US009206600B2

(12) United States Patent
Von Hoyningen Huene et al.

(10) Patent No.: US 9,206,600 B2
(45) **Date of Patent: *Dec. 8, 2015**

(54) MODULAR WALL SYSTEM

(71) Applicant: Allsteel Inc., Muscatine, IA (US)

(72) Inventors: Eberhard Von Hoyningen Huene, Hudson (CA); Michael Salzman, Dollard-des-Ormeaux (CA); Anneke Struis, Coteau-du-Lac (CA)

(73) Assignee: Allsteel Inc., Muscatine, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/097,461

(22) Filed: Dec. 5, 2013

(65) Prior Publication Data

US 2014/0157720 A1 Jun. 12, 2014

Related U.S. Application Data

(60) Division of application No. 13/594,657, filed on Aug. 24, 2012, now Pat. No. 8,613,168, which is a continuation-in-part of application No. PCT/CA2011/000541, filed on May 5, 2011.

(60) Provisional application No. 61/331,588, filed on May 5, 2010.

(51) Int. Cl.

| | |
|---|---|
| ***E04B 2/00*** | (2006.01) |
| ***E04B 2/74*** | (2006.01) |
| ***E04B 2/82*** | (2006.01) |

(52) U.S. Cl.

CPC ..... *E04B 2/7453* (2013.01); *E04B 2/745* (2013.01); *E04B 2/7407* (2013.01); *E04B 2/7455* (2013.01); *E04B 2/82* (2013.01); *Y10T 29/49947* (2015.01)

(58) Field of Classification Search

CPC ..... E04B 2/82; E04B 2/745; E04B 2/7455; E04B 2/7453; E04B 2/7407; Y10T 29/49947

USPC ..... 52/745.1, 745.19, 745.13, 745.18, 52/745.2, 747.1, 36.1, 79.1, 81.1, 81.2, 52/506.04, 653.1, 238.1, 239–242, 52/262–263, 122.1, 123.1, 118, 64, 235, 52/267, 126.1–126.6, 220.7, 243.1; 182/188.2, 354.1

See application file for complete search history.

(56) References Cited

U.S. PATENT DOCUMENTS

| | | | |
|---|---|---|---|
| 1,498,813 | A | 6/1924 | Sankela et al. |
| 2,387,389 | A | 10/1945 | Goldsmith |

(Continued)

FOREIGN PATENT DOCUMENTS

| | | | |
|---|---|---|---|
| CA | 2002674 | C | 5/1991 |
| CA | 1294107 | C | 1/1992 |

(Continued)

OTHER PUBLICATIONS

FARAM P650 Catalogue, Jan. 2009, 9 pages.

(Continued)

*Primary Examiner* — Jeanette E Chapman

(74) *Attorney, Agent, or Firm* — Faegre Baker Daniels LLP

(57) ABSTRACT

A wall panel of a moveable and demountable frameless wall panel system that is secured between a floor of a room and a ceiling rail secured to a ceiling of the room. The wall panel includes a frameless panel, an upper clamp assembly, a ceiling track configured to be removably inserted into the ceiling rail, a lower clamp assembly, a first height adjustment mechanism secured to the lower clamp assembly, a second height adjustment mechanism, and a bottom floor channel receiving the first height and second height adjustment mechanisms.

21 Claims, 55 Drawing Sheets

(56) References Cited

U.S. PATENT DOCUMENTS 2,394,443 A 2/1946 Guignon, Jr.
2,822,898 A 2/1958 Richards
3,040,847 A 6/1962 Webster
3,048,882 A 8/1962 Tucker et al.
3,057,005 A 10/1962 Dishaw
3,057,444 A 10/1962 Walberg
3,141,189 A 7/1964 Fergison
3,159,866 A 12/1964 Kellems
3,228,160 A 1/1966 O'Brien
3,234,582 A 2/1966 Bates
3,302,353 A 2/1967 Du Pradal
3,305,983 A 2/1967 Bus
3,350,828 A 11/1967 Russell
3,352,078 A 11/1967 Neal
3,363,383 A 1/1968 La Barge
3,381,436 A 5/1968 Elliott et al.
3,411,252 A 11/1968 Boyle, Jr.
3,453,789 A * 7/1969 Stephenson ..... 52/126.3
3,566,559 A 3/1971 Dickson
3,570,200 A 3/1971 Ritner et al.
3,574,985 A 4/1971 Pierce
3,585,768 A 6/1971 Klein
3,594,028 A 7/1971 Scott
3,653,156 A 4/1972 Horgan, Jr.
3,670,357 A 6/1972 Steigerwald
3,675,382 A 7/1972 Lickliter et al.
3,697,028 A 10/1972 Nimmo
3,722,026 A 3/1973 Wilhelmi
3,802,480 A 4/1974 Daggy
3,829,930 A 8/1974 McNinch
3,885,361 A 5/1975 De Schutter
3,925,933 A 12/1975 Reuter
4,027,714 A 6/1977 Dixon et al.
4,037,380 A 7/1977 Pollock
4,067,165 A 1/1978 Timmons
4,086,734 A 5/1978 Hayashi
4,103,463 A 8/1978 Dixon
4,104,829 A 8/1978 Agcaoili
4,109,429 A 8/1978 Whisson
4,144,924 A 3/1979 Vanden Hoek
4,157,743 A 6/1979 Masuda et al.
4,167,084 A 9/1979 Brunton
4,263,761 A 4/1981 Kristoff
4,277,920 A 7/1981 Dixon
4,282,631 A 8/1981 Uehara et al.
4,399,644 A 8/1983 Bright
4,407,101 A 10/1983 Propst et al.
4,416,093 A 11/1983 Salkeld et al.
4,438,614 A 3/1984 Raith et al.
4,449,337 A 5/1984 Gzym et al.
4,450,658 A 5/1984 Legeai
4,453,346 A 6/1984 Powell et al.
4,555,880 A 12/1985 Gzym et al.
4,561,232 A 12/1985 Gladden, Jr. et al.
4,570,397 A 2/1986 Creske
4,625,476 A 12/1986 Shimada
4,640,072 A 2/1987 Muhle
4,667,450 A 5/1987 Stefnik et al.
4,703,598 A 11/1987 Wilson et al.
4,712,653 A 12/1987 Franklin et al.
4,757,657 A 7/1988 Mitchell et al.
4,825,610 A 5/1989 Gasteiger
4,873,741 A 10/1989 Riegelman
4,881,353 A 11/1989 Braendel et al.
4,907,384 A 3/1990 Underwood
4,914,880 A 4/1990 Albertini
4,914,888 A 4/1990 Hanson
5,003,740 A 4/1991 Dull et al.
5,042,555 A 8/1991 Owens
5,056,577 A 10/1991 DeLong et al.
5,092,385 A 3/1992 Beaulieu
5,125,201 A 6/1992 Pieters et al.
5,159,793 A 11/1992 Deugo et al.
5,161,330 A 11/1992 Auriemma
5,175,969 A 1/1993 Knauf et al.
5,207,037 A 5/1993 Giles et al.
5,212,918 A 5/1993 Newhouse et al.
5,228,254 A 7/1993 Honeycutt, Jr.
5,237,786 A 8/1993 Kochansky
5,379,560 A 1/1995 Steller
5,381,845 A 1/1995 Ruggie et al.
5,433,046 A 7/1995 MacQuarrie et al.
5,444,958 A 8/1995 Lu
5,467,559 A 11/1995 Owens
5,491,943 A 2/1996 Vondrejs et al.
5,542,219 A 8/1996 Dias
5,586,593 A 12/1996 Schwartz
5,600,926 A 2/1997 Ehrlich
5,603,192 A 2/1997 Dickson
5,644,877 A 7/1997 Wood
5,644,878 A 7/1997 Wehrmann
5,735,089 A 4/1998 Smith et al.
5,802,789 A 9/1998 Goodman et al.
5,822,935 A 10/1998 Mitchell et al.
5,826,385 A 10/1998 Dykstra et al.
5,836,121 A 11/1998 Hofman
5,839,240 A 11/1998 Elsholz et al.
5,845,363 A 12/1998 Brempell et al.
5,852,904 A 12/1998 Yu et al.
5,867,955 A 2/1999 Russell
5,870,867 A 2/1999 Mitchell
5,875,596 A 3/1999 Muller
5,881,979 A 3/1999 Rozier, Jr. et al.
5,943,834 A 8/1999 Jeffers et al.
5,996,299 A 12/1999 Hsueh
6,047,508 A 4/2000 Goodman et al.
6,058,665 A 5/2000 Halvorson, Jr. et al.
6,088,877 A 7/2000 Swy et al.
6,094,872 A 8/2000 Ward et al.
6,112,472 A 9/2000 Van Dyk et al.
6,112,485 A 9/2000 Beyer et al.
6,115,968 A 9/2000 Sarlanis
6,122,871 A 9/2000 Russell et al.
6,141,925 A 11/2000 Halvorson, Jr. et al.
6,167,937 B1 1/2001 Williams
6,170,213 B1 1/2001 Zarrelli et al.
6,176,054 B1 1/2001 Allen et al.
6,185,784 B1 2/2001 Gamperle
6,209,273 B1 4/2001 Jeffers et al.
6,209,610 B1 4/2001 Davies et al.
6,223,485 B1 5/2001 Beck et al.
6,250,032 B1 6/2001 Davis et al.
6,260,321 B1 7/2001 Rudduck
6,282,854 B1 9/2001 Vos et al.
6,314,704 B1 * 11/2001 Bryant ..... 52/745.1
6,329,591 B2 12/2001 Karst et al.
6,336,247 B1 1/2002 Schnoor
6,341,457 B1 1/2002 Aerts et al.
6,349,516 B1 2/2002 Powell et al.
6,393,783 B2 5/2002 Emaus et al.
6,397,533 B1 6/2002 Hornberger et al.
6,405,781 B2 6/2002 Davies et al.
6,418,671 B1 7/2002 DeRuiter et al.
6,481,168 B1 11/2002 Hodges et al.
6,493,995 B2 12/2002 McKenzie
6,530,181 B1 3/2003 Seiber et al.
6,557,310 B2 5/2003 Marshall et al.
6,571,519 B1 6/2003 Diffrient et al.
6,609,350 B1 8/2003 Weber
6,619,008 B1 9/2003 Shivak et al.
6,651,396 B2 11/2003 DeRuiter et al.
6,672,430 B2 1/2004 Boucher et al.
6,688,056 B2 2/2004 Huene et al.
6,729,085 B2 5/2004 Newhouse et al.
6,748,997 B2 6/2004 Fricano et al.
6,820,388 B2 11/2004 Newhouse et al.
6,889,477 B1 5/2005 Kottman
6,920,727 B2 7/2005 Yu et al.
6,990,909 B2 1/2006 Gosling et al.
7,021,007 B2 4/2006 Jacobs
7,150,127 B2 12/2006 Underwood et al.
7,293,389 B2 11/2007 Jacobs
7,331,425 B2 * 2/2008 Bukowski et al. ..... 187/269
7,520,093 B2 4/2009 Guhl

(56) References Cited

U.S. PATENT DOCUMENTS

| | | | |
|---|---|---|---|
| 7,568,311 | B2 | 8/2009 | Shivak et al. |
| 7,603,821 | B2 | 10/2009 | Eberlein et al. |
| 7,624,549 | B2 | 12/2009 | Kopish |
| 7,644,552 | B2 | 1/2010 | Kuipers et al. |
| 7,712,260 | B2 | 5/2010 | Vardaro et al. |
| 7,752,817 | B2 | 7/2010 | Pilz et al. |
| 7,814,711 | B2 | 10/2010 | Milligan et al. |
| 7,866,445 | B2 | 1/2011 | Bukowski et al. |
| 8,024,901 | B2 | 9/2011 | Gosling et al. |
| 8,046,962 | B2 | 11/2011 | Glick et al. |
| 8,176,707 | B2 | 5/2012 | Gosling et al. |
| 8,186,917 | B2 | 5/2012 | Nelson et al. |
| 8,297,004 | B2 | 10/2012 | Knight, III et al. |
| 8,601,749 | B2 | 12/2013 | Huene Von Hoyningen et al. |
| 8,613,168 | B2 | 12/2013 | Huene et al. |
| 8,615,936 | B2 | 12/2013 | Huene et al. |
| 2002/0053166 | A1 | 5/2002 | Fries |
| 2002/0088188 | A1 | 7/2002 | Chang |
| 2002/0108330 | A1 | 8/2002 | Yu et al. |
| 2002/0121056 | A1 | 9/2002 | Von Hoyningen Huene et al. |
| 2002/0157335 | A1 | 10/2002 | Vos |
| 2002/0178667 | A1 | 12/2002 | Elmer |
| 2002/0189172 | A1 | 12/2002 | Kaeser et al. |
| 2003/0014853 | A1 | 1/2003 | Hostetler et al. |
| 2003/0089057 | A1 | 5/2003 | Wiechecki et al. |
| 2003/0194907 | A1 | 10/2003 | Riner et al. |
| 2003/0221384 | A1 | 12/2003 | Burken et al. |
| 2004/0003556 | A1 | 1/2004 | Zerbst |
| 2004/0035074 | A1 | 2/2004 | Stanescu et al. |
| 2004/0177573 | A1 | 9/2004 | Newhouse et al. |
| 2005/0000164 | A1 | 1/2005 | Jacobs |
| 2006/0059806 | A1 | 3/2006 | Gosling et al. |
| 2006/0185250 | A1 | 8/2006 | Gosling et al. |
| 2006/0185276 | A1 | 8/2006 | Pai |
| 2006/0277850 | A1 | 12/2006 | Gravel et al. |
| 2007/0017065 | A1 | 1/2007 | Hutnik et al. |
| 2007/0245640 | A1 | 10/2007 | Bergqvist |
| 2008/0202030 | A1 | 8/2008 | Heiniger et al. |
| 2009/0038764 | A1 | 2/2009 | Pilz |
| 2010/0051763 | A1 | 3/2010 | Knight et al. |
| 2011/0099929 | A1 | 5/2011 | Liegeois et al. |
| 2012/0317894 | A1 | 12/2012 | Huene et al. |
| 2012/0317895 | A1 | 12/2012 | Huene et al. |
| 2012/0317899 | A1 | 12/2012 | Huene et al. |
| 2013/0000224 | A1 | 1/2013 | Von Hoyningen Huene et al. |
| 2013/0192141 | A1 | 8/2013 | Kopish et al. |

FOREIGN PATENT DOCUMENTS

| | | | |
|---|---|---|---|
| CA | 2162300 | A | 5/1997 |
| CA | 2273631 | C | 10/1999 |
| CA | 2310869 | C | 12/2000 |
| CA | 2349964 | C | 12/2001 |
| CA | 2324050 | A1 | 4/2002 |
| CA | 2359547 | C | 4/2002 |
| CA | 2348060 | C | 11/2002 |
| CA | 2359165 | A1 | 4/2003 |
| CA | 2428593 | C | 11/2003 |
| CA | 2590527 | A1 | 11/2008 |
| CN | 2295731 | Y | 10/1998 |
| DE | 2807558 | A1 | 8/1979 |
| DE | 10247416 | A1 | 4/2004 |
| DE | 10341117 | B4 | 4/2005 |
| DE | 10359444 | B4 | 7/2005 |
| DE | 102008051354 | A1 | 4/2010 |
| DE | 102008051356 | B4 | 4/2010 |
| DE | 102010015574 | A1 | 10/2011 |
| EP | 0730066 | A | 9/1996 |
| EP | 0963719 | A2 | 12/1999 |
| EP | 1094167 | A2 | 4/2001 |
| FR | 70624 | E | 6/1959 |
| FR | 1356877 | A | 2/1964 |
| FR | 1450107 | A | 5/1966 |
| FR | 1526637 | A | 5/1968 |
| FR | 2378912 | A1 | 8/1978 |
| FR | 2755160 | A1 | 4/1998 |
| GB | 1259347 | A | 1/1972 |
| GB | 1400613 | A | 7/1975 |
| GB | 2171135 | A | 8/1986 |
| GB | 2283071 | A | 4/1995 |
| JP | 6414454 | A | 1/1989 |
| JP | 5112992 | A | 5/1993 |
| JP | 09158372 | A | 6/1997 |
| JP | 2000160745 | A | 6/2000 |
| JP | 2001003498 | A | 1/2001 |
| JP | 2006200247 | A | 8/2006 |
| JP | 2007169932 | A | 7/2007 |
| WO | 9946455 | A2 | 9/1999 |
| WO | 0075447 | A1 | 12/2000 |
| WO | WO0214616 | A1 | 2/2002 |
| WO | WO02005211 | A1 | 7/2002 |
| WO | WO2008116741 | A1 | 10/2008 |

OTHER PUBLICATIONS

International Search Report issued in PCT/CA2011/000541, dated Sep. 6, 2011, 4 pages.

Konig + Neurath Office Furniture Systems, Seating Systems, Room Systems, copyright 2007, 87 pages.

Partial International Search Report issued in PCT/US2013/056247, mailed Dec. 13, 2013, 8 pages.

Office Action issued in U.S. Appl. No. 13/754,417, mailed Feb. 12, 2014, 14 pages.

International Search Report and Written Opinion issued in PCT/US2013/056247, mailed Mar. 12, 2014, 27 pages.

* cited by examiner 301
331
315
333
337
325a
305
511
325b 329
327
325
335
477

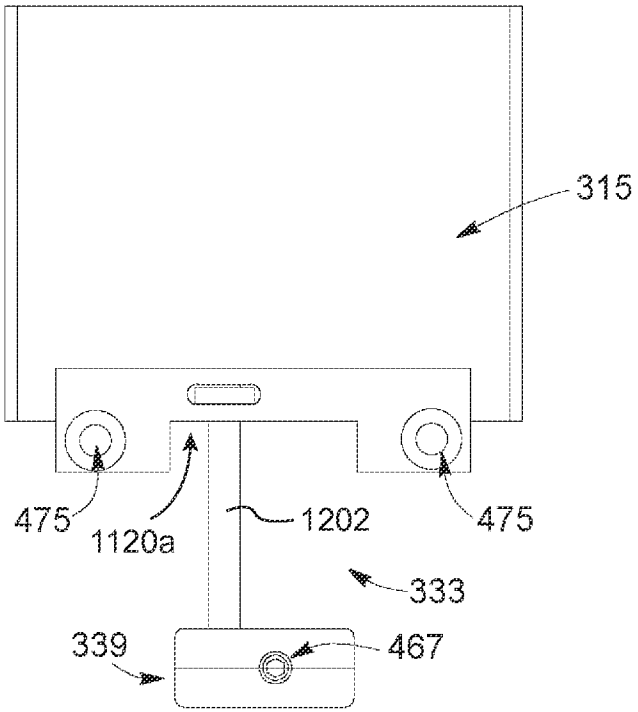
FIG. 36
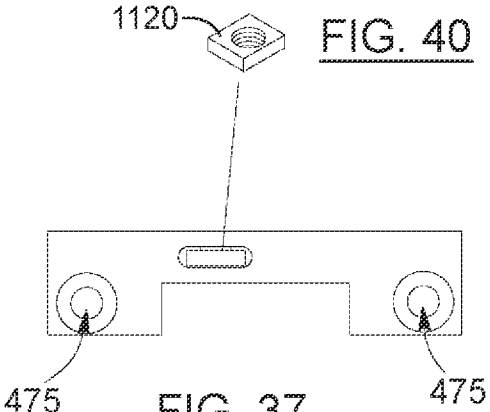
FIG. 40
FIG. 37
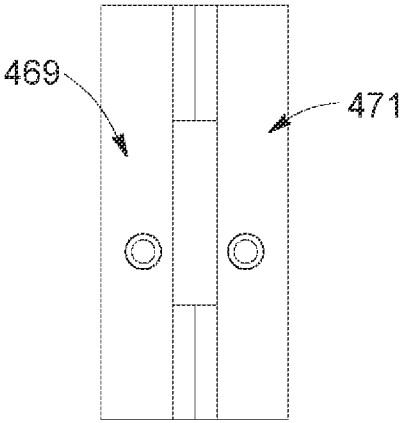
FIG. 39
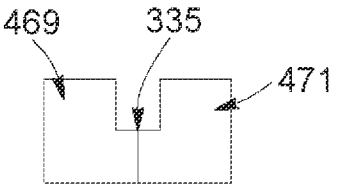
FIG. 38

515

515

515
529
523
517
529

515
529
523
521
517
519
529
523

531
527
535
533
535

531
535
535
533

531
535
535
533

305
527
527

527
315

305
507
315
527
509

515
527
315
531

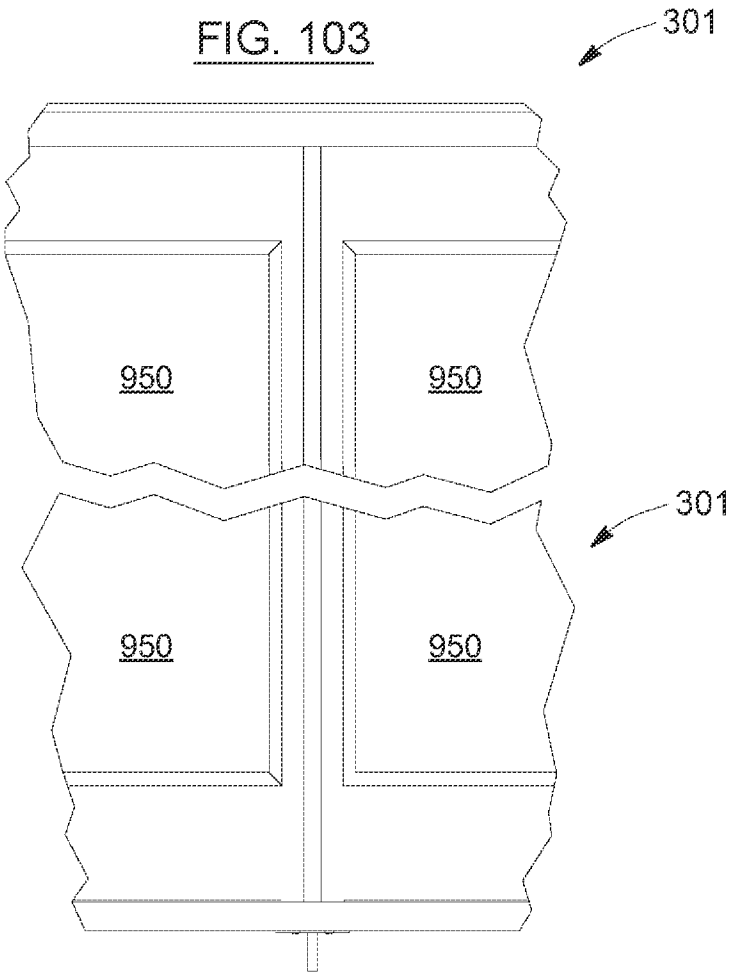
FIG. 103
FIG. 104
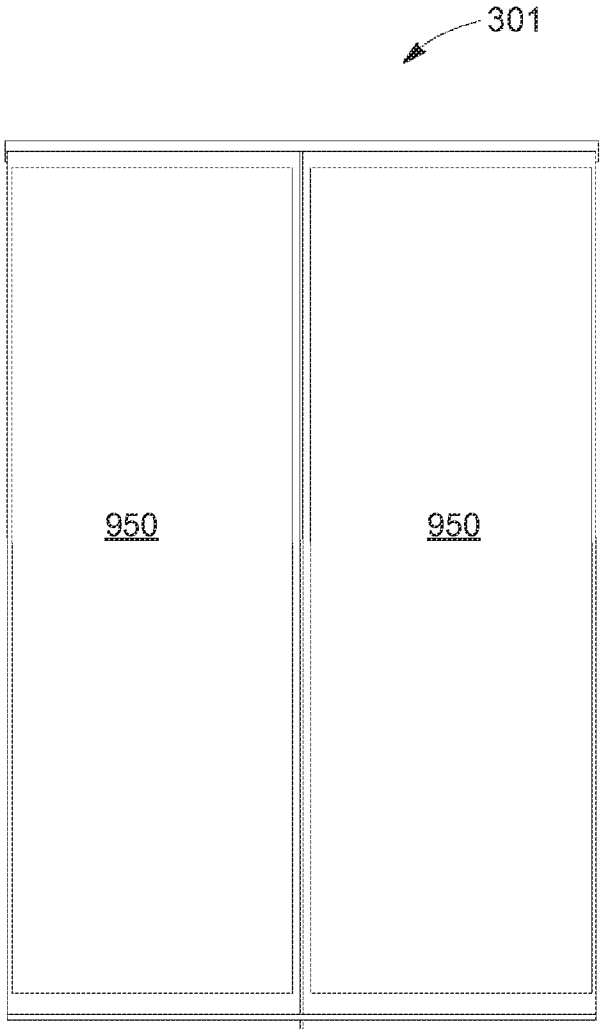
FIG. 102

MODULAR WALL SYSTEM

CROSS-REFERENCE TO RELATED APPLICATION

This application is a divisional of U.S. patent application Ser. No. 13/594,657, entitled "MODULAR WALL SYSTEM", filed Aug. 24, 2012, which is a continuation-in-part under 35 U.S.C. 120 of International Patent Application No. PCT/CA2011/000541, entitled "MOVEABLE AND DEMOUNTABLE WALL PANEL SYSTEM FOR BUTT-GLAZED WALL PANELS," and having an international filing date of May 5, 2011, which claims priority to Provisional application Ser. No. 61/331,588 filed May 5, 2010, all of which are incorporated herein by reference in their entireties for all purposes.

TECHNICAL FIELD

The present invention relates to a wall panel system. More particularly, the present invention relates to a moveable non-progressive mountable and demountable wall panel system for butt-glazed wall panels.

BACKGROUND

Fixed wall systems, moveable wall systems, and non-progressive wall systems are very well known in the art.

Some problems associated with fixed wall systems are the inability to displace and/or move the fixed wall systems once they are mounted; the inability to readily install pass through components (wiring, etc.) after the fixed wall systems have been mounted; and the inability to readily change aspects and features of the fixed wall systems once they are installed. Furthermore, fixed wall systems are also disadvantageous because their installation is quite lengthy. For example, for conventional gyproc walls, one must first install supporting studs, then affix gyproc panels thereto, then plaster thereon, wait for drying of the plaster, sanding subsequently and then finishing the surfaces of the gyproc walls. It is well known in the art that the mounting of such fixed wall systems usually extends over several days and requires a great deal of manual labor, which is thus very inefficient and very cost ineffective.

Some of the problems associated with moveable wall systems are that, very often, their components are over-engineered (e.g. too heavy), different and specialized tooling is required for assembling such moveable wall systems, and the moveable wall systems generally comprise various different components which are not readily interchangeable. As a result of the above-mentioned, installation of such moveable wall systems is generally quite lengthy and cumbersome. Furthermore, it is well known in the art that such moveable wall systems, by virtue of their design, offer generally very poor sound proofing, light proofing and/or vibration proofing.

Some of the problems associated with non-progressive wall systems are the inability to independently change, move, and/or alter a particular component of the non-progressive wall system without affecting the other components operatively connected to said particular component. Indeed, by virtue of their design, non-progressive wall systems generally have several components which are intricately connected to one another and thus prevent one particular component thereof from being changed, moved, and/or altered without disturbing the other components of the non-progressive wall system.

Furthermore, with several conventional wall panel systems, certain components thereof need to be anchored (penetrated, nailed, screwed, etc.) into the floor or the ceiling, which leads to substantial drawbacks, such as holes in the floor and/or corresponding carpet, damages to property, etc. Moreover, it is also known that in some jurisdictions, when components of wall panel systems are permanently affixed to the infrastructure of a building, they become the property of the building owner, which is very undesirable for the owners and/or users of such wall panel systems. It is also known that in large corporations, the different departments need to be restructured on a regular basis, therefore, leading to a frequent reorganization of office spaces, with associated inconveniences. Therefore, it would be very useful to have a prefabricated and modular wall panel construction system that could be assembled without being permanently affixed to an infrastructure of a building, and could be easily moveable and demountable, from one location to another, whether within the same building, or from one building to the next, without leaving any adverse or destructive effects behind.

Known to the Applicant are the following American documents which describe 5 different wall panel systems and accessories: U.S. Pat. Nos. 2,387,389; 2,394,443; 2,822,898; 3,040,847; 3,048,882; 3,057,005; 3,057,444; 3,141,189; 3,159,866; 3,228,160; 3,234,582; 3,302,353; 3,305,983; 3,352,078; 3,363,383; 3,381,436; 3,411,252; 3,566,559; 3,585,768; 3,670,357; 3,675,382; 3,697,028; 3,722,026; 3,802,480; 3,829,930; 3,925,933; 4,027,714; 4,037,380; 4,067,165; 4,086,734; 4,103,463; 4,104,829; 4,109,429; 4,167,084; 4,263,761; 4,277,920; 4,282,631; 4,399,644; 4,449,337; 4,450,658; 4,555,880; 4,625,476; 4,640,072; 4,703,598; 4,757,657; 4,825,610; 4,873,741; 4,907,384; 4,914,880; 5,042,555; 5,056,577; 5,125,201; 5,159,793; 5,161,330; 5,207,037; 5,212,918; 5,228,254; 5,237,786; 5,379,560; 5,381,845; 5,433,046; 5,467,559; 5,491,943; 5,542,219; 5,603,192; 5,644,877; 5,644,878; 5,735,089; 5,845,363; 5,875,596; 5,881,979; 5,996,299; 6,047,508; 6,088,877; 6,094,872; 6,112,485; 6,115,968; 6,141,925; 6,167,937 B1; 6,122,871; 6,170,213 B1; 6,176,054 B1; 6,185,784 B1; 6,209,610 B1; 6,329,591 B2; 6,336,247 B1; 6,349,516 B1; 6,405,781 B2; 6,493,995 B2; 6,530,181 B1; 6,571,519 B1; 6,889,477 B1; 7,021,007 B2; 7,293,389 B2; 7,520,093 B2; 7,624,549 B2; 2002/0053166 A1; 2002/0088188 A1; 2002/0157335 A1; 2003/0014853 A1; 2004/0003556 A1; 2005/0000164 A1; 2006/0277850 A1; 2007/0017065 A1; and 2008/0202030 A1.

Known to the Applicant are also the following foreign documents: CA 2,002,674; FR 1,450,017; FR 1,526,637 and GB 2,171,135 A.

A movable and demountable wall panel system for framed wall panels, that is, substantially rectangular shaped wall panels comprising opposite top and bottom distance channels, and opposite side vertical posts, with outer covers, having been designed by the Applicant of the present case, is the one described in U.S. Pat. No. 6,688,056 B2 granted on Feb. 10, 2004, to VON HOYNINGEN HUENE et al. More particularly, this document describes a moveable and demountable wall panel system including a plurality of panels each having opposite top and bottom distance channels, opposite left and right vertical posts, a panel covering, a ceiling rail, and an articulating floor channel. The distance channels and vertical posts are affixed to one another by connecting studs in order to form a rectangular support frame of the panel. The articulating floor channel is operatively connected to a bottom portion of the rectangular support frame by left and right glide assemblies mounted into receiving channels of the left and right vertical posts respectively. The articulating floor channel is used for operatively securing the rectangular support frame of the panel to a ground surface. Each vertical post has at least one receiving lip extending along a direction substantially parallel to the vertical axis of the panel.

Despite several improvements in the field, when assembling office spaces using frameless butt-glazed wall panels, these office spaces are still built using a very old and conventional "stick-built" or "knock-down" approach. That is, one generally goes on site, takes the different measurements, including floor and/or ceiling deviations, where the office space is to be assembled, will then generally manufacture corresponding glass panels of different heights and widths in order to accommodate or compensate for these different particular deviations, and will assemble the office space in a very progressive manner, on site. By assigning each specific glass panel of different dimensions to a corresponding place where it is assigned to, and afterward adjusting positioning, height and vertical displacement of each one of said different types of glass panels in a manual manner, using a plurality of shimmies that are inserted accordingly under each of said glass panels in an attempt to have an overall uniform wall panel assembly, and compensate for possible floor and/or ceiling deviations. Obviously, this approach is not only very long, but quite cumbersome from a logistical point of view, as well as being very labor intensive, and is not very efficient when having to assemble several office spaces in large corporations.

None of the above-mentioned patents seem to disclose or even suggest a movable non-progressive mountable and demountable wall panel system which is designed to assemble "frameless" butt-glazed wall panels in a very fast, easy, convenient, proper, systematic and cost-effective manner, thereby avoiding the corresponding drawbacks of the "stick-built" approach of conventional wall panel systems.

Hence, in light of the aforementioned, there is a need for an improved system which, by virtue of its design and components, would be able to overcome or at least minimize some of the aforementioned prior art problems.

SUMMARY

Some embodiments relate to a wall panel of a moveable and demountable frameless wall panel system that is secured between a floor of a room and a ceiling rail secured to a ceiling of the room. The wall panel includes a frameless panel, an upper clamp assembly, a ceiling track configured to be removably inserted into the ceiling rail, a lower clamp assembly, a first height adjustment mechanism secured to the lower clamp assembly, a second height adjustment mechanism, and a bottom floor channel receiving the first height and second height adjustment mechanisms.

Some embodiments relate to moveable and demountable wall panel systems for defining an office space with a plurality of wall panels disposable in a substantially upright manner between a floor and a ceiling each having respectively a series of uppermost and lowermost deviations, each wall panel having a vertical axis and a horizontal axis, and comprising: at least one prefabricated frameless panel, each panel having a given height defined between top and bottom edges, and a given width defined between left and right side edges, the top edge of each panel being provided with a ceiling track configured for being removably insertable into a corresponding ceiling rail extending along the ceiling and delimiting the office space;

a bottom floor channel associated with each corresponding panel and being configured for operatively resting against the floor opposite to the ceiling rail extending along the ceiling;

integrated first and second power-drivable height adjustment assemblies associated with each panel and insertable into a corresponding bottom floor channel, each height adjustment assembly comprising a support edge for operatively supporting a bottom portion of each panel, each height adjustment assembly being selectively operable as to be adjustably raised or lowered, thereby allowing a vertical height adjustment of each panel and a rotational angle adjustment thereof; and at least one connecting plate for removably connecting a pair of bottom floor channels, each connector and bottom channel being positioned, shaped and sized with respect to one another for ensuring that the side edges of a pair of neighboring prefabricated frameless panels cooperate with one another in order to define the office space.

Some embodiments provide a prefabricated, modular and frameless butt-glazed wall panel construction system that can be moveable and demountable, from one location to another, without a "stickbuilt" approach, and without leaving any adverse or destructive effects behind.

According to another aspect of the present invention, there is provided a method of using the above-mentioned wall panel system and/or components thereof.

According to another aspect of the present invention, there is provided a method of installing the above-mentioned wall panel system and/or components thereof.

According to another aspect of the present invention, there is provided an office space having been defined with the above-mentioned wall panel system and/or components thereof. According to another aspect of the present invention, there is provided a kit with corresponding components for assembling the above-mentioned office space.

According to yet another aspect of the present invention, there is also provided a method of assembling components of the above-mentioned kit. According to yet another aspect of the present invention, there is also provided a method of doing business with the above-mentioned wall panel system, kit and/or corresponding method(s).

The objects, advantages and other features of the present invention will become more apparent upon reading of the following non-restrictive description of preferred embodiments thereof, given for the purpose of exemplification only, with reference to the accompanying drawings.

BRIEF DESCRIPTION OF THE DRAWINGS

FIG. 36 is another side elevational view of what is shown in FIG. 34.

FIG. 37 is a side elevational view of some of the components shown in FIG. 36.

FIG. 38 is a front elevational view of one of the components shown in FIG. 37.

FIG. 39 is a top plan view of what is shown in FIG. 38.

FIG. 40 is a perspective view of one of the components shown in FIG. 37.

FIG. 102 is a side elevational view of a pair of glass post panels being assembled onto one another according to a preferred embodiment of the present invention.

FIG. 103 is an enlarged view of a top portion of what is shown in FIG. 102.

FIG. 104 is an enlarged view of a bottom portion of what is shown in FIG. 102.

FIG. 121 is an enlarged view of a bottom portion of what is shown in FIG. 120, an outer shell of one of the solid panels having been removed so as to better illustrate inner components of the assembly.

FIG. 122 is a perspective view of a post connection clip according to a preferred embodiment of the present invention.

FIG. 123 is a side elevational view of what is shown in FIG. 122.

FIG. 124 is a top plan view of what is shown in FIG. 122.

FIG. 125 is a side elevational view of a solid panel metallic frame according to a preferred embodiment of the present invention, the solid panel metallic frame being shown with an adjustable bottom cover.

FIG. 126 is a side view of what is shown in FIG. 125.

FIG. 127 is a perspective view of an intermediate distance channel shown in an exploded relationship with a vertical post of a solid panel metallic frame according to a preferred embodiment of the present invention.

FIG. 128 is a cross-sectional view of an assembled configuration of what is shown in FIG. 127.

FIG. 129 is a side elevational view of a solid panel according to a preferred embodiment of the present invention.

FIG. 130 is a partial enlarged view of some of the components of a solid wall panel according to a preferred embodiment of the present invention, some of the components being shown in an exploded relationship.

FIG. 131 is a cross-sectional view of a portion of a solid wall panel according to a preferred embodiment of the present invention.

FIG. 132 is a perspective view of what is shown in FIG. 131.

Figure 133:
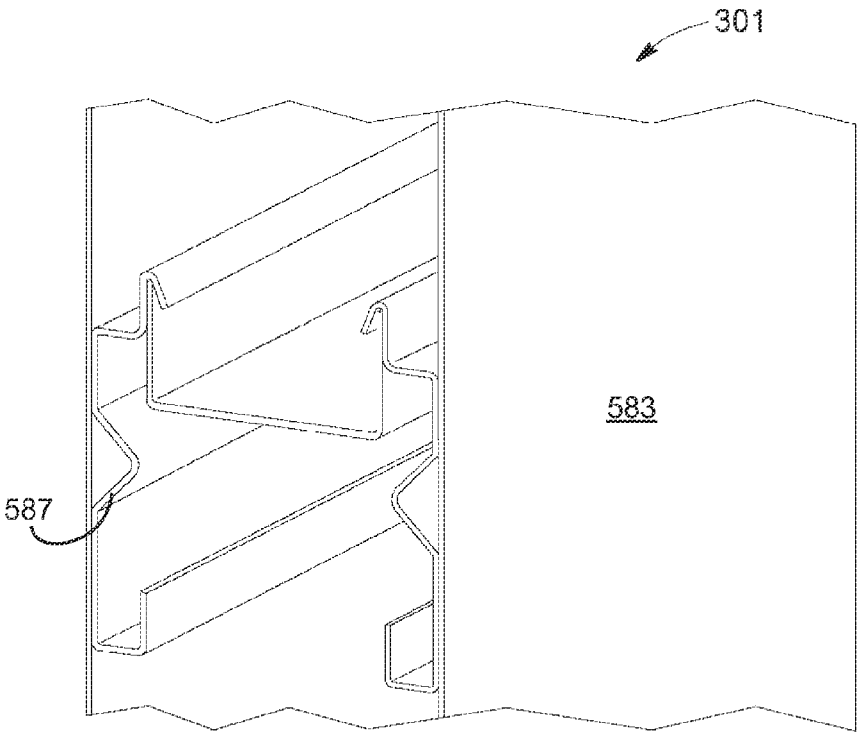

FIG. 133 is a perspective view of a solid panel metallic shell hooking assembly according to a preferred embodiment of the present invention.

Figure 134:
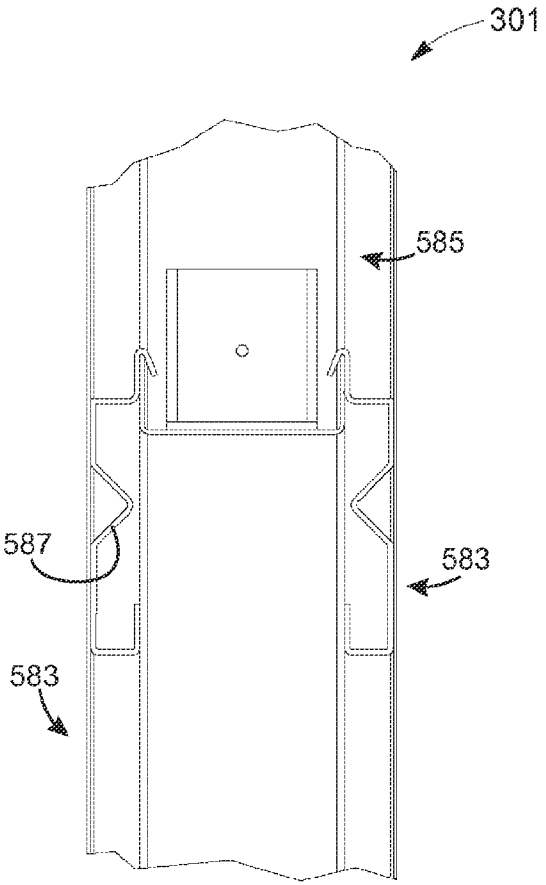

FIG. 134 is a cross-sectional view of what is shown in FIG. 133.

Figure 135:
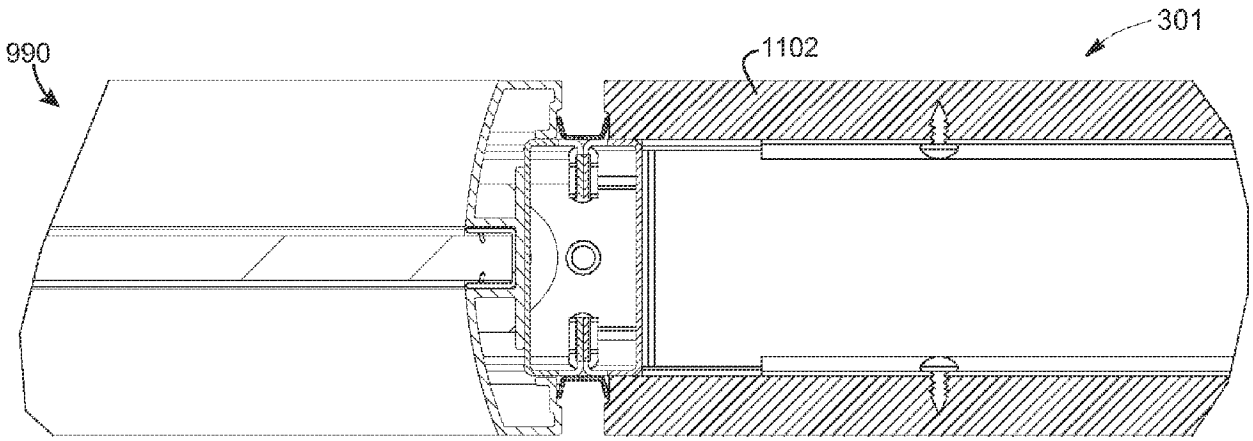

FIG. 135 is a cross-sectional view of a solid panel MDF/stackable and glass pole panel assembly according to a preferred embodiment of the present invention.

Figure 136:
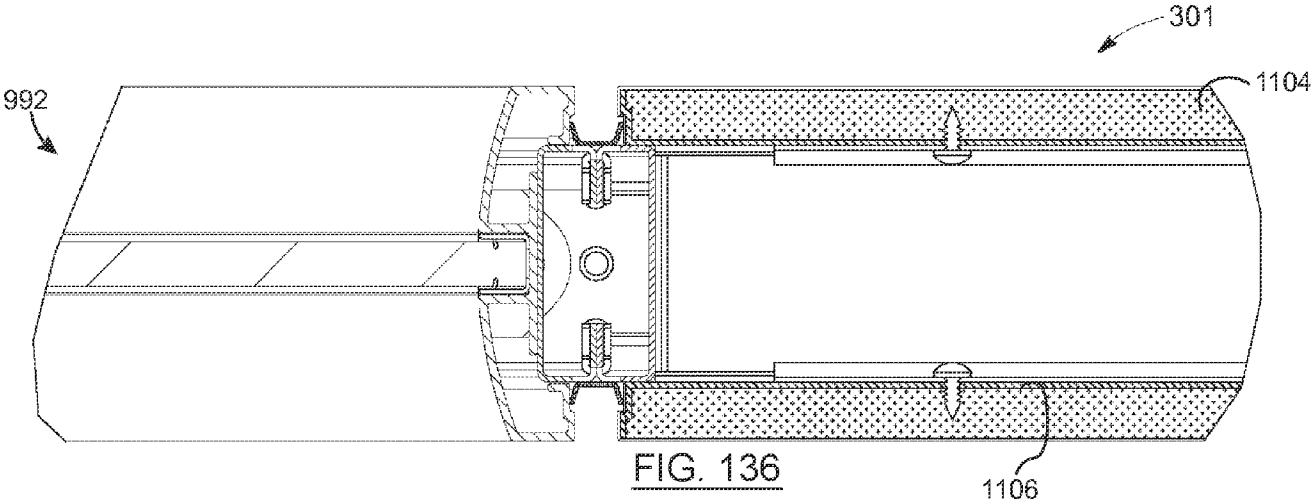

FIG. 136 is a cross-sectional view of a solid panel MDF/stackable and glass pole panel assembly according to another preferred embodiment of the present invention.

Figure 137:
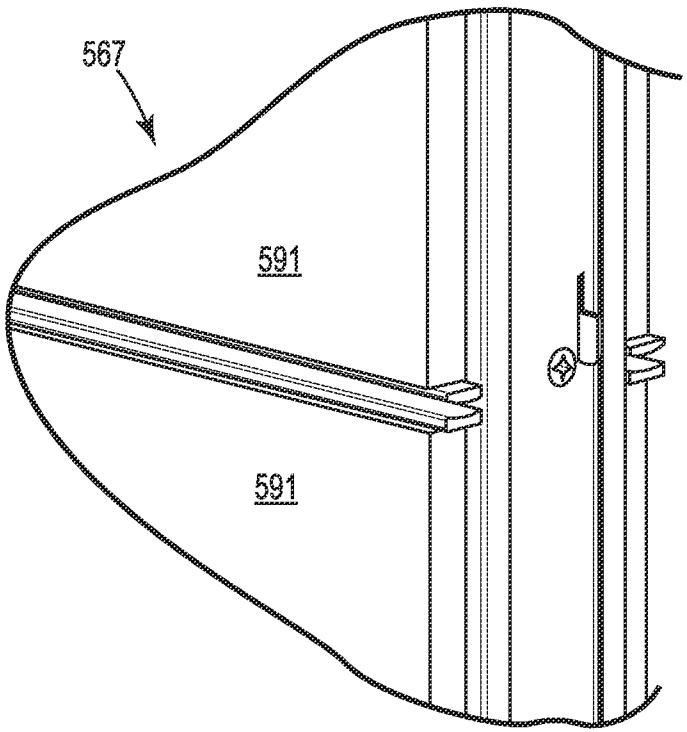

FIG. 137 is a partial perspective view of a wall panel being provided with hooking channels according to a preferred embodiment of the present invention.

Figure 138:
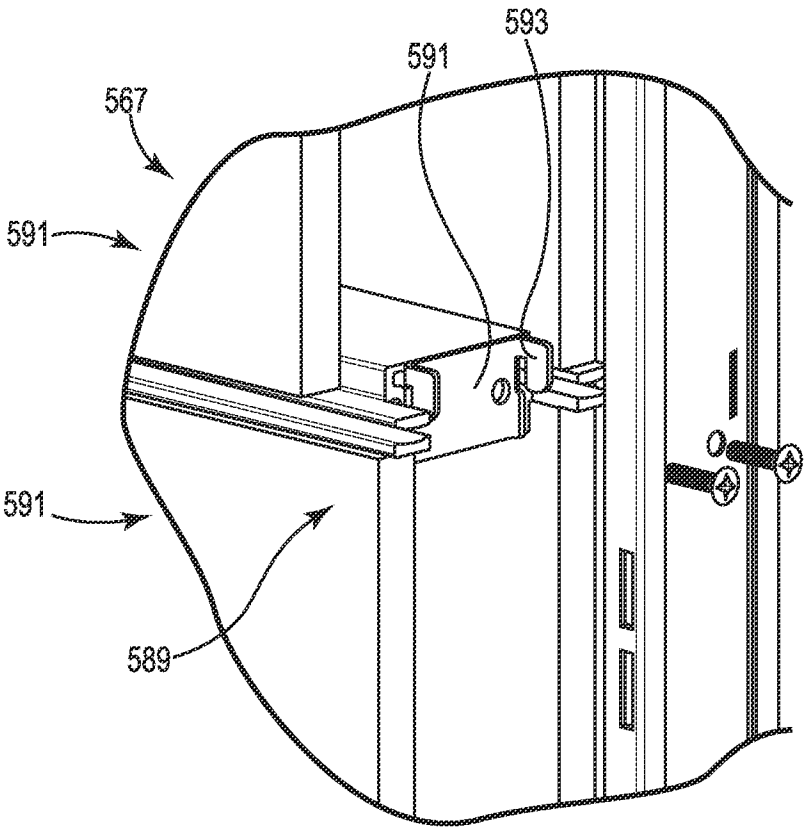

FIG. 138 is an exploded view of what is shown in FIG. 137.

Figure 139:
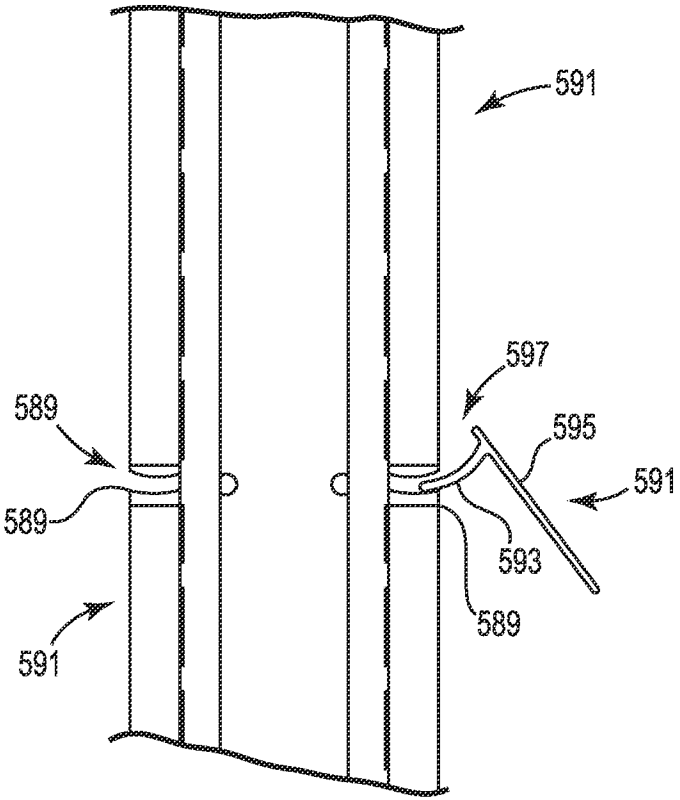

FIG. 139 is a schematic representation of a hooking bracket cooperating with a horizontal hooking channel of a wall panel according to a preferred embodiment of the present invention.

Figure 140:
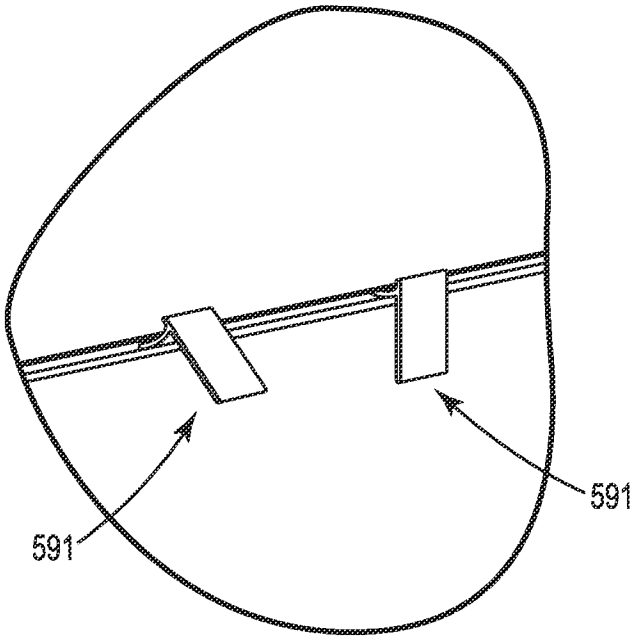

FIG. 140 is a partial view of a wall panel being provided with a pair of hooking brackets, one of said hooking brackets being shown in a hooked configuration within the horizontal hooking channel, and the hooking bracket being shown in intermediate configuration.

Figure 141:
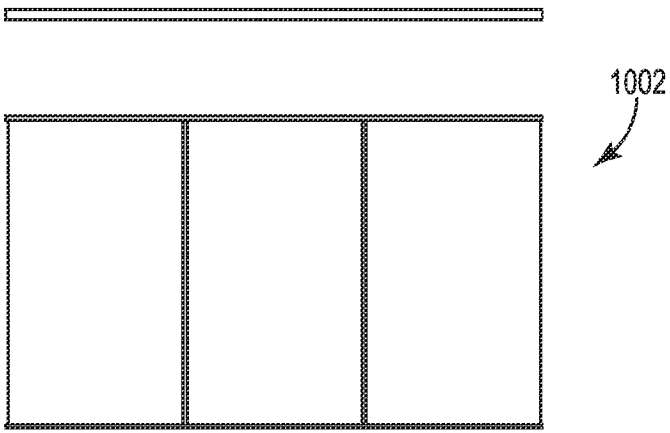

FIG. 141 is a side elevational view of a wall panel assembly disposed along a clear story configuration according to a preferred embodiment of the present invention.

Figure 142:
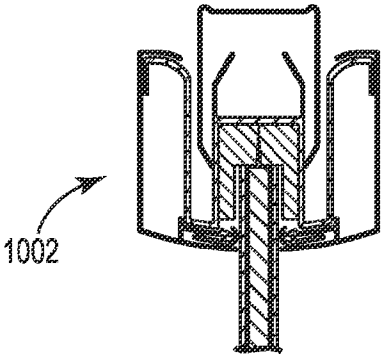

FIG. 142 is an enlarged cross-sectional view of a top portion of what is shown in FIG. 141.

Figure 143:
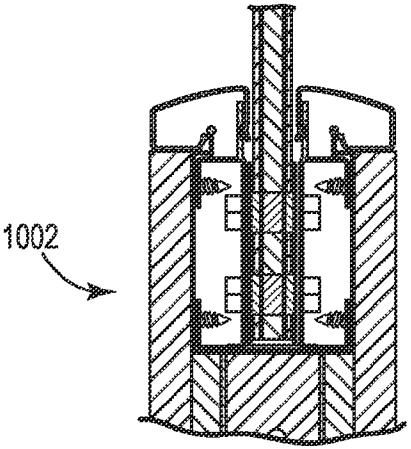

FIG. 143 is an enlarged view of a bottom portion of what is shown in FIG. 141.

Figure 144:
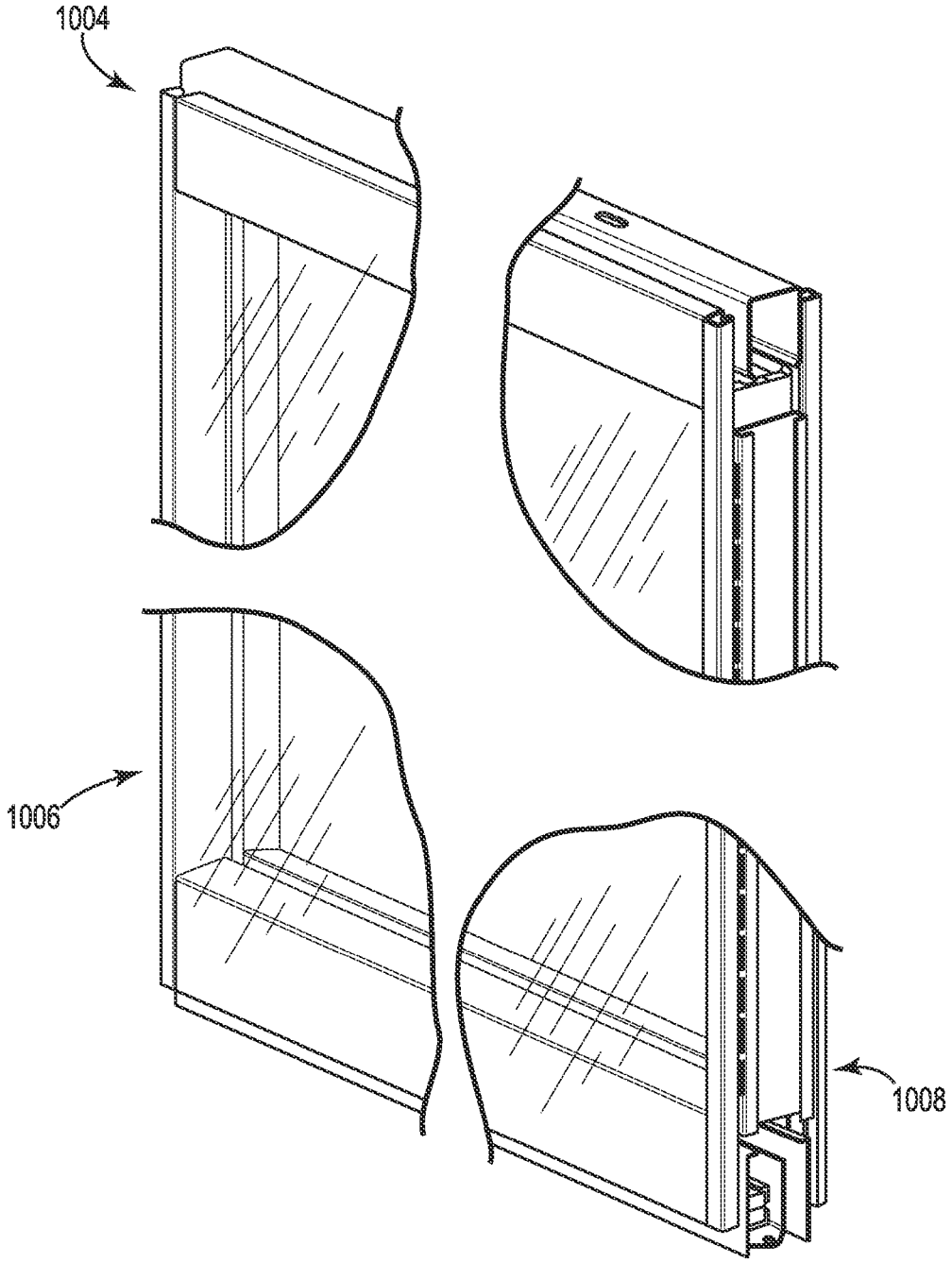

FIG. 144 is a fragmentary perspective view of a framed glass panel being provided with a dropdown cover according to a preferred embodiment of the present invention.

Figure 145:
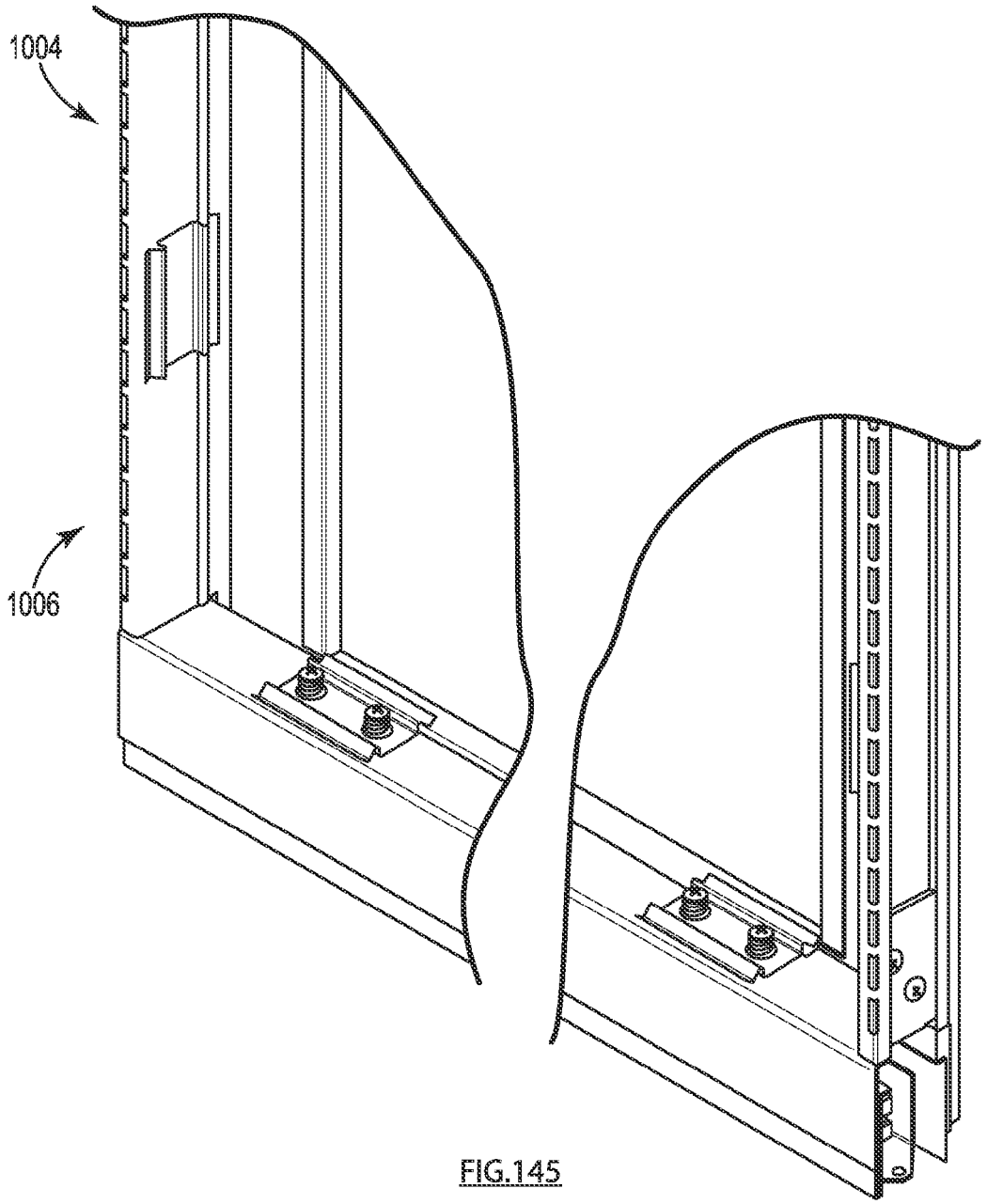

FIG. 145 is a bottom perspective of what is shown in FIG. 144, the framed glass panel being now without a bottom cover.

Figure 146:
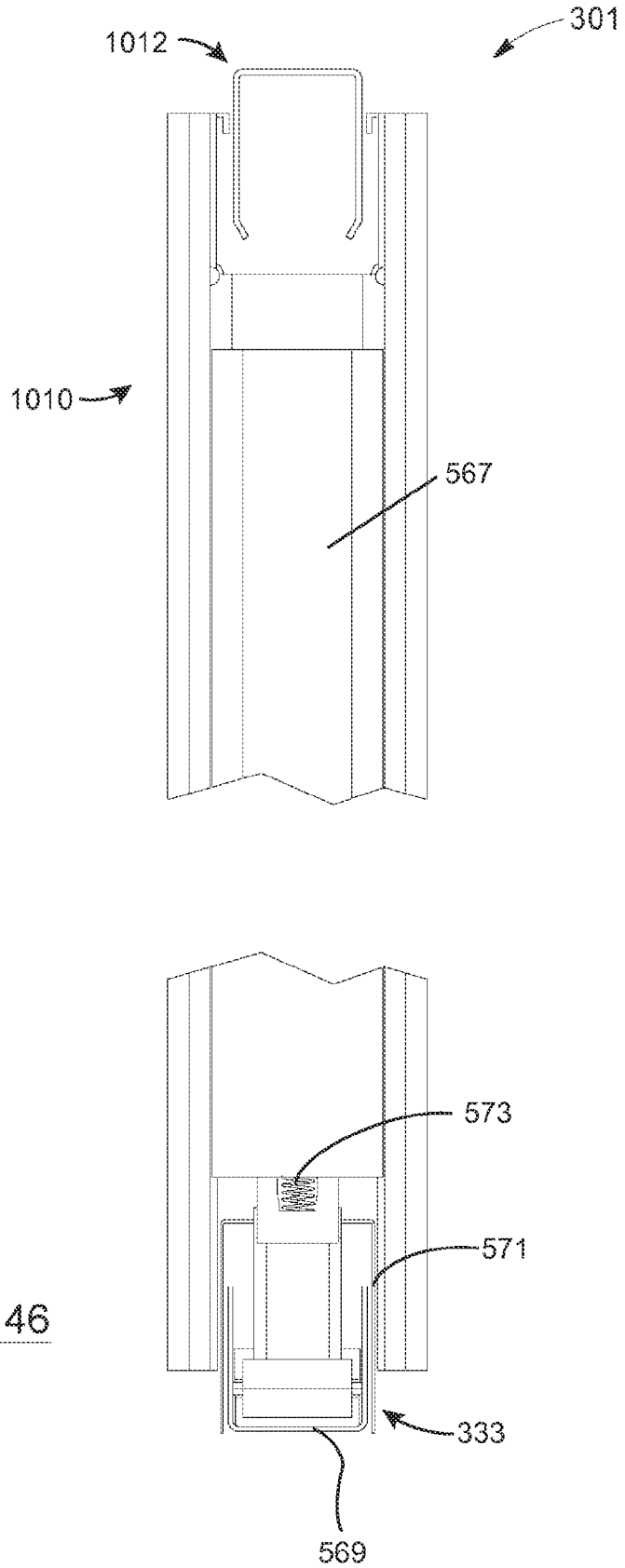

FIG. 146 is a side view of a framed wall panel being provided with a spring-loaded dropdown cover according to a preferred embodiment of the present invention.

Figure 147:
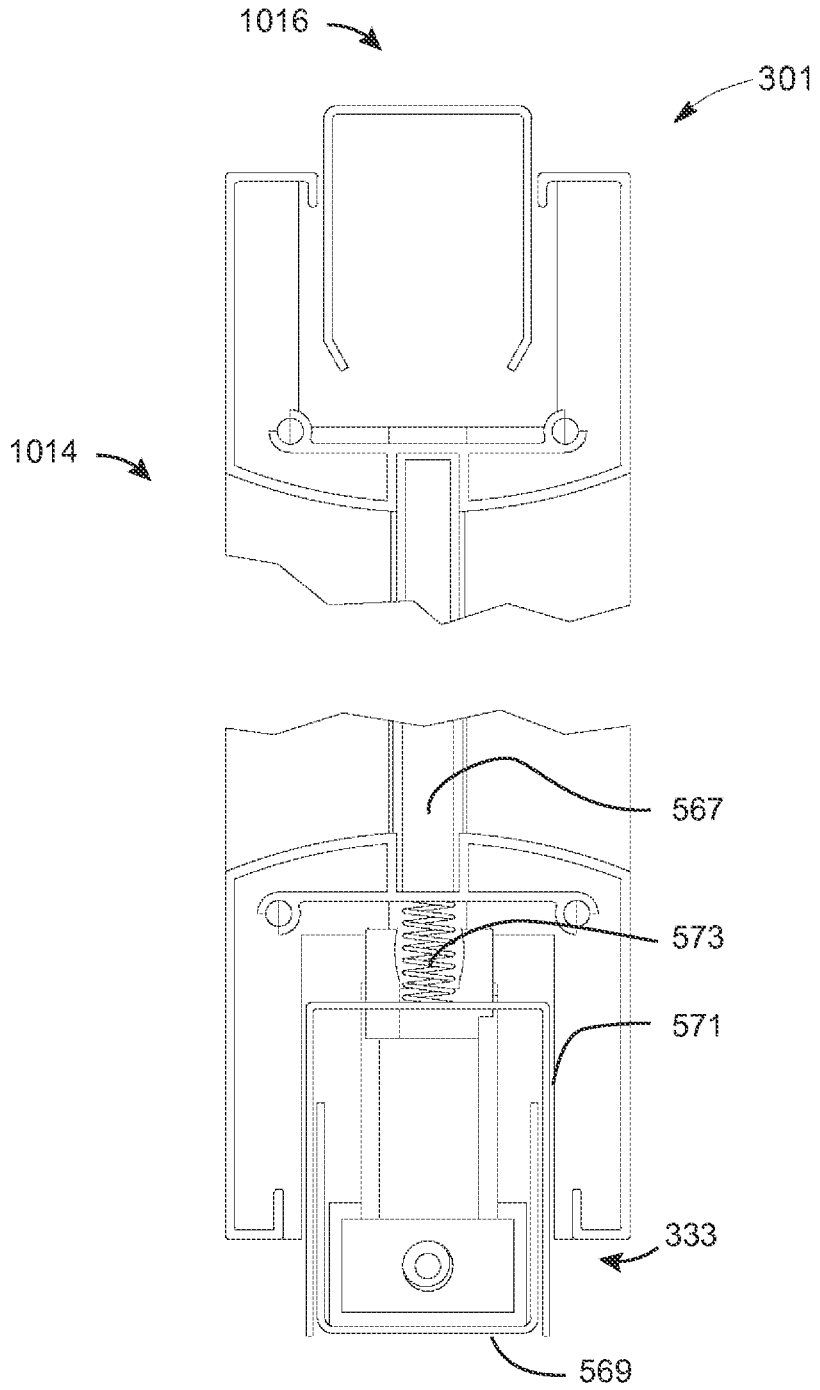

FIG. 147 is a cross-sectional view of a framed wall panel being provided with a spring-loaded dropdown cover according to another preferred embodiment of the present invention.

Figures 148, 149:
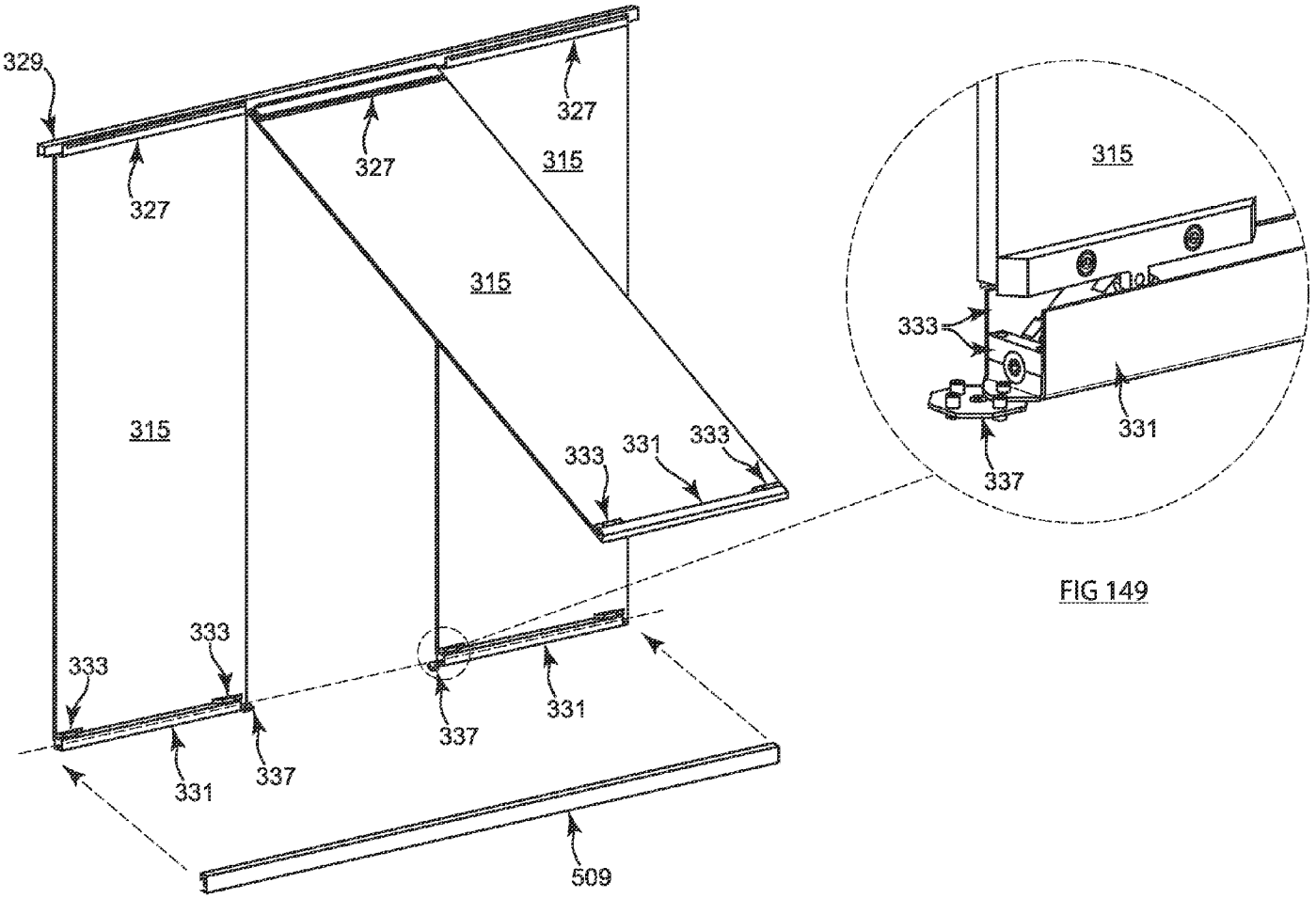

FIGS. 148 and 149 are perspective views showing a butt-glazed frameless wall panel system during installation according to a preferred embodiment of the present invention.

Figure 150:
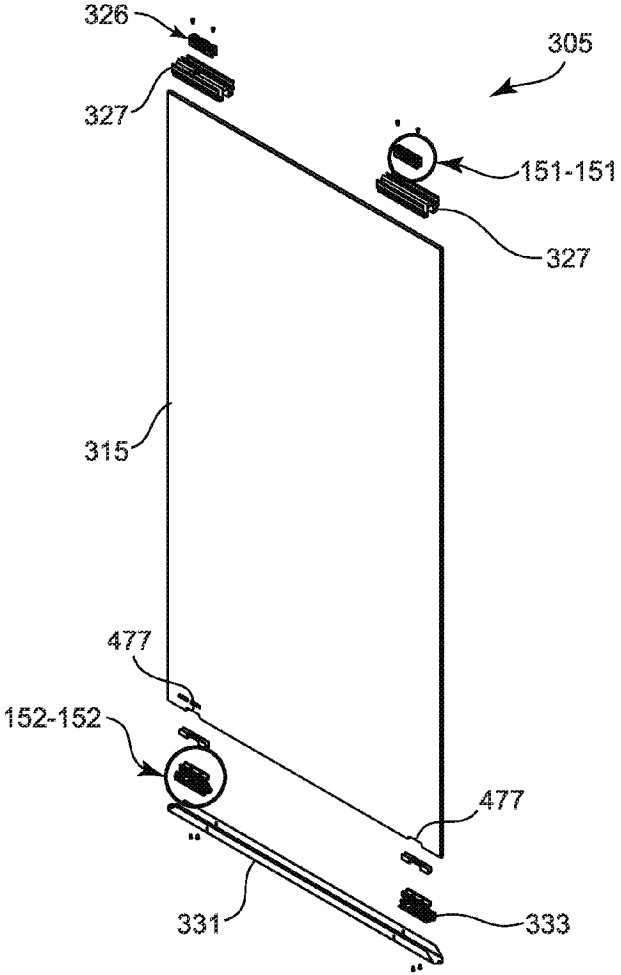

FIG. 150 is an exploded view of a pre-assembled frameless wall panel according to another preferred embodiment of the present invention.

Figure 151:
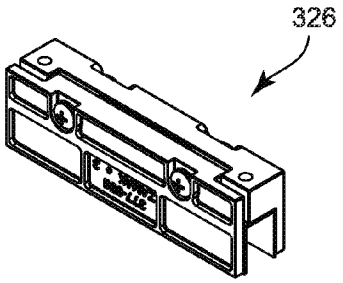

FIG. 151 is a perspective view of an upper clamp assembly of the pre-assembled wall panel of FIG. 150.

Figure 152:
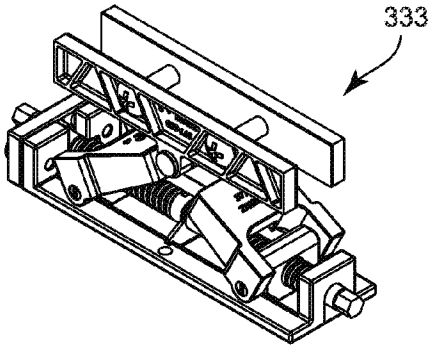

FIG. 152 is a perspective view of a height adjustment assembly of the pre-assembled wall panel of FIG. 150.

Figure 153:
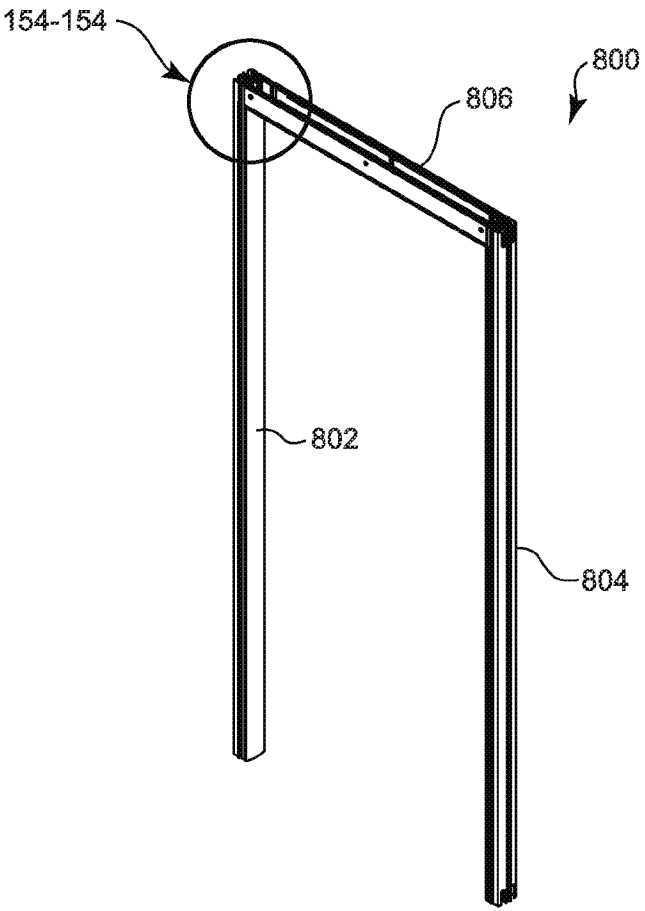

FIG. 153 is a perspective view of a door frame according to a preferred embodiment of the present invention.

Figure 154:
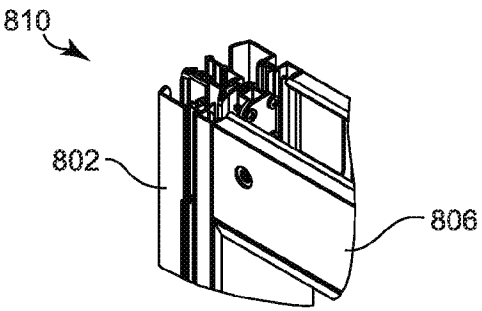

FIG. 154 is an enlarged view of area 154-154 of FIG. 153.

Figure 155:
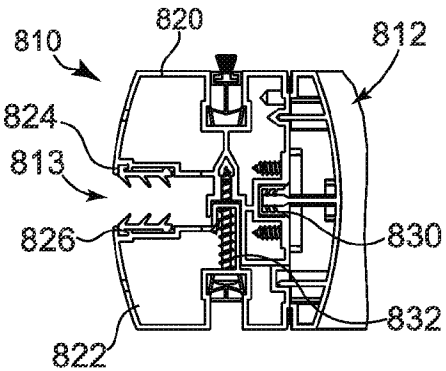

FIG. 155 is a top view of the enlarged area of FIG. 149.

Figure 156:
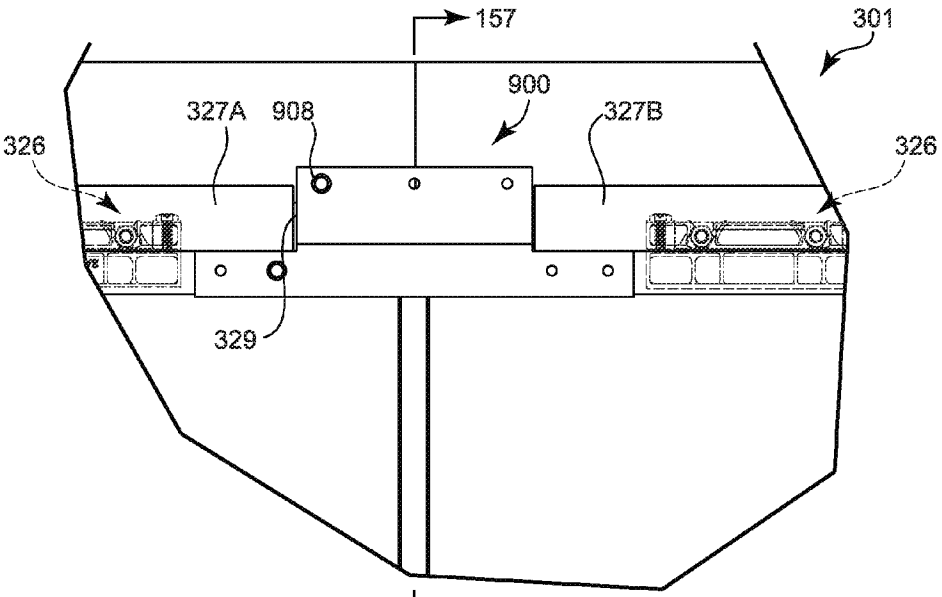

FIG. 156 is an enlarged view showing top portions of adjacent frameless, butt-glazed wall panels according to a preferred embodiment of the present invention.

Figure 157:
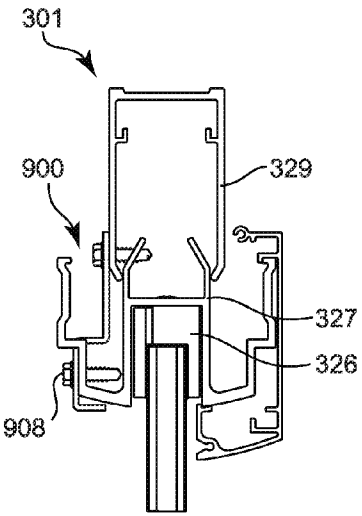

FIG. 157 is a sectional view taken along line 157-157 of FIG. 156.

Figure 158:
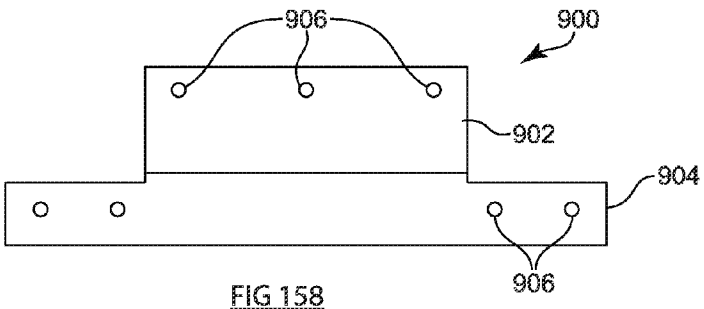

FIG. 158 is a front view of an upper interconnect of FIG. 157 according to a preferred embodiment of the present invention.

Figure 159:
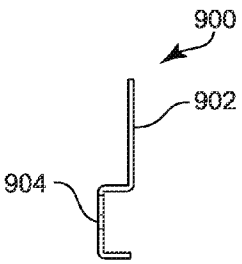

FIG. 159 is a side view of the upper interconnect of FIG. 158 according to a preferred embodiment of the present invention.

Figure 160:
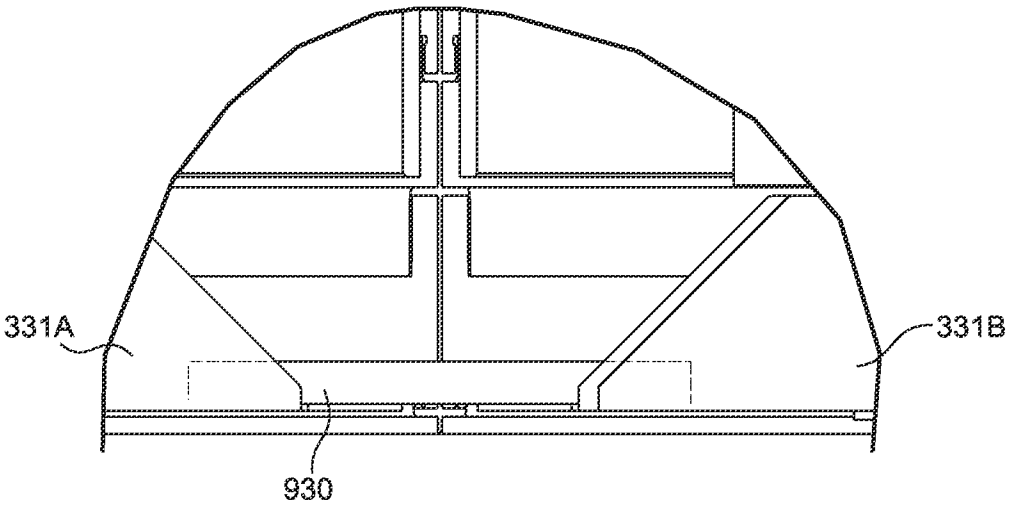

FIG. 160 is an enlarged view showing lower portions of adjacent frameless, butt-glazed wall panels according to a preferred embodiment of the present invention.

Figure 161:
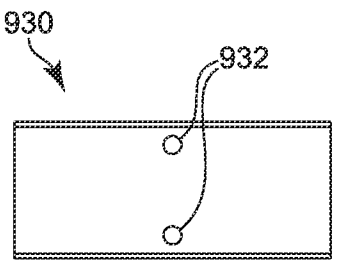
Figure 164:
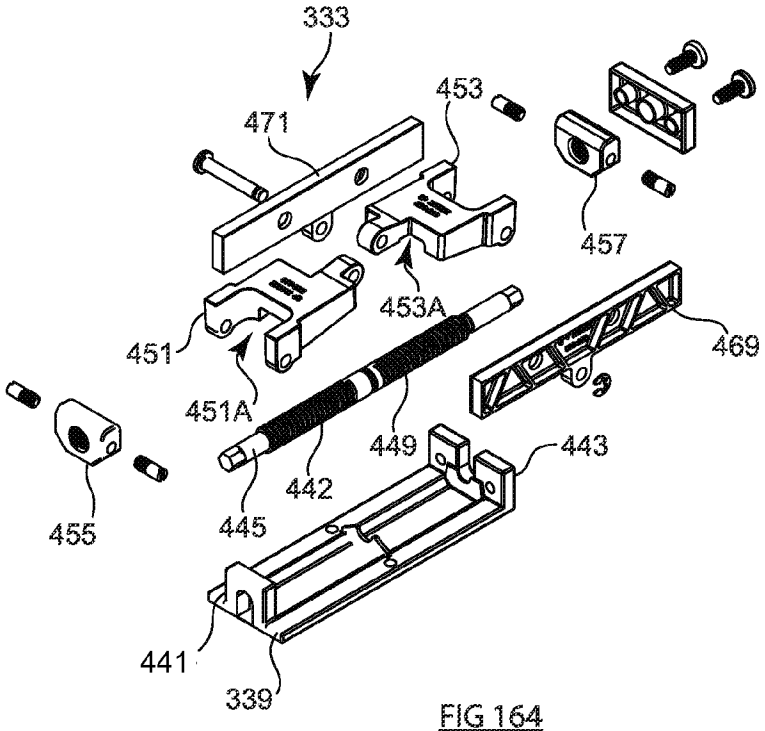
Figure 163:
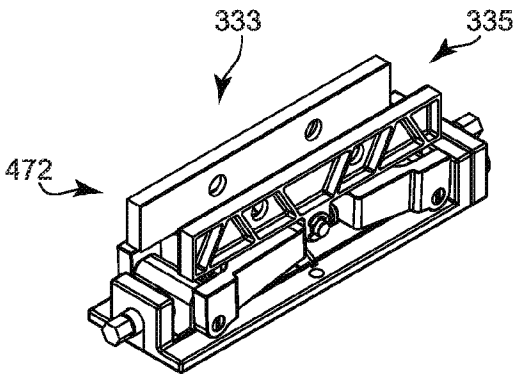

FIG. 161 is a top view of the lower interconnect of FIG. 160 according to a preferred embodiment of the present invention.

Figure 162:
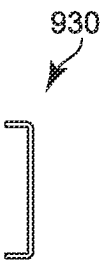

FIG. 162 is a side view of the lower interconnect of FIG. 161 according to a preferred embodiment of the present invention.

FIGS. 163-167 show a height adjustment assembly, according to a preferred embodiment of the present invention.

Figure 168:
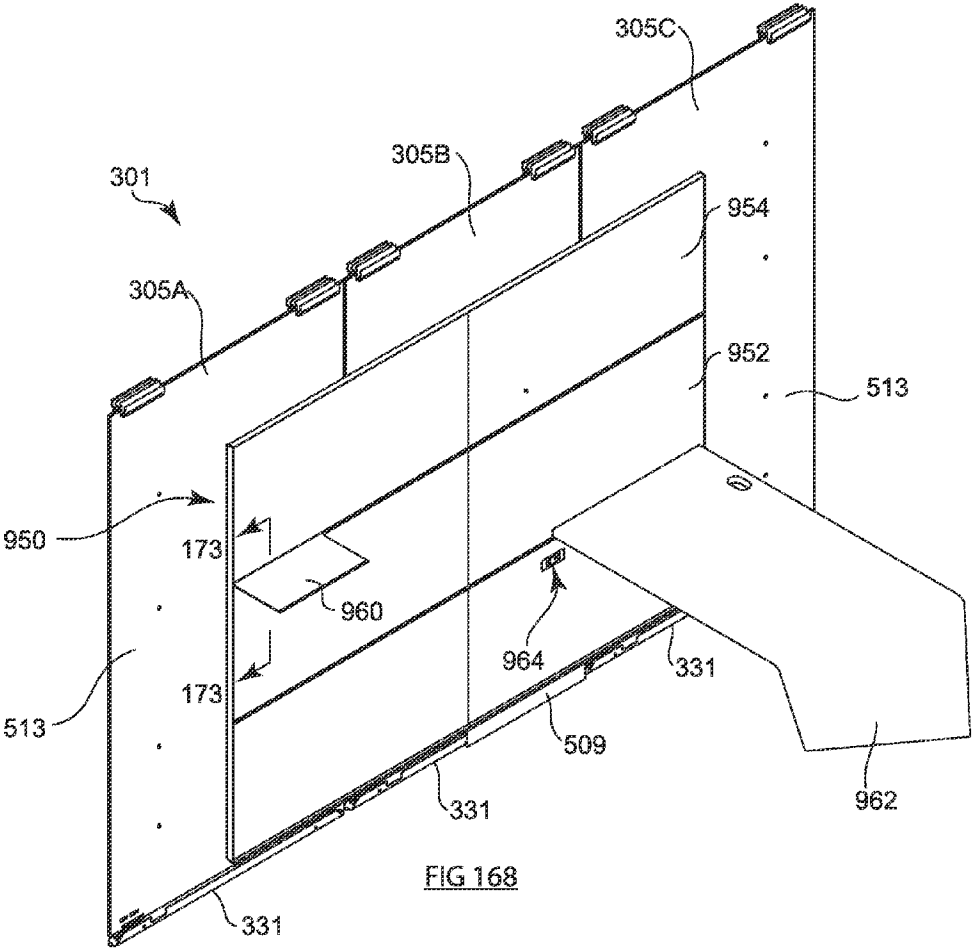

FIG. 168 shows a frameless wall panel system, according to a preferred embodiment of the present invention.

Figure 169:
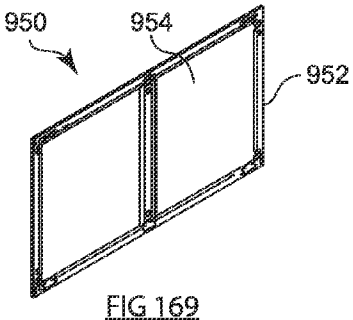
Figure 170:
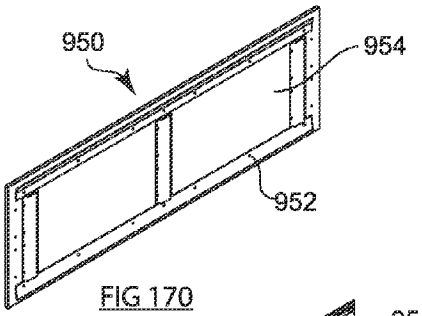
Figure 171:
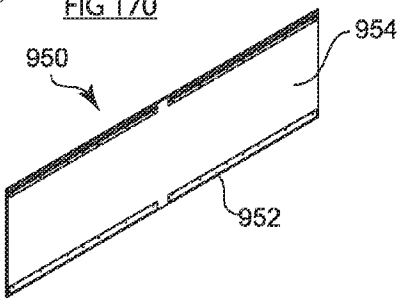

FIG. 169-171 show rail and tile systems usable with the wall panel system of FIG. 168.

Figure 172:
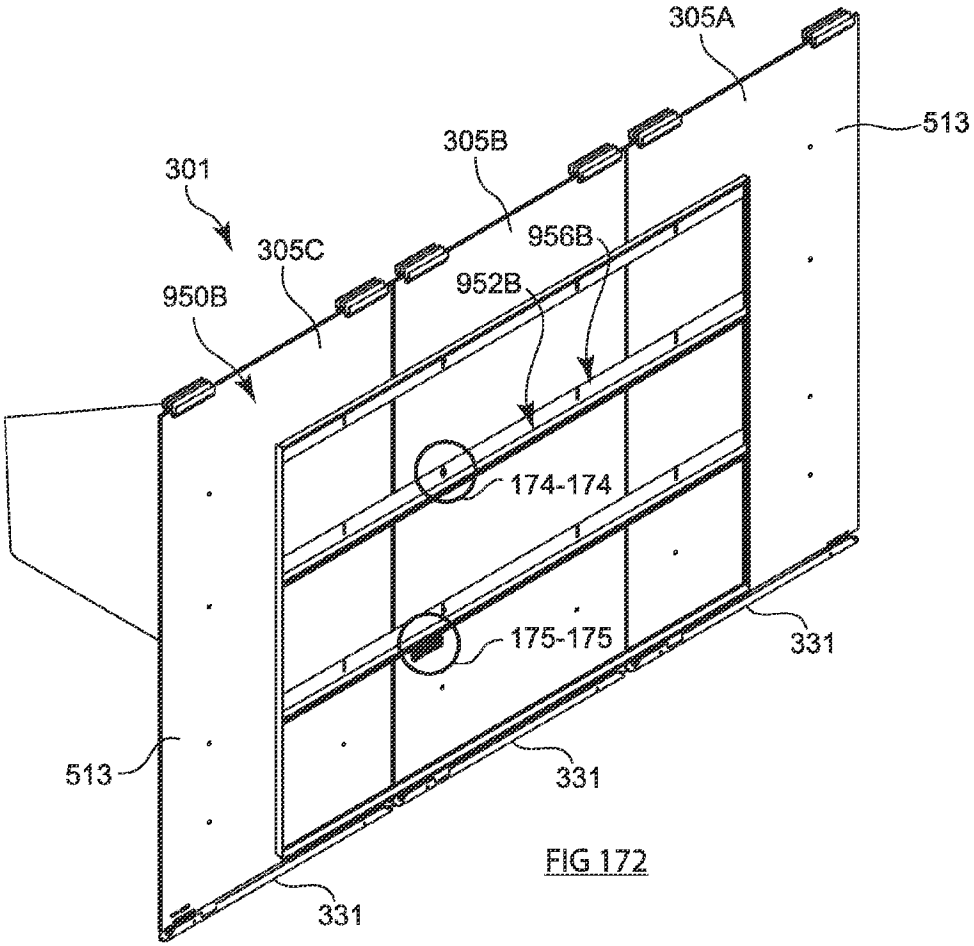

FIG. 172 shows a back view of the wall panel system of FIG. 168.

Figure 173:
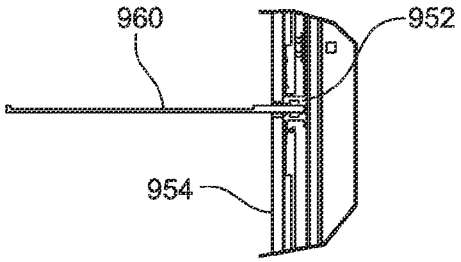

FIG. 173 is a sectional view along line 173-173 of FIG. 168.

Figure 174:
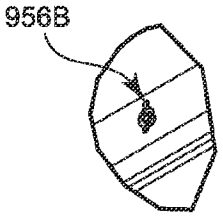
Figure 175:
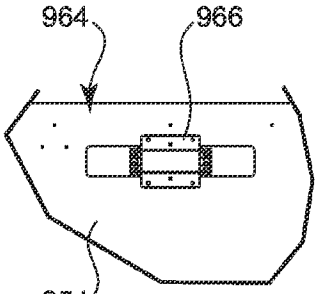

FIGS. 174 and 175 are enlarged views of portions of FIG. 172.

Figure 176:
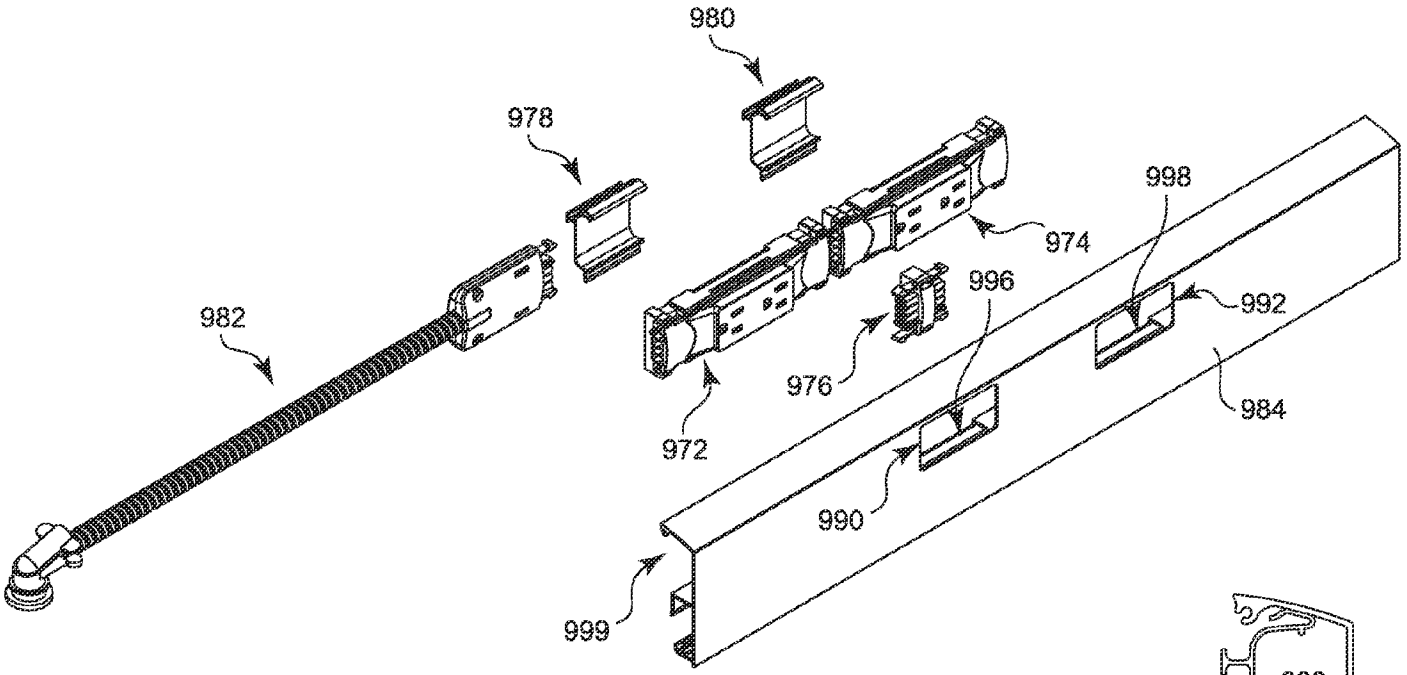
Figure 177:
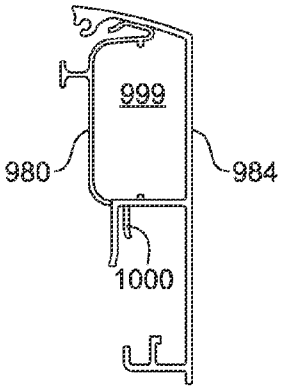

FIGS. 176 and 177 show components of an electrical outlet assembly of the wall panel system of FIG. 168, according to a preferred embodiment of the present invention.

DETAILED DESCRIPTION

In the following description, the same numerical references refer to similar elements. The embodiments, geometrical configurations, materials mentioned and/or dimensions shown in the figures or described in the present description are preferred embodiments only, given for exemplification purposes only.

Moreover, although the present invention as exemplified hereinafter was primarily designed for wall systems intended in work environments, for defining office spaces, etc., it could be used with other objects and for other purposes, as apparent to a person skilled in the art. For this reason, expressions such as "work", "office", "space", "wall", "panel" and any other references and/or other expressions equivalent thereto should not be taken as to limit the scope of the present invention and include all other objects and all other applications with which the present invention could be used and may be useful.

Moreover, in the context of the present invention, the expressions "system", "kit", "set", "assembly", "product" and "device", as well as any other equivalent expressions and/or compounds word thereof known in the art will be used interchangeably, as apparent to a person skilled in the art. This applies also for any other mutually equivalent expressions, such as, for example: a) "mount", "assemble", "define", "build", "erect", etc.; b) "wall", "panel", etc.; c) "office", "work space", "environment", "structure", "enclosure", etc.; d) "rotating", "driving", "displacing", "moving", "supporting", "conveying" etc.; e) "interchangeable", "modular", "progressive", etc.; f) "enable", "allow", "permit", etc.; g) "fastening", "securing", "attaching", "anchoring", "adjusting", "positioning", etc.; h) "hole", "bore", "slot", "slit", "groove", "cavity", etc.; i) "rotating", "pivoting", "turning", "rolling", etc.; j) "ceiling", "upper, "top", etc.; k) "floor", "lower, "bottom", etc.; k) "glass", "laminate", "panel", "gypsum", "board", etc.; l) "positioning", "spacing", "locating", "arranging", "disposing", etc.; m) "adjacent", "neighbouring", "sequential", etc.; n) "components", "parts", "elements", etc.; as well as for any other mutually equivalent expressions, pertaining to the aforementioned expressions and/or to any other structural and/or functional aspects of the present invention, as also apparent to a person skilled in the art.

Furthermore, in the context of the present description, it will be considered that expressions such as "connected" and "connectable", or "mounted" and "mountable", may be interchangeable, in that the present invention also relates to a kit with corresponding components for assembling a resulting fully assembled office space.

Moreover, in the context of the present description, it is also important to make the distinction between a "framed" wall panel which typically consists of a substantially rectangular shape, and comprises opposite top and bottom distance channels, and opposite left and right vertical posts, which make the "frame" of the framed wall panel, and a "frameless" wall panel, which is a wall panel deprived of such distance channels and vertical posts (e.g. a straightforward glass panel not having a frame around it, etc.), as can be easily understood by a person skilled in the art.

In addition, although the preferred embodiment of the present invention as illustrated in the accompanying drawings may comprise various components, and although the preferred embodiment of the wall panel system as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperation therein between, as well as other suitable geometrical configurations may be used for the wall panel system and corresponding components according to the present invention, as will be briefly explained hereinafter and as can be easily inferred here from by a person skilled in the art, without departing from the scope of the invention.

List of numerical references for some of the corresponding preferred components illustrated in the accompanying drawings:

301. wall panel system
303. office space
305. wall panel
307. floor
309. ceiling
311. vertical axis
313. horizontal axis
315. wall panel
317. height
319. top edge
321. bottom edge
323. width
325. side edge
325*a*. left side edge
325*b*. right side edge
326. top clamp assembly
327. ceiling track
329. ceiling rail
331. bottom floor channel
333. height adjustment assembly
334. first vertical member
335. support edge
336. second vertical member
337. connecting plate
338. third vertical member
339. base

340. fourth vertical member
441. first end cap
441*a*. first end cap component (of first end cap 441)
441*b*. second end cap component (of first end cap 441)
443. second end cap
443*a*. first end cap component (of second end cap 443)
443*b*. second end cap component (of second end cap 443)
445. height adjusting rod
447. first threaded segment
449. second threaded segment
451. first adjustment leg
451*a*. recessed portion
452. second extremity
452*a*. first extremity
453*a*. recessed portion
453. second adjustment leg
455. runner component
457. runner component
459. pivot axis
461. first bushing
463. second bushing
465. fastener
466. worm gear
466*a*. worm gear
467. socket
469. first clamp
471. second clamp
472. lower clamp assembly
473. gasket location
475. connector
477. notch
479. bushing
481. longitudinal axis
483. center point
485. projection
487. hole
489. nut
491. setscrew
493. hole
495. pointed tip
497. anchoring hole
499. anchor
501. projecting element
503. extremity (of projecting element)
505. longitudinal groove
507. ceiling cover
509. bottom cover
511. gasket
513. through-hole
515. complementary accessory
517. bushing
517*b*. bushing
519*b*. first threaded stud
521*b*. second threaded stud
519. first threaded stud
521. second threaded stud
523. washer
525. distraction marker
527. snap-on wood shell
529. hooking knob
531. hanging plate
533. hanging hook
535. hole
537. snap-on glass shell
539. stand-off stud
541. sliding door assembly
543. sliding door
545. sliding door hardware
547. sliding door mounting bracket
549. bottom guide plug
551. bottom floor seal
551*a*. spring
553. sliding glass door
555. glass clamp
555*a*. upper glass clamp
555*b*. bottom glass clamp
557. height adjustment fastener
559. bottom floor seal
561. gasket
563. tightening assembly
565. soft-top mechanism
567. framed wall panel
569. bottom distance channel
571. dropdown cover
573. spring
575. vertical post
577. post connection clip
579. slot
581. intermediate distance channel
583. outer covering (or metallic shell)
585. inner hanging component
587. stiffening component
589. hooking channel
591. hooking bracket
593. hooking portion
595. hanging portion
597. groove
599. complementary wall panel
800. sliding door frame
802. first jamb
804. second jamb
806. header
810. clamp assembly
812. cover assembly
813. receiving channel
820. first portion
822. second portion
900. upper bracket
902. first vertical leg
904. second vertical leg
906. apertures
908. self-tapping screws
930. lower bracket
932. apertures
950. glass post panel
952. three way glass post panel assembly
954. glass post three way panel assembly
956. wall panel assembly
980. wall panel assembly
982. door post
990. solid panel MDF/stackable and glass pole panel assembly
992. solid panel MDF/stackable and glass pole panel assembly
1002. wall panel assembly
1004 framed glass panel
1006. dropdown cover
1008. bottom cover
1010. framed wall panel
1014. framed wall panel
1102. wall structure
1104. wall structure
1106. layer
1120. nut

1120*a*. nut
1202. vertical shaft
1204. vertical shaft
1591. stacked components By virtue of its design and its components, the present wall panel system is a moveable non-progressive mountable and demountable wall panel system, particularly well suited for mounting frameless wall panels, such as butt-glazed wall panels, for example, in a very quick, easy and systematic manner, something that is not possible with conventional wall panel systems.

Indeed, the present invention is the next and innovative generation of wall panel systems, being a considerable improvement over other wall panel systems, such as, for example, the one designed by the Applicant of the present case, and described in U.S. Pat. No. 6,688,056 B2 granted on Feb. 10, 2004, to VON HOYNINGEN HUENE et al., the content of which is incorporated herein by reference.

Figure 1:
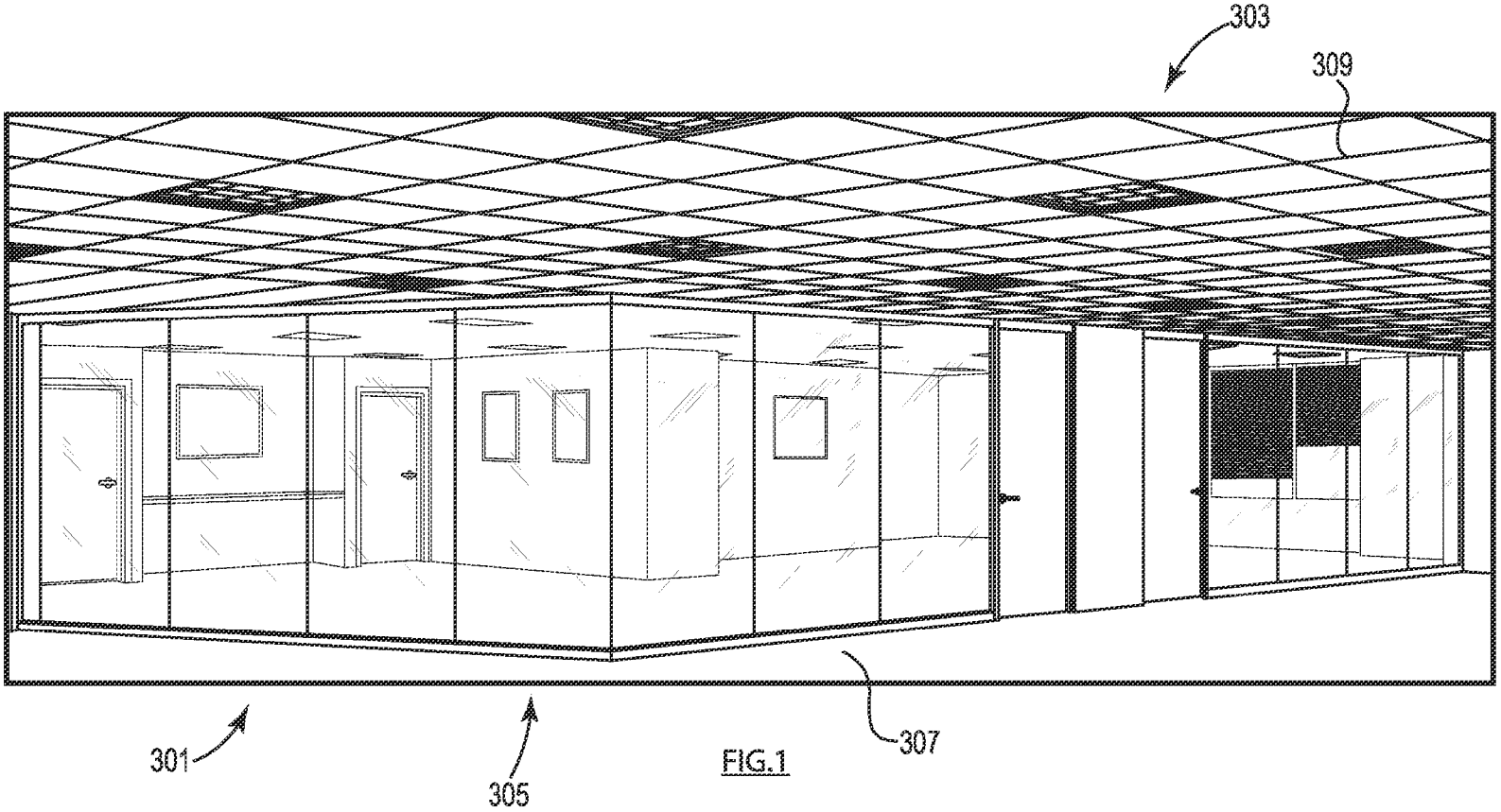
FIG. 1 is a perspective view of an office space assembly having been assembled with a wall panel system according to a preferred embodiment of the present invention, the office space assembly being shown with butt-glazed wall panels and a pair of corresponding doors.
Figure 18:
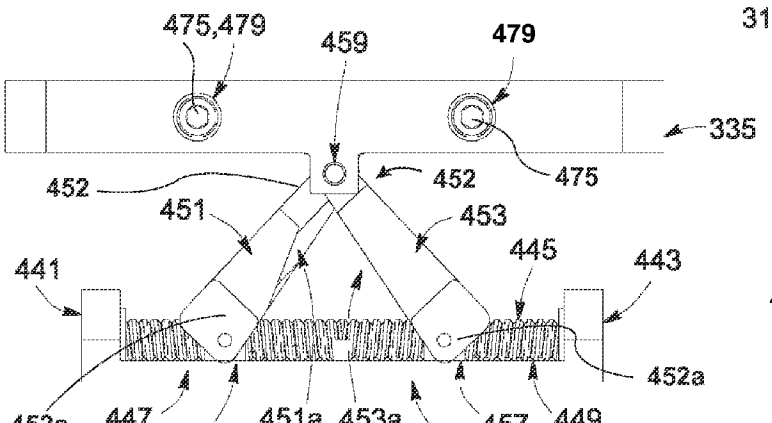
FIG. 18 is a side elevational view of what is shown in FIG. 17.
Figure 21:
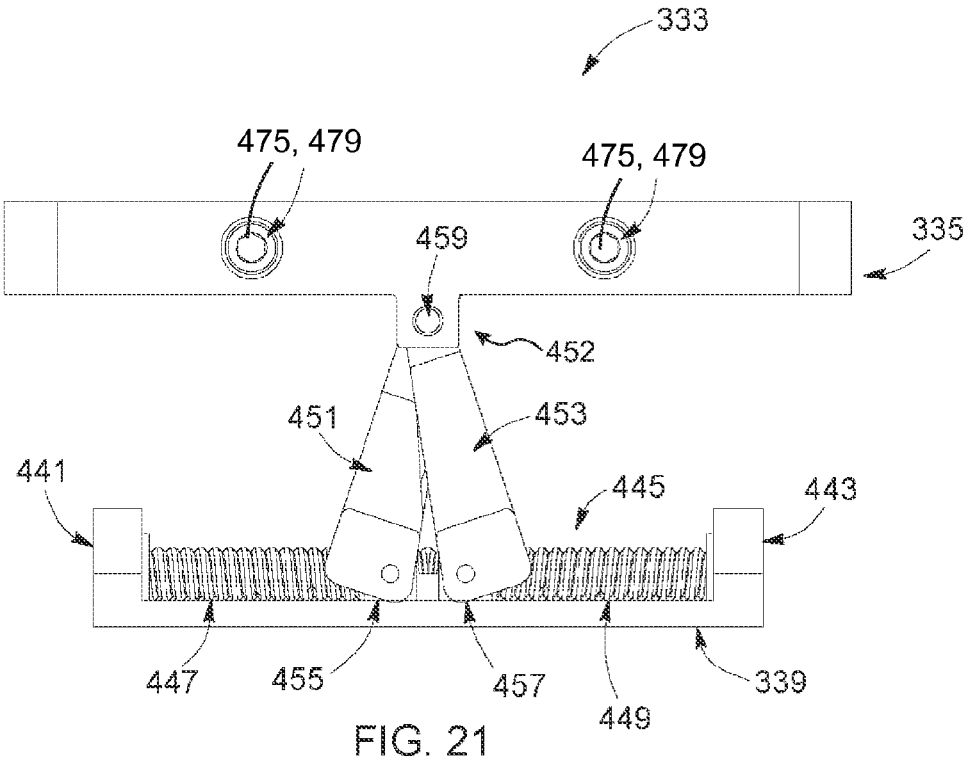
FIG. 21 is another side elevational view of what is shown in FIG. 18, the height adjustment assembly being now shown in a raised configuration.

Broadly described, the wall panel system (301) according to the preferred embodiment of the invention, as illustrated in the accompanying drawings, is a moveable and demountable wall panel system (301) for defining an office space (303) with a plurality of wall panels (305) disposable in a substantially upright manner between a floor (307) and a ceiling (309) each having respectively a series of uppermost and lowermost deviations, each wall panel (305) having a vertical axis (311) and a horizontal axis (313), and comprising:

at least one prefabricated frameless panel (315), each panel (315) having a given height (317) defined between top and bottom edges (319, 321), and a given width (323) defined between left and right side edges (325*a*, 325*b*), a pair of top clamp assemblies (326) secured to the top edge (319) of each panel (305) such that the top edge (310) is provided with a ceiling track (327) configured for being removably insertable into a corresponding ceiling rail (329) extending along the ceiling (309) and delimiting the office space (303);

a bottom floor channel (331) associated with each corresponding panel (315) and being configured for operatively resting against the floor (307) opposite to the ceiling rail (329) extending along the ceiling (309);

integrated first and second power-drivable height adjustment assemblies (333) associated with each panel (315) and insertable into a corresponding bottom floor channel (331), each height adjustment assembly (333) comprising a support edge (335) for operatively supporting a bottom portion of each panel (315), each height adjustment assembly (333) being selectively operable as to be adjustably raised or lowered, thereby allowing a vertical height adjustment of each panel (315) and a rotational angle adjustment thereof by virtue of a pivot axis (459), as illustrated for example in FIG. 18; and at least one connecting plate (337) for removably connecting a pair of bottom floor channels (331), each connecting plate (337) and bottom floor channel (331) being positioned, shaped and sized with respect to one another for ensuring that the side edges (325) of a pair of neighboring prefabricated frameless panels (315) cooperate with one another in order to define the office space (303). An example of a resulting office space (303) is shown in FIG. 1.

According to a first preferred embodiment of the invention, and as better shown in FIGS. 2-27, each height adjustment assembly (333) may comprise a scissors-type height adjustment mechanism including: a) a base (339); b) opposite first and second end caps (441, 443) projecting from the base (339); c) a height adjusting rod (445) being rotatively mounted about the end caps (441, 443), the height adjusting rod (445) having first and second threaded segments (447, 449) each being oppositely threaded with respect to one another; and d) first and second adjustment legs (451, 453), the first adjustment leg (451) having a first extremity (452*a*) pivotably mounted onto a runner component (455) threadedly engaged onto the first threaded segment (447) of the height adjusting rod (445) and a second extremity (452) pivotably mounted onto the support edge (335), and the second adjustment leg (453) having a first extremity (452*a*) pivotably mounted onto a runner component (457) threadedly engaged onto the second threaded segment (449) of the height adjusting rod (445) and a second extremity (452) pivotably mounted onto the support edge (335), such that a rotation of the common height adjusting rod (445) along a first direction causes a raising of the support edge (335), and a rotation of said common height adjusting rod (445) along a second and opposite direction causes a lowering of the support edge (335).

Preferably, the second extremities 452 of the first and second adjustment legs (451, 453) are pivotably mounted onto a bottom portion of the support edge (335) about a common pivot axis (459), as better shown in FIGS. 17, 18, 21 and 22.

Figure 17:
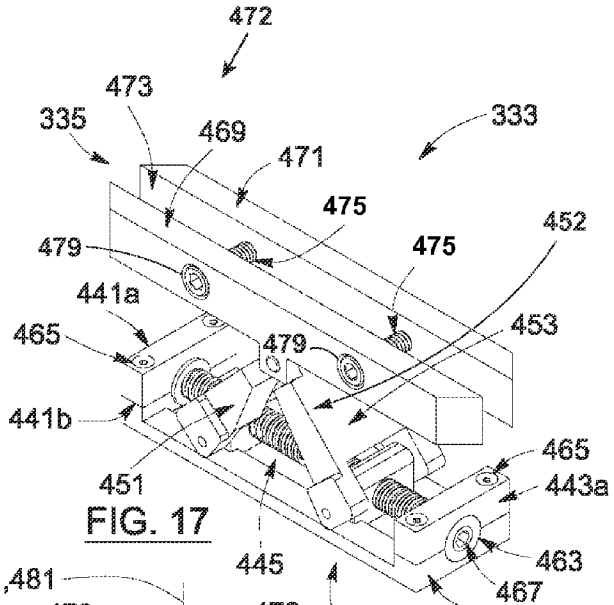
FIG. 17 is a perspective view of a height adjustment assembly according to a preferred embodiment of the present invention.
Figure 22:
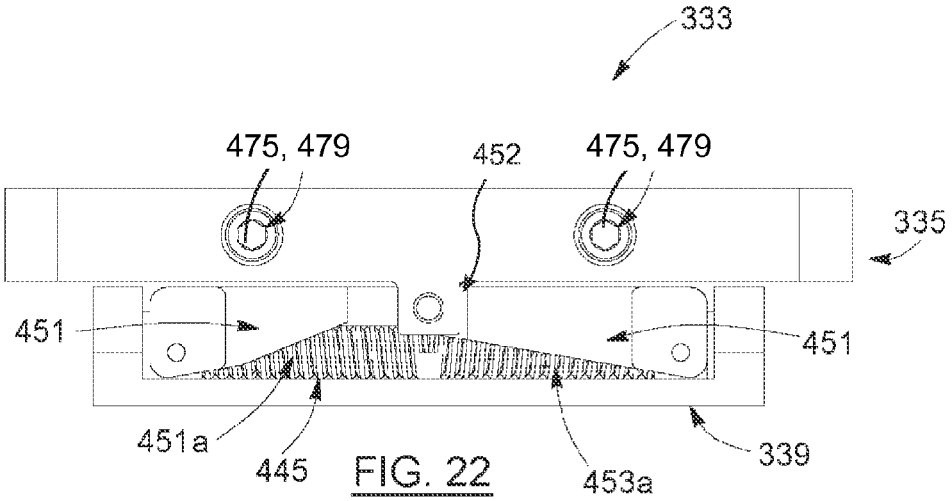
FIG. 22 is another side elevational view of what is shown in FIG. 21, the height adjustment assembly being now shown in a lowered configuration.
Figure 23:
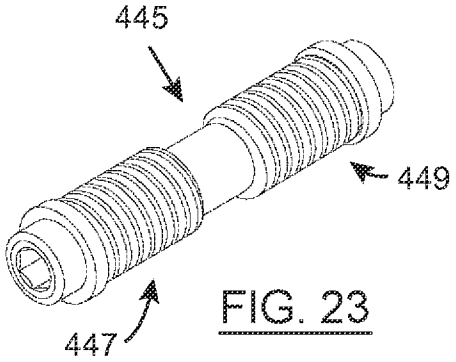
FIG. 23 is a perspective view of a height adjusting rod provided with a pair of distal bushings according to a preferred embodiment of the present invention.
Figure 25:
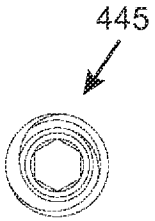
FIG. 25 is a front plan view of what is shown in FIG. 24.
Figure 27:
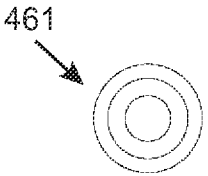
FIG. 27 is a rear elevational view of what is shown in FIG. 26.
Figure 24:
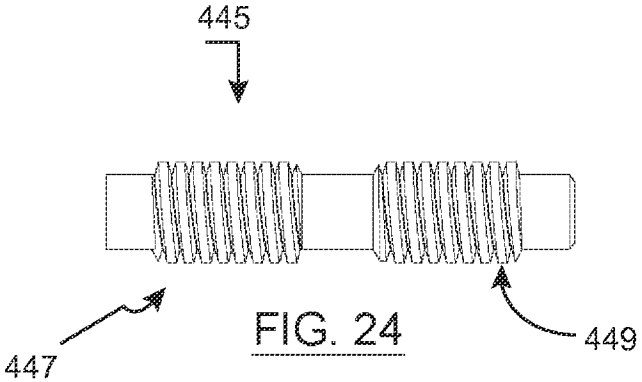
FIG. 24 is a side elevational view of the height adjusting rod shown in FIG. 23.
Figure 26:
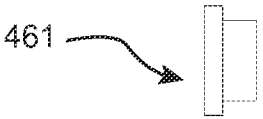
FIG. 26 is a side elevational view of one of the bushings shown in FIG. 23.
Figure 28:
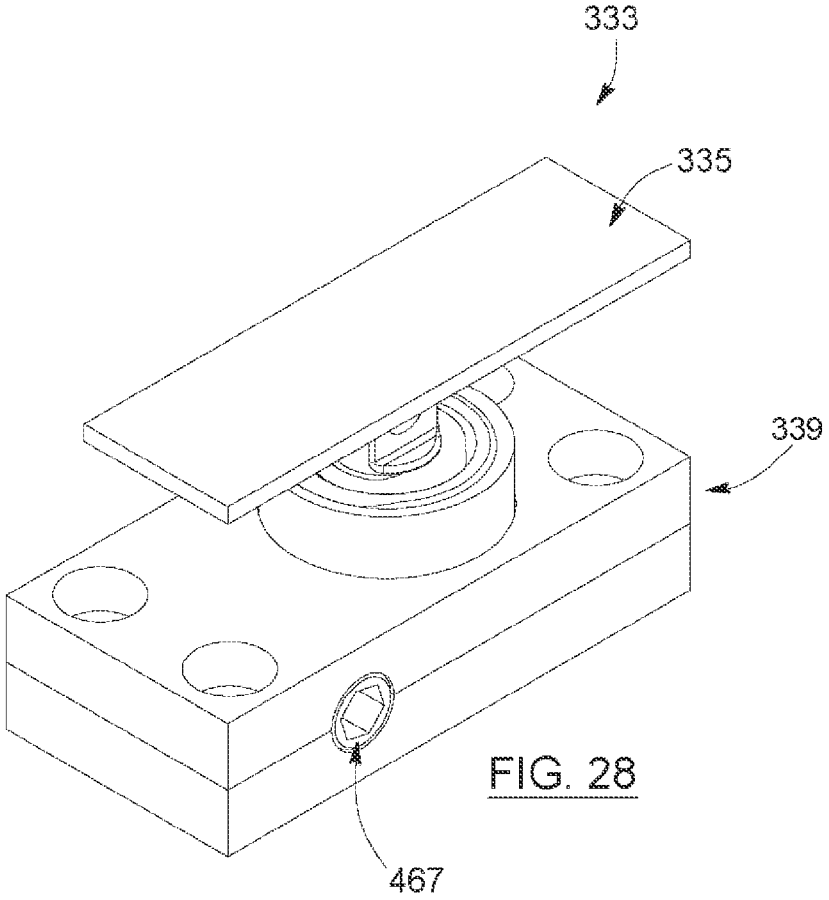
FIG. 28 is a perspective view of a height adjustment assembly according to another preferred embodiment of the present invention, the height adjustment assembly being shown in a lowered configuration.
Figure 29:
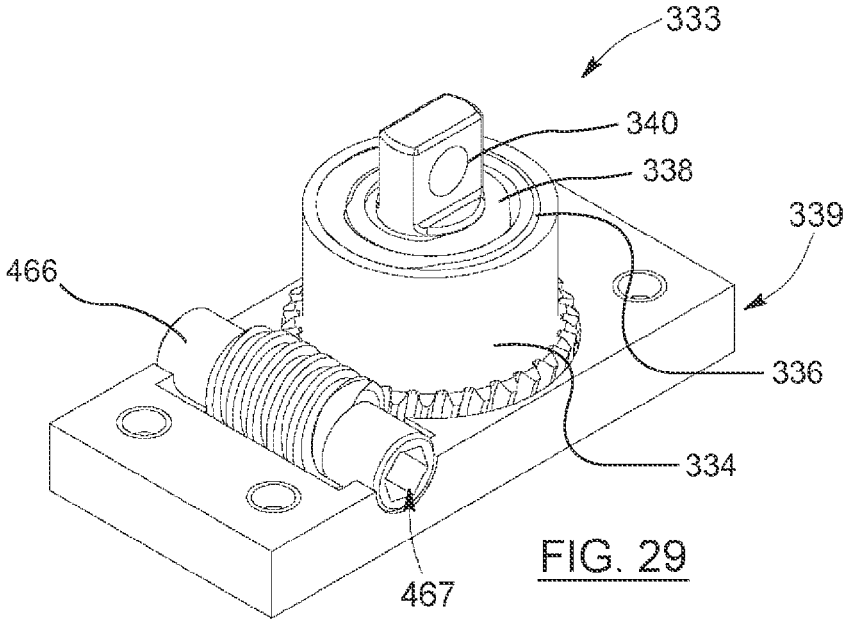
FIG. 29 is another perspective view of what is shown in FIG. 28, the height adjustment assembly being now shown with certain parts having been removed so as to better illustrate inner components of the height adjustment assembly.
Figure 30:
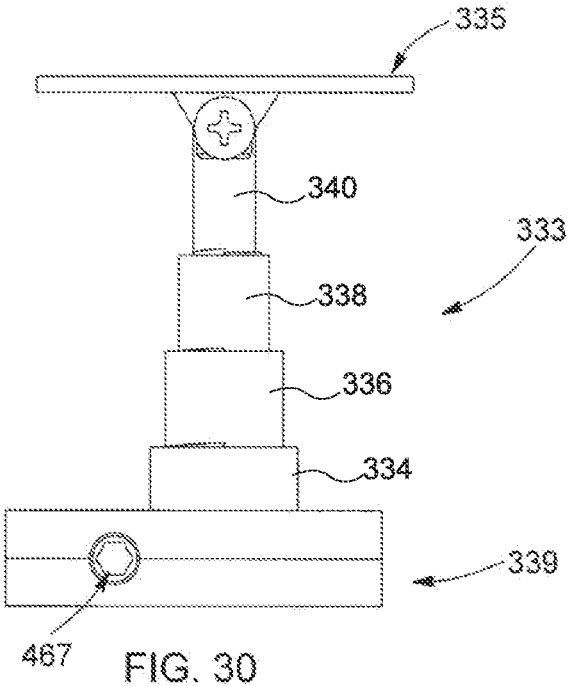
FIG. 30 is a side elevational view of what is shown in FIG. 28, the height adjustment assembly being now shown in a raised configuration.
Figure 31:
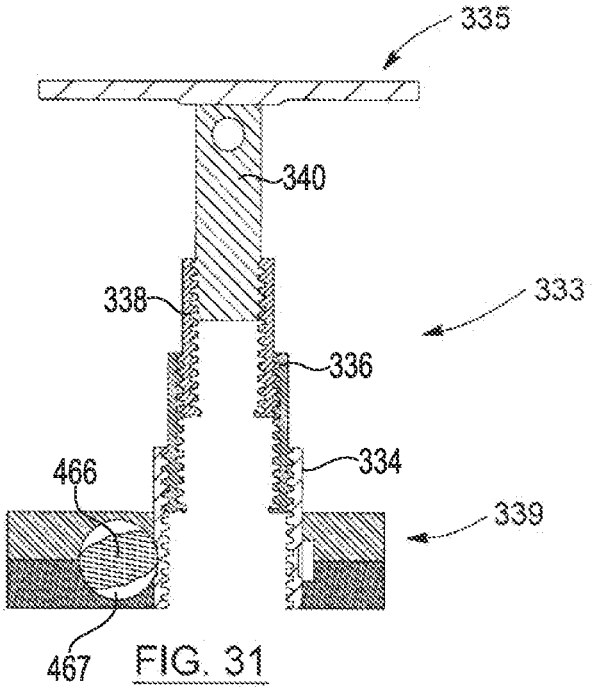
FIG. 31 is a cross-sectional view of what is shown in FIG. 30.
Figure 32:
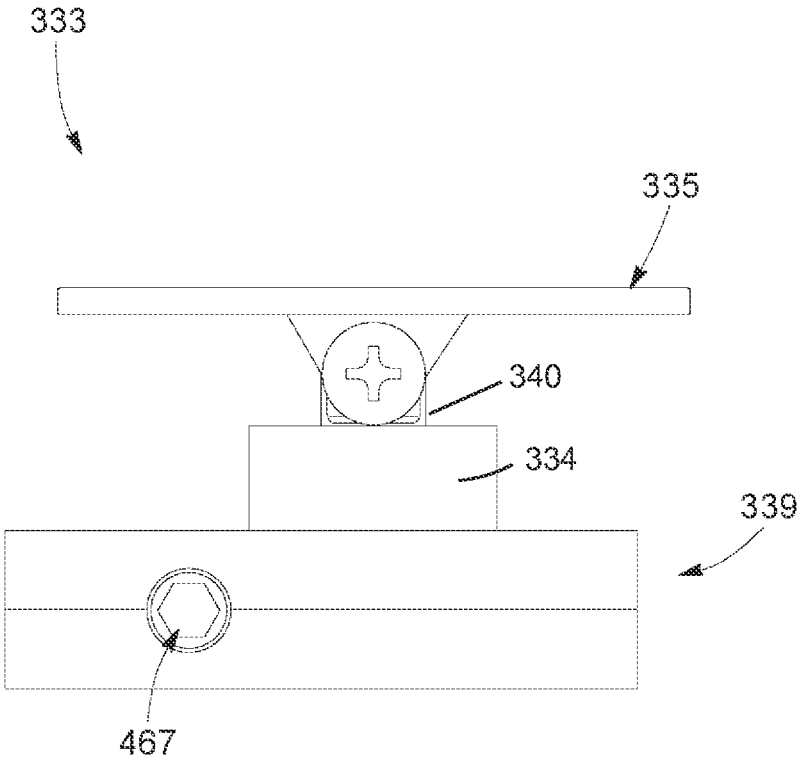
FIG. 32 is another side elevational view of what is shown in FIG. 30, the height adjustment assembly being now shown in a lowered configuration.
Figure 33:
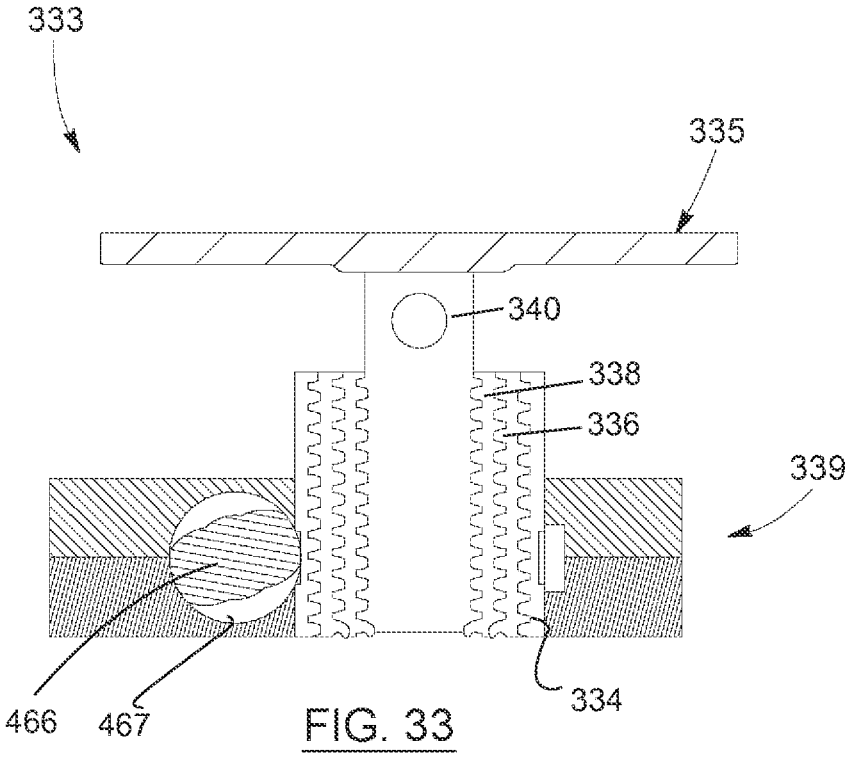
FIG. 33 is a cross-sectional view of what is shown in FIG. 32.
Figure 34:
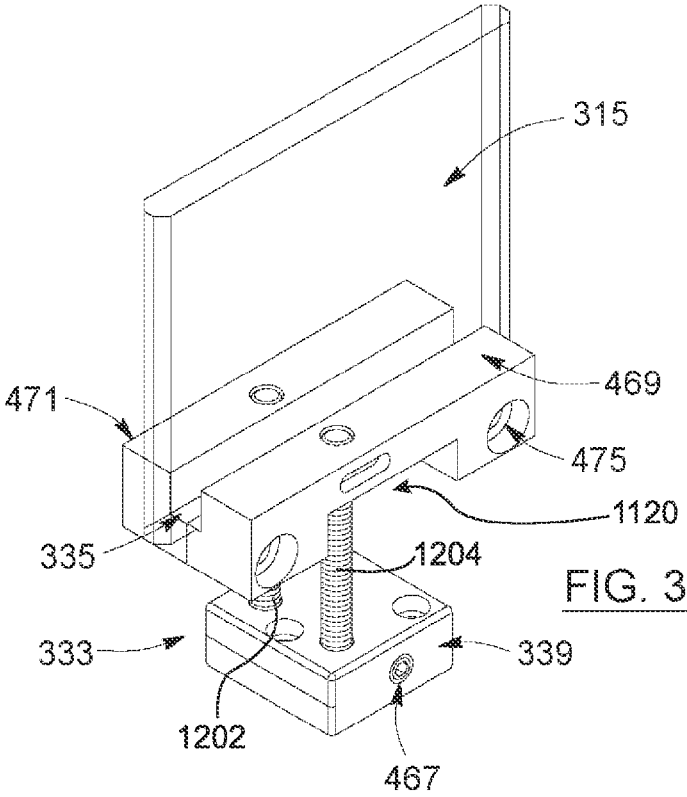
FIG. 34 is a perspective view of a height adjustment assembly according to yet another preferred embodiment of the present invention.
Figure 35:
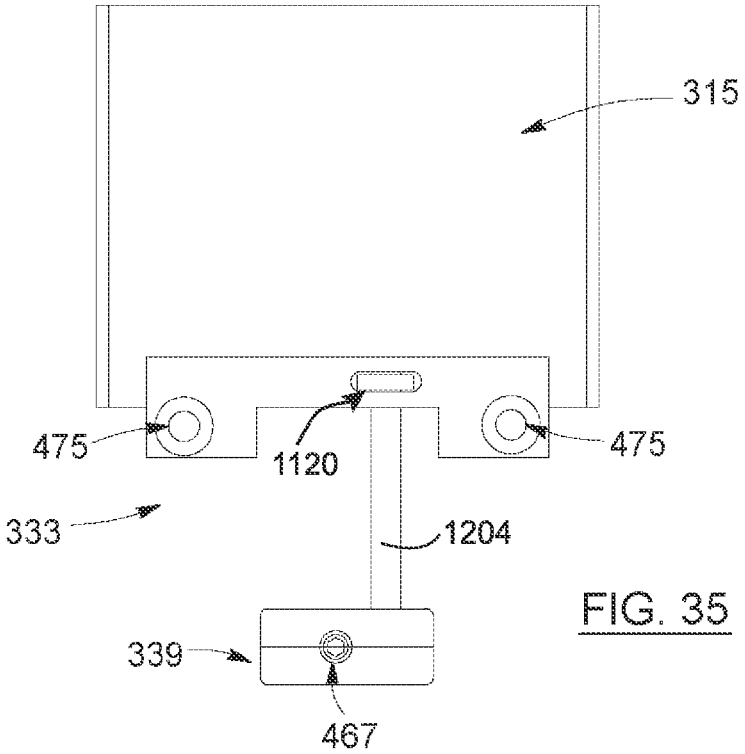
FIG. 35 is a side elevational view of what is shown in FIG. 34.
Figure 41:
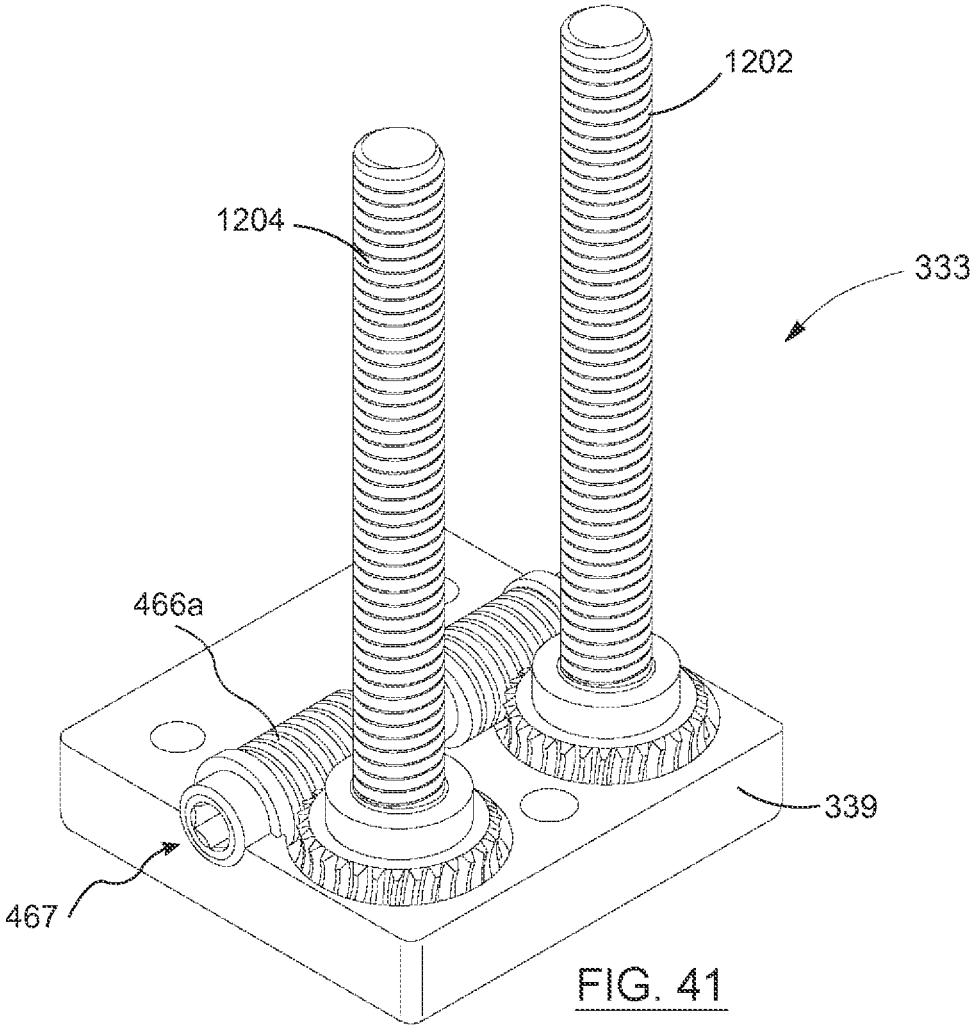
FIG. 41 is a perspective view of a height adjustment assembly according to yet another preferred embodiment of the present invention, the height adjustment assembly being shown with certain components having been removed therefrom so as to better illustrate inner components of the height adjustment assembly.
Figure 42:
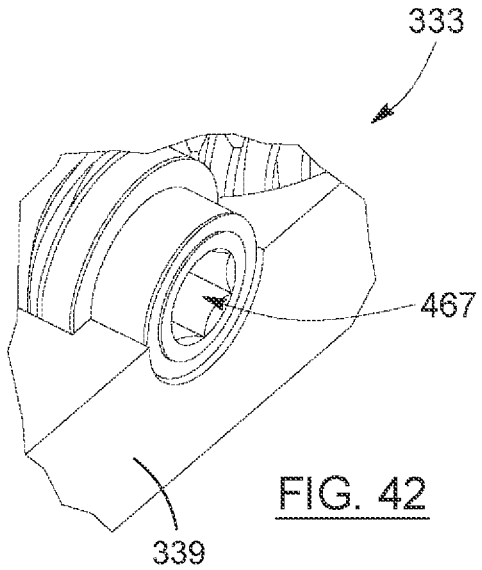
FIG. 42 is an enlarged view of a portion of what is shown in FIG. 41.
Figure 45:
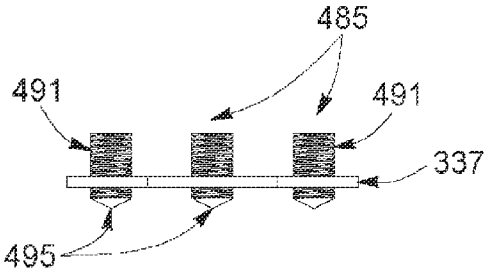
FIG. 45 is a side elevational view of what is shown in FIG. 43.
Figure 44:
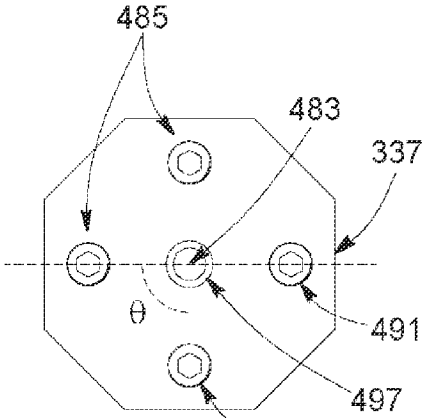
FIG. 44 is a top plan view of what is shown in FIG. 43.
Figure 43:
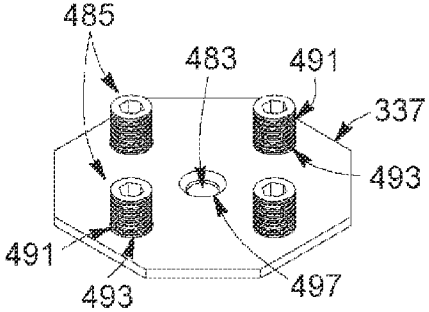
FIG. 43 is a perspective view of a connecting plate provided with four projections and an anchoring hole about the center point according to a preferred embodiment of the present invention.
Figure 48:
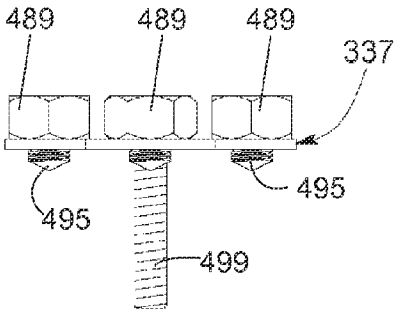
FIG. 48 is a side elevational view of what is shown in FIG. 46.
Figure 47:
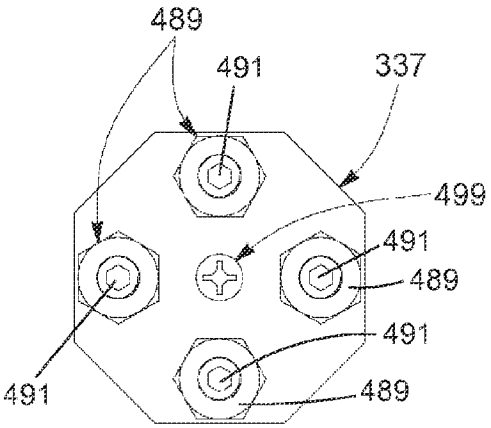
FIG. 47 is a top plan view of what is shown in FIG. 46.
Figure 46:
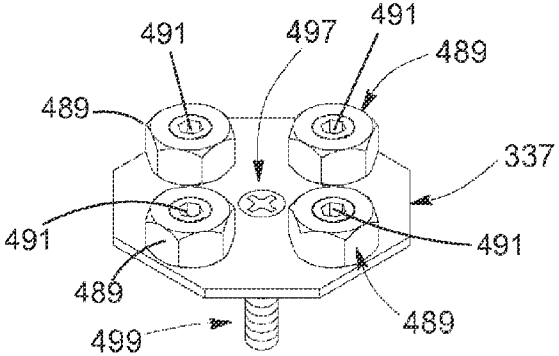
FIG. 46 is another perspective view of what is shown in FIG. 43, the projections of the connecting plate being now provided with corresponding nuts, and the connecting plate being further provided with a threaded anchor extending downwardly from a center point of the connecting plate according to a preferred embodiment of the present invention.
Figure 52:
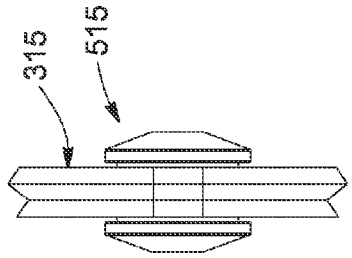
FIG. 52 is an enlarged view of a portion of what is shown in FIG. 50.
Figure 54:
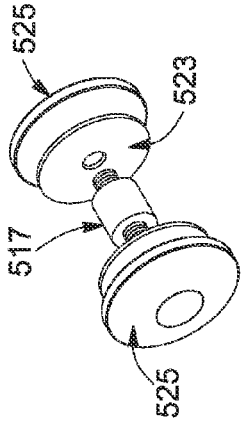
FIG. 54 is an exploded view of the component shown in FIG. 53.
Figure 51:
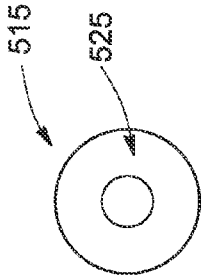
FIG. 51 is an enlarged view of a portion of what is shown in FIG. 49.
Figure 53:
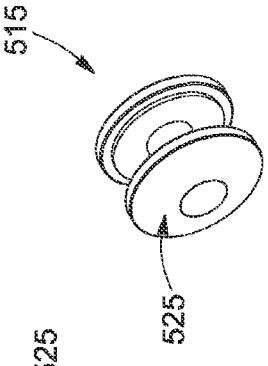
FIG. 53 is a perspective view of a complementary accessory assembly according to a preferred embodiment of the present invention.

Preferably also, the adjustment legs (451, 453) comprise recessed portions (451*a*, 453*a*) for avoiding the height adjusting rod (445) when the adjustment legs (451, 453) are drawn down into a lowered configuration, as can be easily understood when referring to FIGS. 17, 18 and 22.

The height adjusting rod (445) can be manufactured in a great number of ways, but according to a preferred embodiment of the present invention, it comprises first and second separate rod components being provided with the first and second threaded segments (447, 449) respectively, the first rod component comprising an extremity with a male component being securely insertable into a female component of a corresponding extremity of the second rod component, as can be easily understood when referring to FIGS. 22-25.

Figure 20:
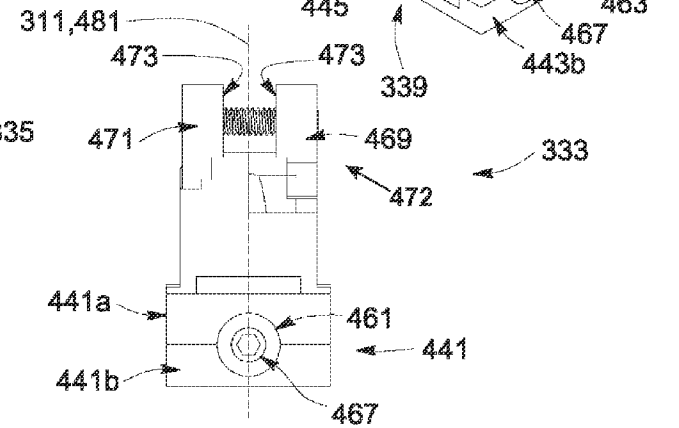
FIG. 20 is a front elevational view of what is shown in FIG. 17.

Referring to FIGS. 17-27, it is shown how the height adjusting rod (445) can be rotatively mounted about first and second bushings (461, 463) provided on the first and second end caps (441, 443) respectively, although other suitable mounting methods may be used according to the present invention. FIG. 20 provides an illustration of the first bushing (461), for example, while FIG. 17 provides an illustration of the second bushing 461.

According to a preferred embodiment, each end cap (441, 443) comprises a first end cap component (441*a*, 443*a*) being removably connectable via at least one corresponding fastener (465) onto a second end cap component (441*b*, 443*b*) being fixed to the base (339) of the height adjustment assembly (333), as can be easily understood from FIGS. 17 and 20.

As also shown in FIG. 20, at least one distal extremity of the height adjusting rod (445) is provided with a socket (467) for receiving a corresponding insert of a driving tool, but preferably, both extremities of the height adjusting rod (445) are provided with a socket (467) for receiving a corresponding insert of a driving tool, so as to namely enable to operate the height adjustment assembly (333) from both sides thereof.

Preferably, and as can be easily understood from FIGS. 3-22, each socket (467), height adjusting rod (445) and support edge (335) of each height adjustment assembly (333) lie substantially in a same vertical plane, under a corresponding wall panel (305, 315).

Figure 19:
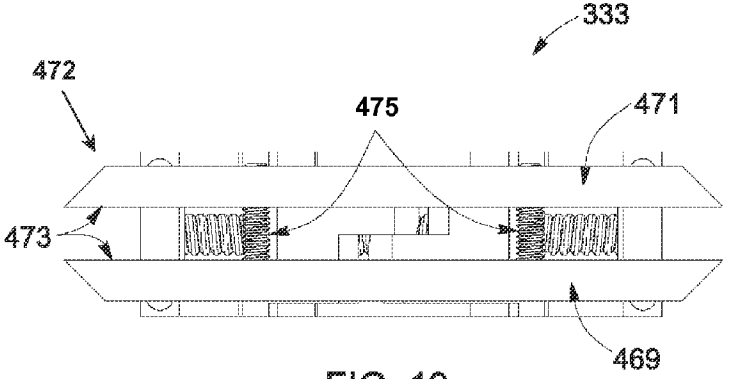
FIG. 19 is a top plan view of what is shown in FIG. 17.

According to another preferred aspect of the present invention, and as also shown for example in FIGS. 17 and 19, each height adjustment assembly (333) comprises opposite first and second clamps (469, 471) to define a lower clamp assembly (472) for clamping a bottom portion of a corresponding wall panel (315). Preferably, inner surfaces of the first and second clamps (469, 471) are provided with a gasket at location (473), as can be easily understood when referring to FIGS. 6, 7 and 17.

As better shown in FIGS. 17-22, each height adjustment assembly (333) comprises at least one connector (475) extending between the first and second clamps (469, 471). Preferably, each connector (475) is a clamp screw being configured with respect to the first and second clamps (469, 471) for urging said clamps (469, 471) towards one another via a corresponding rotation of the clamp screw. Each connector (475) may be provided with a bushing (479), and in such a case, the bushing is preferably a nylon bushing (479), although other suitable components and materials may be used according to the present invention.

According to a preferred embodiment of the invention, the bottom edge of each prefabricated frameless panel (315) is provided with at least one positioning notch (477) for cooperating with a corresponding connector (475), which is part of the clamp assembly (472). Each notch (477) is preferably prefabricated onto each panel (315) in a precise manner using an appropriate method. While the notch(es) (477) are not visible, for example, in FIGS. 7 and 9, an embodiment of the notch (477) can be seen in FIG. 150. Among other advantages, the presence of such positioning notches (477) enable to easily and precisely place each panel (315) onto a corresponding pair of height adjustment assemblies (333), as can be easily understood when referring to FIGS. 7 and 9, for example. In this regard, each height adjustment assembly (333) is preferably made symmetrical along a longitudinal axis (481) thereof.

According to another preferred aspect of the present invention, each height adjustment assembly (333) is a power-drivable height adjustment assembly (333) being selectively adjustable via a power drill through a corresponding socket (467) of the height adjustment assembly (333). The socket (467) of the height adjustment assembly (333) may extend in a substantially parallel relationship with respect to the support edge (335) thereof, as explained earlier, and as exemplified in FIGS. 17-22. Alternatively, the socket (467) of the height adjustment assembly (333) may extend in a substantially traverse relationship with respect to the support edge (335) thereof.

Obviously, various other types of suitable height adjustment assemblies (333) and cooperations with remaining components of the present wall panel system (301) may be used according to the present invention, as apparent to a person skilled in the art. As way of an example, reference is made to FIGS. 28-33, among various alternatives, there is shown a telescopic height adjustment assembly (333) including a telescoping screw-type height adjustment mechanism the adjustment mechanism including a first substantially vertical member (334) that is cylindrical in shape and has inner threads and outer threads, a second substantially vertical member (336) that is cylindrical in shape and has inner and outer threads, and a third substantially vertical member (338) that is cylindrical in shape and has inner and outer threads. The third vertical member (338) is telescopically received in the second vertical member (336) and the second vertical member (336) is telescopically received in the first vertical member (334). If desired, greater or fewer telescoping members (e.g., a fourth vertical member (340) telescopically received in the third vertical member 338) are provided. Actuation of the adjustment mechanism (e.g., using a worm gear) includes rotating the first, second, and third members (334, 336, 338) relative to one another to telescopically extend the third member (338) from the second member (336) and the second member (336) from the first member (334).

In other embodiments, as shown in FIGS. 34-42, the system (301) includes a double-shaft height adjustment assembly (333) including a screw-type height adjustment mechanism. As illustrated, the double-shaft height adjustment assembly (333) includes a first vertical shaft 1202 extending upwards from a base 339 and a second vertical shaft 1204 extending upwards from a base 339. The first vertical shaft 1202 and the second vertical shaft may be rotated by rotating the worm gear 467. The first vertical shaft 1202 can engage a first nut 1120*a*, which is disposed within the second clamp 471 while the second vertical shaft 1204 can engage a second nut 1120, which is disposed within the first clamp 469. As seen, the nuts 1120, 1120*a* are disposed against rotation within the first clamp 469 and the second clamp 471, respectively, and thus rotation of the first and second vertical shafts 1202, 1204 can cause the clamps 469, 471 to move vertically in response to rotation of the worm gear 467.

Preferably, each prefabricated frameless panel (315), each bottom floor channel (331) and each height adjustment assembly (333) associated with each wall panel (305) are delivered on site in a "pre-assembled" manner, prior to the assembling of the wall panels (305, 315) together on site in order to define the office space (303), in order to facilitating and expedite installation. It should also be understood that according to some embodiments each frameless panel (315) is further pre-assembled with each top clamp assembly (326), and each ceiling track (327) associated with each wall panel (305) in a "pre-assembled" manner. In other words, the wall panels (305) are provided on site for installation with the bottom floor channels (331), height adjustment assemblies (333), top clamp assemblies (326), and ceiling tracks (327) pre-attached, or otherwise pre-assembled to the frameless panels (315).

According to another preferred aspect of the present invention, and as better shown in FIGS. 43-48, each connecting plate (337) is a non-invasive connecting plate (337) having a center point (483). By "non-invasive", it is meant that the connecting plate (337) need not be anchored (penetrated, nailed, screwed, etc.) onto the floor, except in areas subject to earthquakes, in which case, legislation may require a corresponding anchoring to the floor, that is why the present connecting plate (337) may also come in a "seismic" version, as explained hereinbelow.

Figures 6, 7, 8:
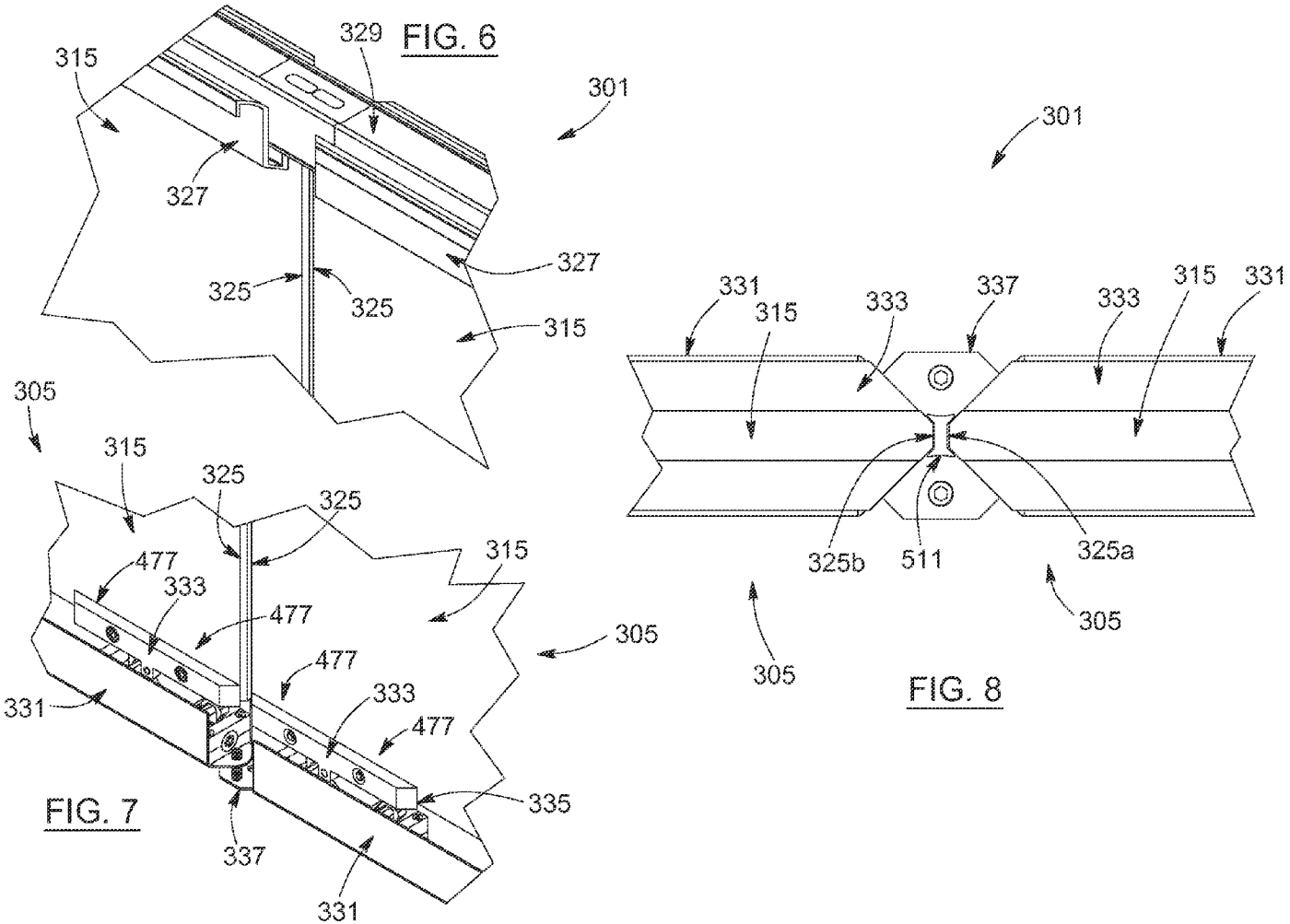
FIG. 6 is a partial top perspective view of an assembly of a pair of butt-glazed wall panels disposed along a 180°-angle connection according to a preferred embodiment of the present invention, the assembly being shown without a ceiling cover so as to better illustrate the ceiling track of each wall panel.
FIG. 7 is a partial bottom perspective view of an assembly of a pair of butt-glazed wall panels disposed along a 180°-angle connection according to a preferred embodiment of the present invention, the assembly being shown without a bottom cover so as to better illustrate the bottom channel and height adjustment assemblies of each wall panel, as well as the connecting plate interconnecting extremities of a pair of bottom channels according to a preferred embodiment of the present invention.
FIG. 8 is a cross-sectional view taken along a given segment of what is shown in FIG. 7.
Figure 10:
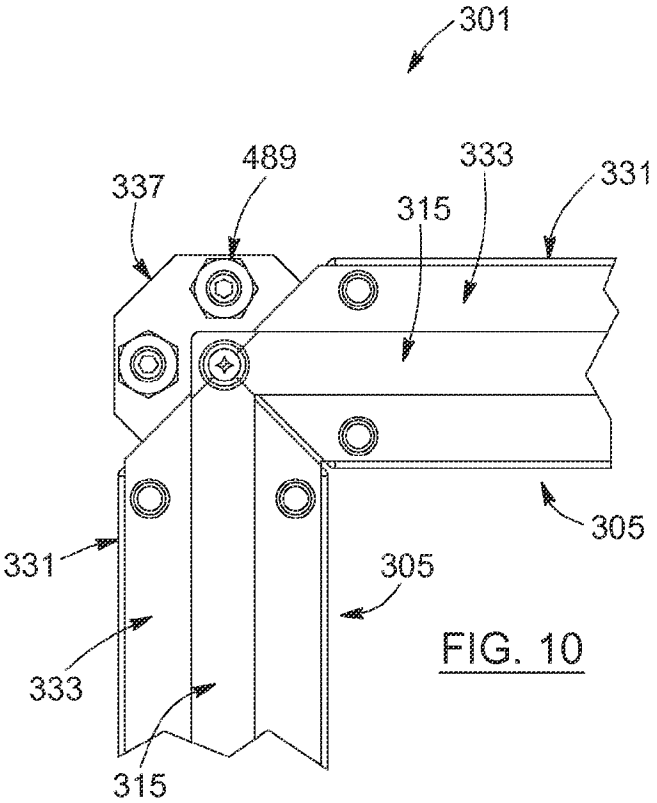
FIG. 10 is a cross-sectional view taken along a given segment of what is shown in FIG. 9.
Figure 9:
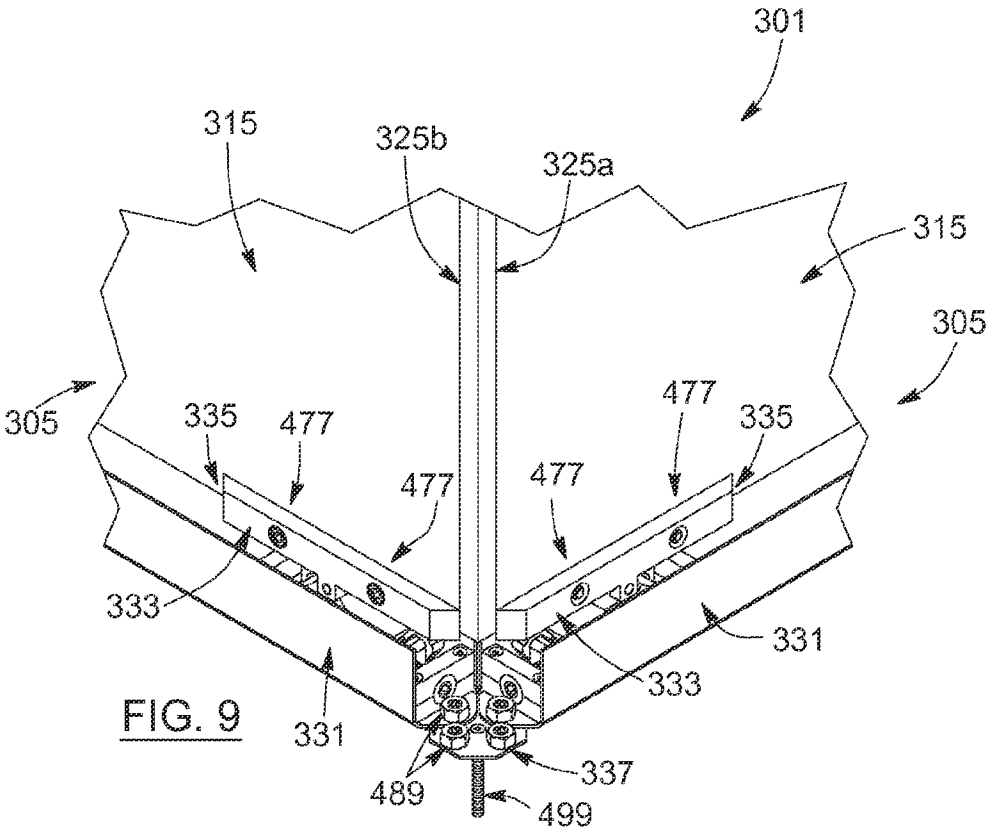
FIG. 9 is a partial bottom perspective view of an assembly of a pair of butt-glazed wall panels disposed along a 90°-angle connection according to a preferred embodiment of the present invention, the assembly being shown without bottom covers so as to better illustrate the bottom channel and height adjustment assemblies of each wall panel, as well as the connecting plate interconnecting extremities of a pair of bottom channels according to a preferred embodiment of the present invention.
Figure 13:
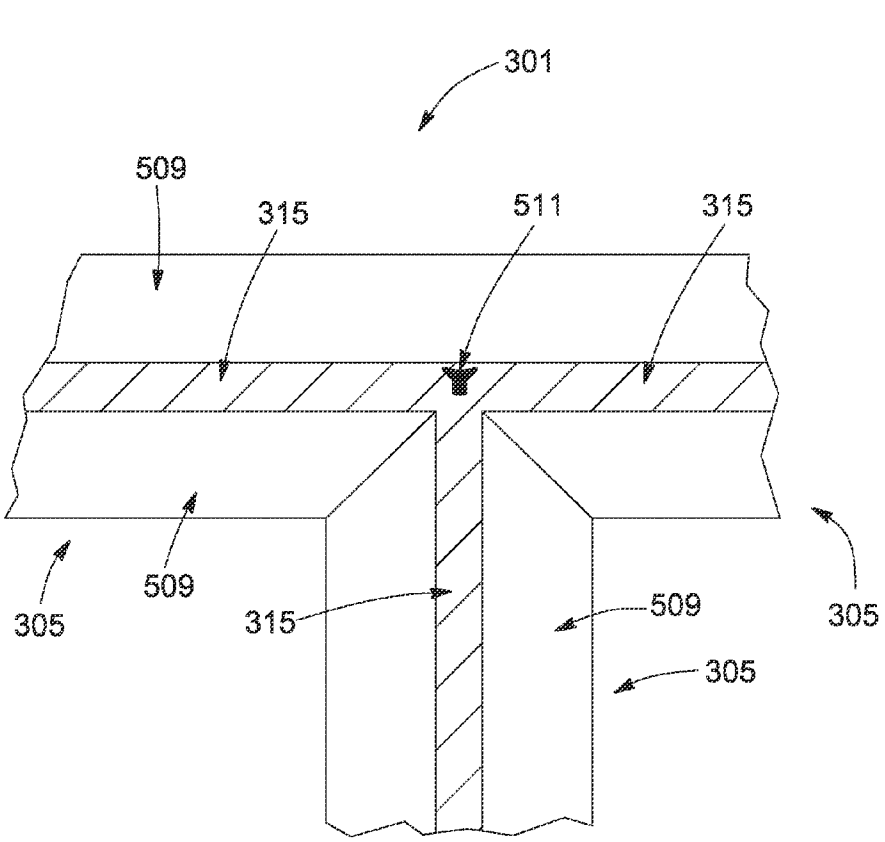
FIG. 13 is a cross-sectional view taken along a given segment of what is shown in FIG. 12.

Preferably, each connecting plate (337) comprises a plurality of projections (485) disposed about the center point (483), each projection (485) being positioned, shaped and sized for receiving a corresponding positioning hole of a neighboring bottom floor channel (331) of the wall panel system (301), the positioning between a pair of adjacent projections (485) being configured so as to ensure proper positioning between adjacent wall panels (305, 315) of the system when corresponding bottom floor channels (331) are connected to one another via a same connecting plate (337), as can be easily understood when referring to FIGS. 7 and 9, for example As better shown in FIGS. 43-48, each projection (485) is preferably a threaded projection configured for receiving a corresponding nut (489) for removably securing an adjacent bottom floor channel (331) against the connecting plate (337). The radial angle (8) originating from the center point (483) of the connecting plate (337) and extending between a pair of adjacent projections (485) is substantially the same throughout the connecting plate (337). In the case where the connecting plate (337) comprises first and second projections (485), the radial angle (8) between adjacent projections (485) is about 180°. In the case where the connecting plate (337)

further comprises third and fourth projections (485), and the radial angle (8) between adjacent projections is about 90°.

When the present wall panel system (301) is used on a carpeted floor, each connecting plate (337) is preferably a carpet gripper. Preferably also, each projection (485) comprises a setscrew (491) threadedly engageable into a corresponding hole (493) of the connecting plate (337), and each setscrew (491) preferably further comprises a pointed tip (495) for inserting between fibers of a corresponding carpet of the floor (307), so as to avoid damaging or leaving marks on the carpet, as can be easily understood by a person skilled in the art.

In the case connecting plate (337) is intended to be used as a seismic connecting plate (337), the seismic connecting plate (337) preferably comprises an anchoring hole (497) disposed about the center point (483) for receiving therein a threaded anchor (499) or other suitable component configured for extending downwardly and anchoring the seismic connecting plate (337) onto the floor (307).

As shown in FIGS. 43-48, each connecting plate (337) preferably has a substantially octagonal shape, although other suitable shapes and forms may be used depending on the particular applications for which the present wall panel system (301) is used, and the desired end results, as can be easily understood by a person skilled in the art.

As exemplified in the various accompanying drawings, the wall panel (305, 315) comprises a ceiling rail (329) associated with each wall panel (305, 315), the ceiling rail (329) being removably mountable onto the ceiling (309), shown in FIG. 1, in a suitable manner, as is well known in the art, such as with Caddy clips, for example. The ceiling rail (329) is illustrated, for example, in FIGS. 6 and 11. As shown in the figures, the ceiling rail (329) is preferably substantially U-shaped, and comprises a pair of projecting elements (501) having extremities (503) being slanted towards one another, as shown in FIG. 4, for example.

Preferably, the ceiling track (327) of each prefabricated frameless wall panel (305, 315) is an extruded profiled ceiling track (327) being substantially complementary in shape to that of the ceiling rail (329), and comprises a pair of longitudinal grooves (505) for receiving a corresponding pair of projecting elements (501) of the ceiling rail (329). As shown in FIGS. 4 and 150, the ceiling track (327) is optionally secured to the top edge (319) of the panel (305) by a pair of top clamp assemblies (326). FIG. 151 is an enlarged view of the clamp assembly (326). In some embodiments, the pair of top clamp assemblies (326) are laterally spaced apart a similar distance to that of the pair of lower clamp assemblies (472). Each of the top clamp assemblies (326) is substantially shorter in length than the ceiling track 327, for example being about the same length as the lower clamp assemblies (472). In other embodiments, each panel (305) includes a pair of ceiling tracks (327) that have lengths substantially less than the overall width of the panel (305), each of the pair of ceiling tracks (327) secured to a corresponding top clamp assembly (326).

Figure 4:
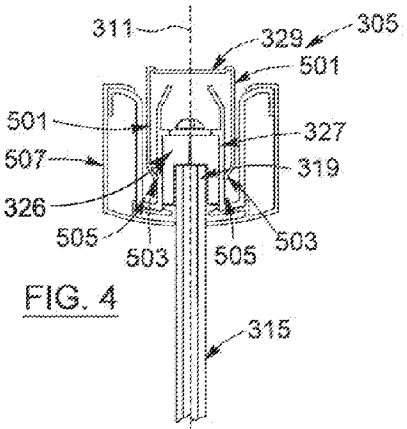
FIG. 4 is an enlarged view of a top portion of what is shown in FIG. 3.
Figure 5:
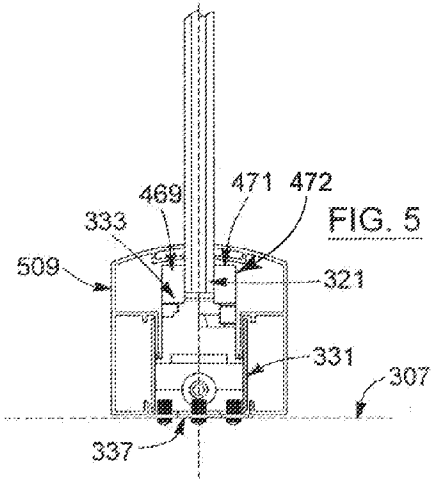
FIG. 5 is an enlarged view of a bottom portion of what is shown in FIG. 3.
Figure 3:
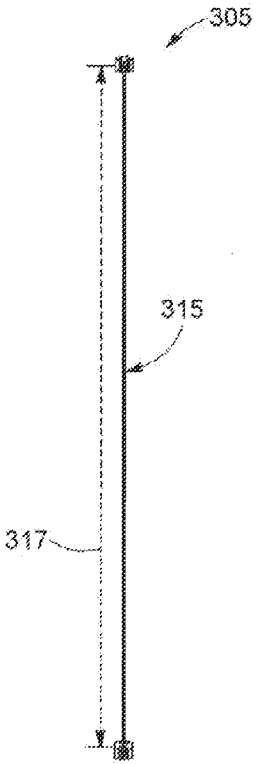
FIG. 3 is a cross-sectional view of FIG. 2.
Figure 2:
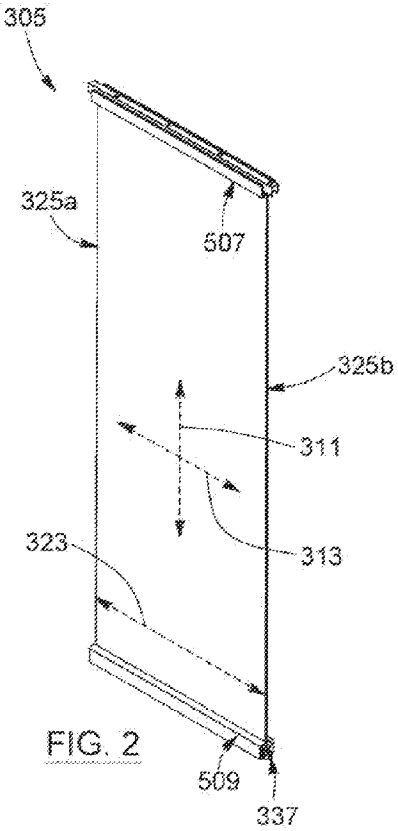
FIG. 2 is a perspective view of a butt-glazed frameless wall panel cooperating with a ceiling rail according to a preferred embodiment of the present invention.
Figure 11:
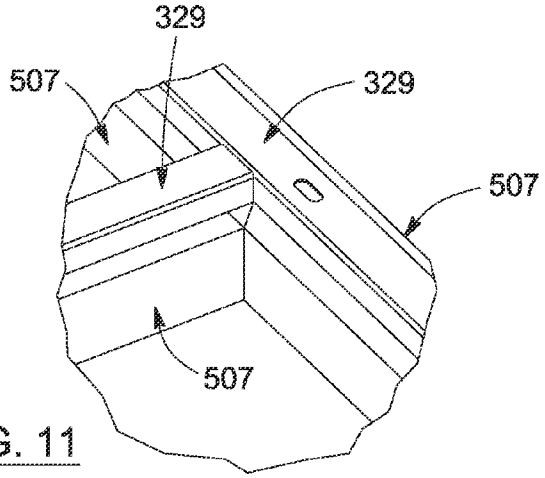
FIG. 11 is a partial top perspective view of an assembly of butt-glazed wall panels disposed along a 3-way connection according to a preferred embodiment of the present invention, the assembly being shown with corresponding ceiling covers.
Figure 12:
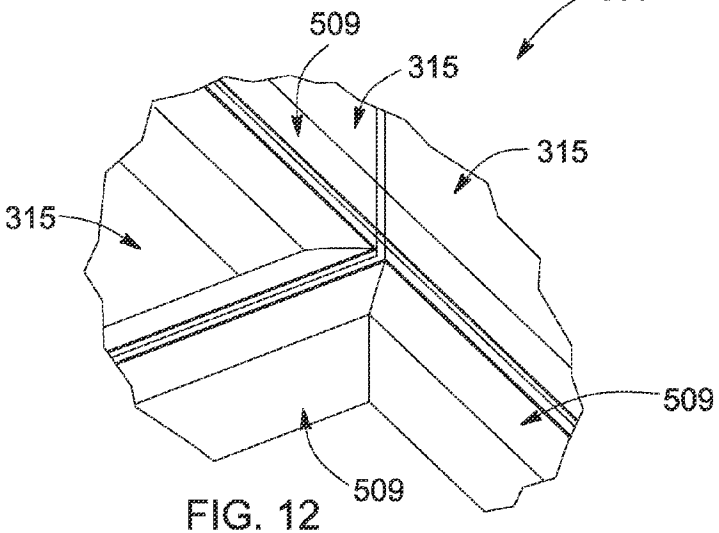
FIG. 12 is a partial bottom perspective view of an assembly of butt-glazed wall panels disposed along a 3-way connection according to a preferred embodiment of the present invention, the assembly being shown with corresponding bottom covers.
Figure 15:
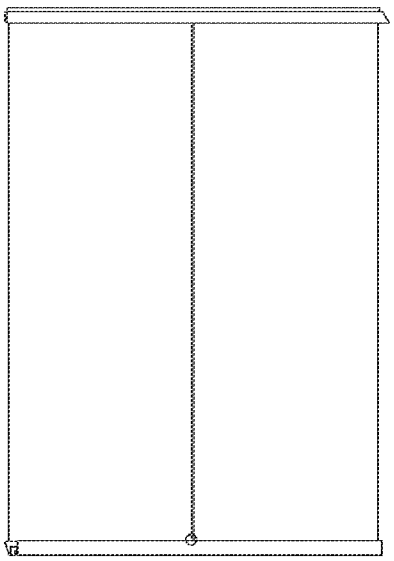
FIG. 15 is a side elevational view of a butt-glazed wall panel assembly disposed along a three-way connection according to a preferred embodiment of the present invention, the wall panel assembly being shown with top and bottom covers.
Figure 16:
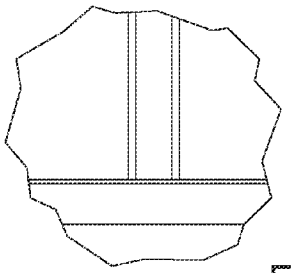
FIG. 16 is an enlarged view of a bottom portion of what is shown in FIG. 15.
Figure 14:
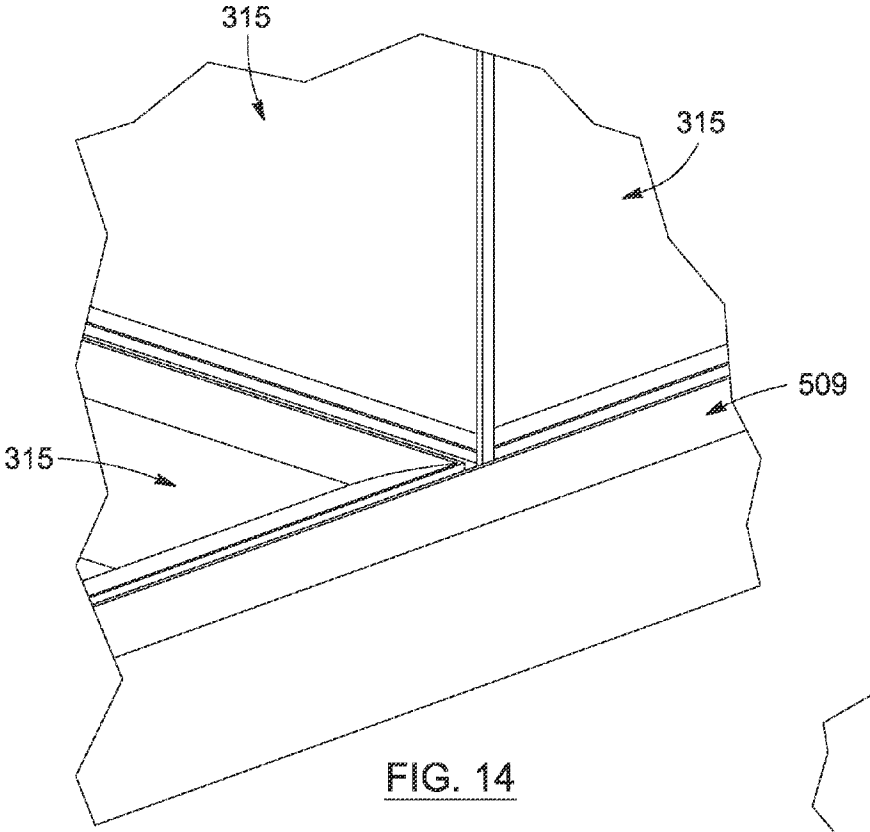
FIG. 14 is a partial bottom perspective view of a butt-glazed wall panel assembly disposed along a three-way connection according to a preferred embodiment of the present invention, the assembly being shown with corresponding bottom covers.

As exemplified in the various accompanying drawings, such as FIGS. 4 and 11, the wall panel system (301) preferably comprises a ceiling cover (507) associated with each prefabricated frameless wall panel (305, 315), the ceiling cover (507) being removably mountable onto the ceiling track (327) of said prefabricated frameless wall panel (305, 315) in a variety of suitable manners, as apparent to a person skilled in the art. Similarly, the wall panel system (301) comprises a bottom cover (509) associated with each prefabricated frameless wall panel (305, 315), the bottom cover (509) being removably mountable onto the bottom floor channel (331) of said prefabricated frameless wall panel (305, 315), in a variety of suitable manners, as apparent to a person skilled in the art. The bottom cover (509) is illustrated, for example, in FIGS. 12 and 13.

According to a preferred aspect of the present invention, each prefabricated frameless wall panel (305, 315) is a frameless glass panel (305, 315) for defining a frameless butt-glazed assembly (303), as exemplified in FIG. 1, for instance. Preferably, a gasket (511) is provided between adjacent side edges (325) of neighboring panels (305, 315), as shown in FIG. 8, for example.

Figure 56:
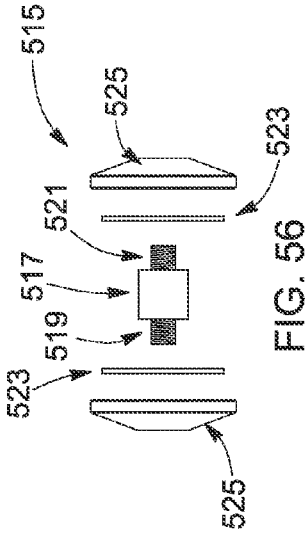
FIG. 56 is a side view of what is shown in FIG. 54.
Figure 50:
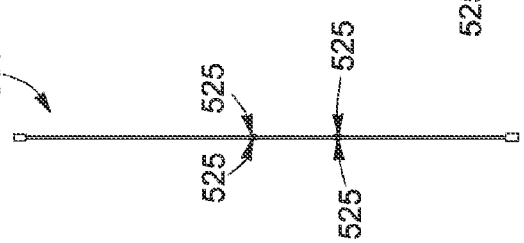
FIG. 50 is a cross-sectional view of what is shown in FIG. 49.
Figure 49:
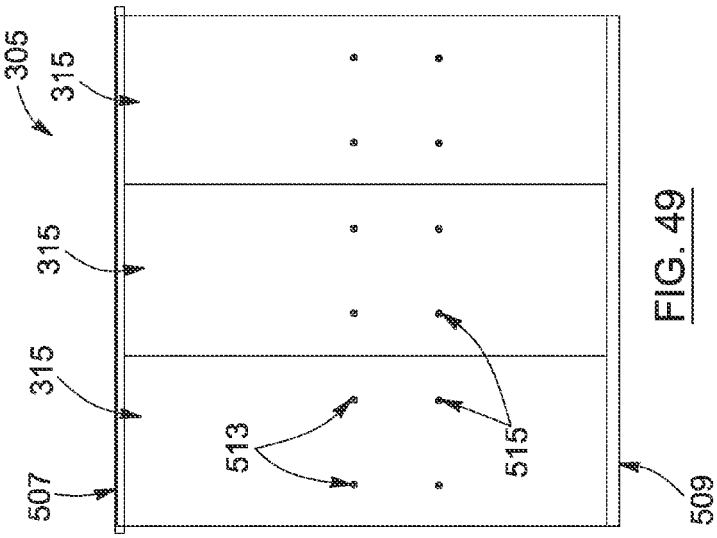
FIG. 49 is a side elevational view of a wall panel assembly provided with butt-glazed distraction markers according to a preferred embodiment of the present invention.
Figure 55:
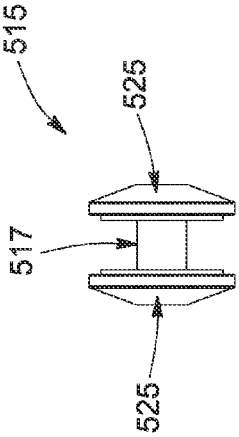
FIG. 55 is a side view of what is shown in FIG. 53.

Referring now to FIGS. 49-75, and according to another preferred aspect of the present invention, each prefabricated frameless panel (305, 315) comprises at least one pre-perforated through-hole (513), as seen in FIG. 49, for receiving a corresponding complementary accessory (515). Preferably, the complementary accessory (515) comprises a bushing (517) insertable into a corresponding through-hole (513), the bushing (517) having opposite ends provided with first and second threaded studs (519, 521) configured for respectively receiving first and second components of the complementary accessory (515), as better shown in FIG. 56, for example. Preferably also, the complementary accessory (515) comprises a washer (523) disposed between each end of the bushing (517) and a corresponding component.

According to the preferred embodiment of the present invention exemplified in FIGS. 49-56, the complementary accessory (515) comprises a butt-glazed distraction marker (525), and at least one of the first and second components of the complementary accessory is a distraction marker (525). Preferably, the complementary accessory (515) comprises a pair of distraction markers (525), both inner and outer, as shown.

Figures 57, 58, 59, 60, 61, 62, 63, 64, 65, 66, 67:
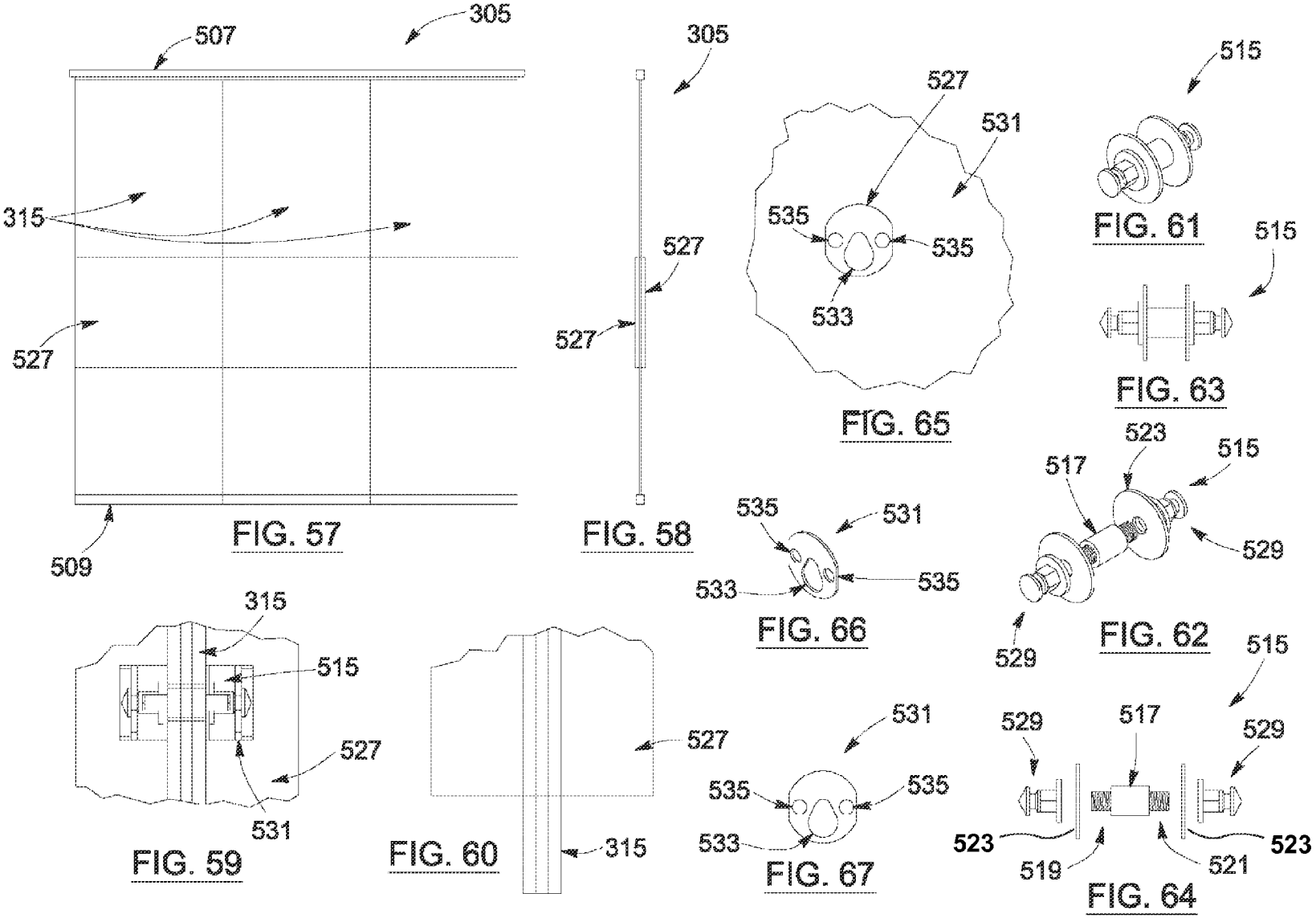
FIG. 57 is a side elevational view of a wall panel assembly being provided with butt-glazed snap-on wood shelves according to a preferred embodiment of the present invention.
FIG. 58 is a cross-sectional view of what is shown in FIG. 57.
FIG. 59 is an enlarged view of a portion of what is shown in FIG. 58.
FIG. 60 is an enlarged view of a portion of what is shown in FIG. 58.
FIG. 61 is a perspective view of a complementary accessory assembly according to another preferred embodiment of the present invention.
FIG. 62 is an exploded view of the components shown in FIG. 61.
FIG. 63 is a side elevational view of what is shown in FIG. 61.
FIG. 64 is a side elevational view of what is shown in FIG. 62.
FIG. 65 is a partial view of a wood shell provided with a hooking plate according to a preferred embodiment of the present invention.
FIG. 66 is a perspective view of the hooking plate shown in FIG. 65.
FIG. 67 is a front plan view of what is shown in FIG. 66.
Figure 71:
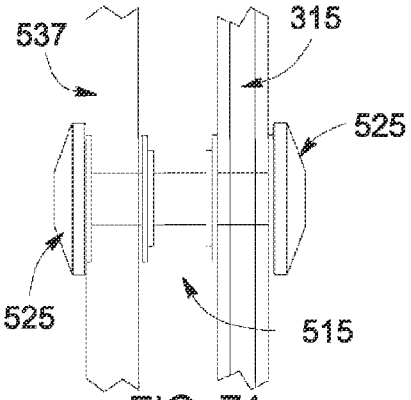
FIG. 71 is an enlarged view of a portion of what is shown in FIG. 69.
Figure 70:
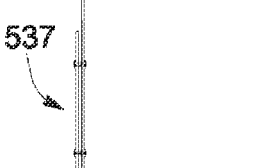
FIG. 70 is an enlarged view of a portion of what is shown in FIG. 68.
Figure 74:
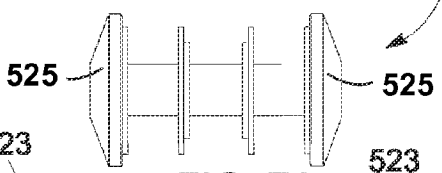
FIG. 74 is a side elevational view of what is shown in FIG. 72.
Figure 75:
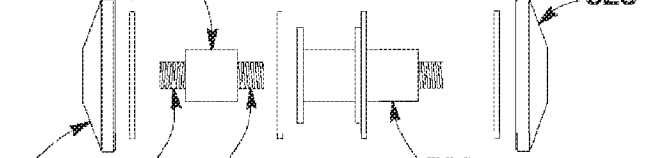
FIG. 75 is a side elevational view of what is shown in FIG. 73.
Figure 69:
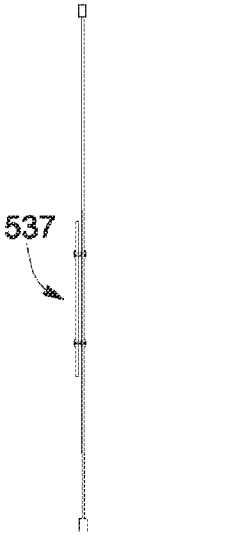
FIG. 69 is a cross-sectional view of what is shown in FIG. 68.
Figure 73:
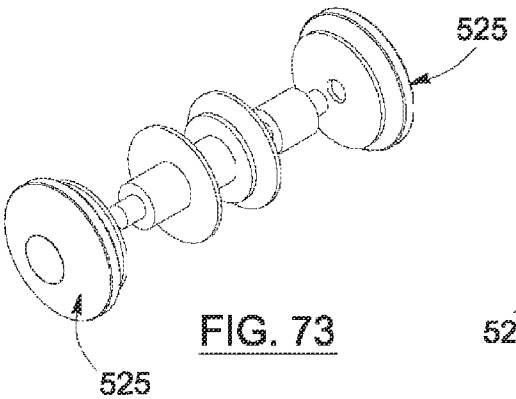
FIG. 73 is an exploded view of the component shown in FIG. 72.
Figure 68:
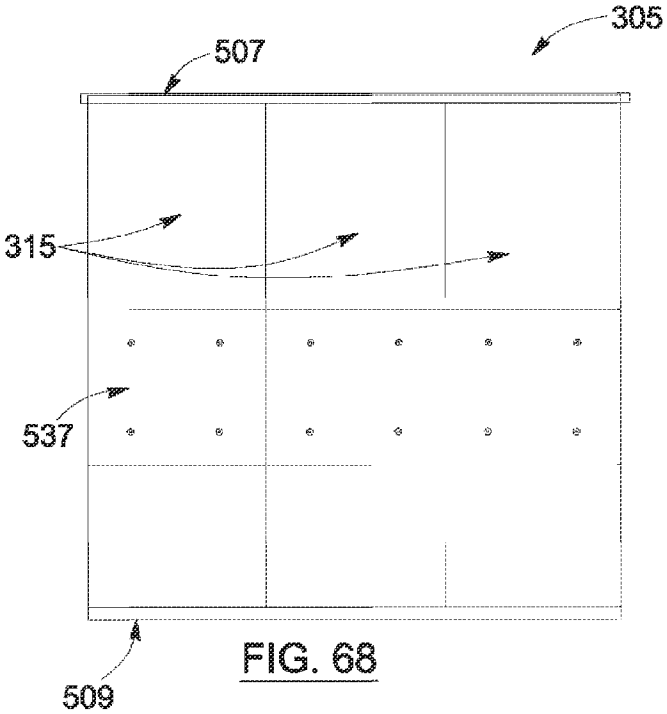
FIG. 68 is a side elevational view of a wall panel assembly being provided with butt-glazed snap-on glass shells according to a preferred embodiment of the present invention.
Figure 72:
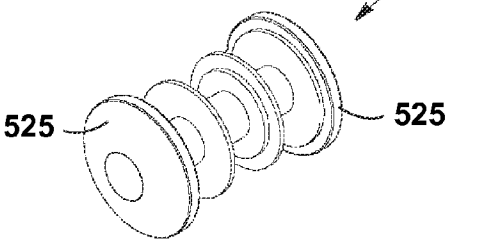
FIG. 72 is a perspective view of a complementary accessory assembly according to yet another preferred embodiment of the present invention.

According to the preferred embodiment of the present invention exemplified in FIGS. 57-67, the complementary accessory (515) may comprise a butt-glazed snap-on wood shell (527), in which case, at least one of the first and second components of the complementary accessory (515) is preferably a hooking knob (529), as better shown in FIG. 62. Preferably also, the hooking knob (529) is configured for receiving a hanging plate (531) of the butt-glazed snap-on wood shell (527), and the hanging plate (531) preferably comprises a hanging hook (533), and at least one hole (535) for receiving a corresponding fastener, as can be easily understood when referring to FIGS. 65-67.

According to the preferred embodiment of the present invention exemplified in FIGS. 68-75, the complementary accessory (515) may comprise a butt-glazed snap-on glass shell (537), in which case, at least one of the first and second components of the complementary accessory (515) is preferably a threaded stand-off stud (539). Preferably also, the complementary accessory (515) further comprises another bushing (517*b*) having opposite ends provided with first and second threaded studs (519*b*, 521*b*) configured for respectively receiving the threaded stand-off stud (539) and a distraction marker (525), as better exemplified in FIGS. 70-75

The prefabricated frameless panels (305) to be used with the present invention can be of various natures and types, as can be easily understood by a person skilled in the art. For example, the prefabricated frameless panels (305) could be a suitable laminated panel (305), or as exemplified in the drawings, simply a glass panel (305), that is preferably tempered or laminated. However, it is worth mentioning that various other suitable types of "frameless" panels (305) may be used and could be useful with the present invention, such as for example: gypsum, melamine, MDF, etc.

Preferably, and as exemplified in the accompanying figures, namely FIGS. 1 and 76-100, the wall panel system (301) comprises a sliding door assembly (541) being removably mountable onto the ceiling track (327) of a given prefabricated frameless wall panel (305, 315) of the wall panel system (301).

Figures 76, 77, 78, 79:
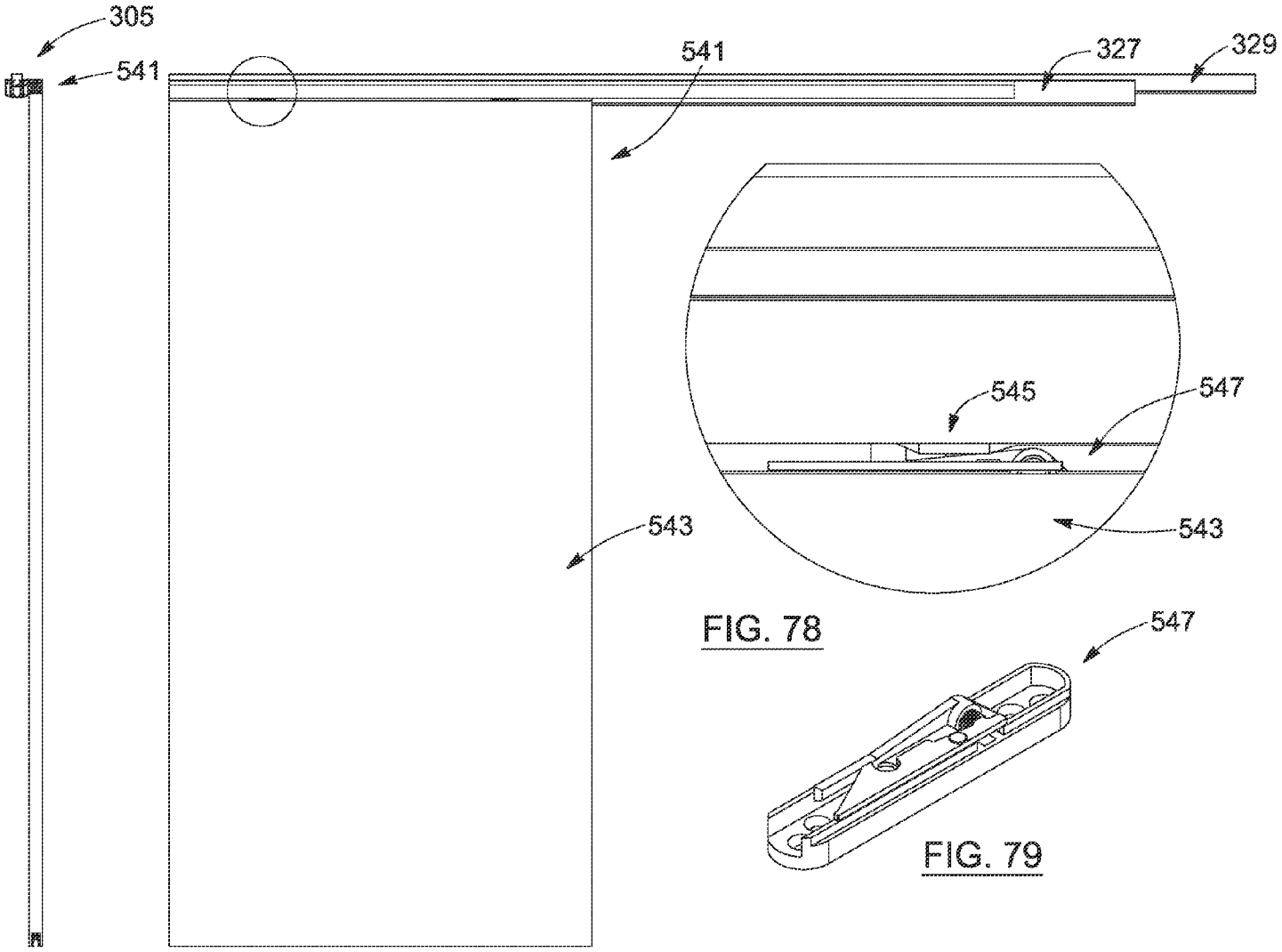
FIG. 76 is a side elevational view of a sliding door assembly operatively mounted onto a ceiling track and comprising a sliding wood door according to a preferred embodiment of the present invention.
FIG. 77 is a cross-sectional view of what is shown in FIG. 76.
FIG. 78 is an enlarged view of a portion of what is shown in FIG. 76.
FIG. 79 is a perspective view of a sliding door mounting bracket according to a preferred embodiment of the present invention.
Figure 81:
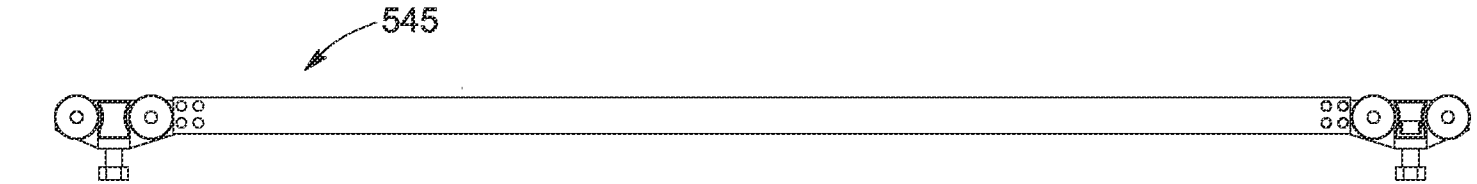
FIG. 81 is a side elevational view of a sliding door hardware being shown in an exploded relationship with a corresponding sliding door mounting bracket according to a preferred embodiment of the present invention.
Figure 82:
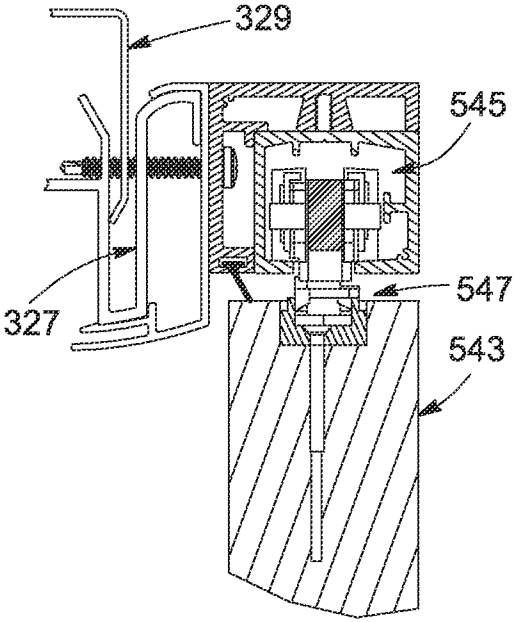
FIG. 82 is a partial cross-sectional view taken along a given segment of what is shown in FIG. 78.
Figure 80:
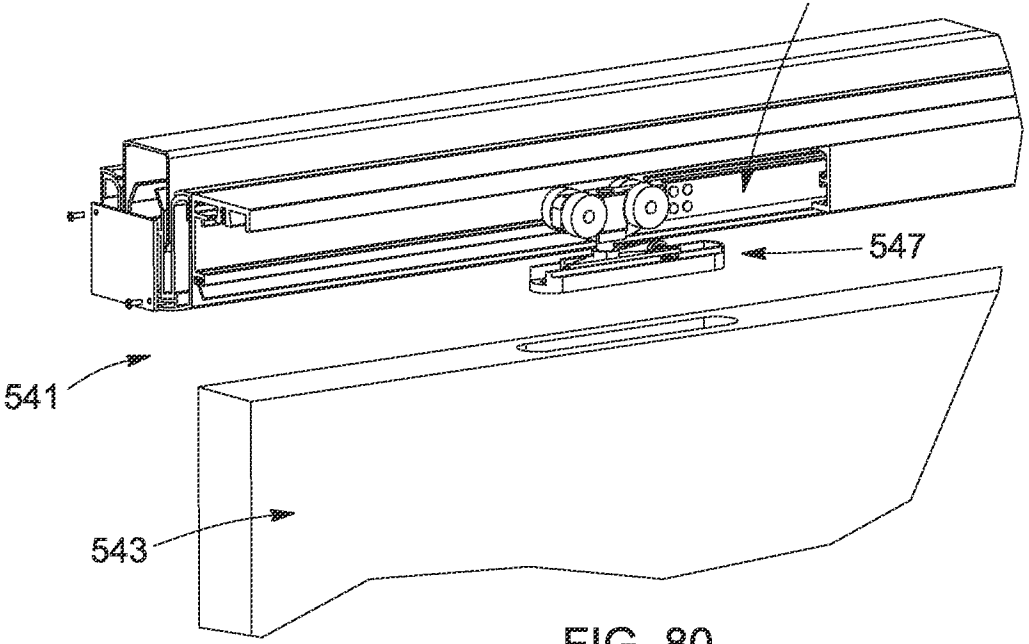
FIG. 80 is a partial top view of a sliding door assembly operatively mounted onto a corresponding ceiling track and ceiling rail according to another preferred embodiment of the present invention, some of the components being shown in an exploded relationship, including sliding door mounting bracket and wood door.
Figure 86:
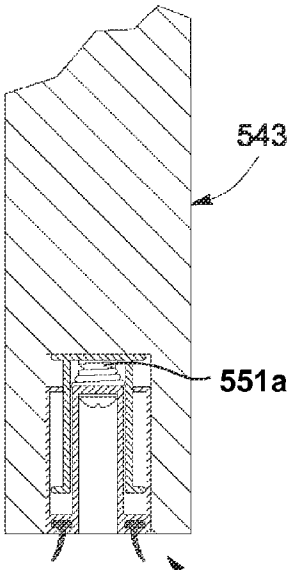
FIG. 86 is a cross-sectional view taken along a given segment of what is shown in FIG. 84.
Figure 84:
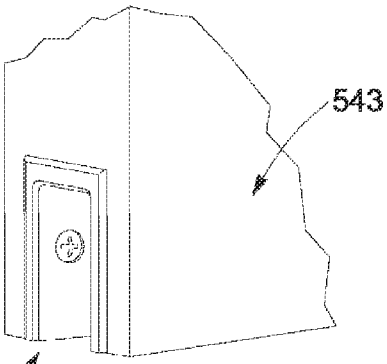
FIG. 84 is a bottom perspective view of a portion of what is shown in FIG. 83.
Figure 85:
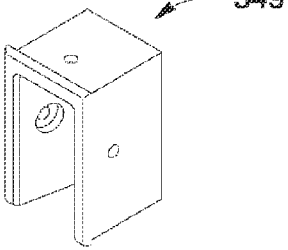
FIG. 85 is a perspective view of the bottom guide plug shown in FIG. 84.
Figure 83:
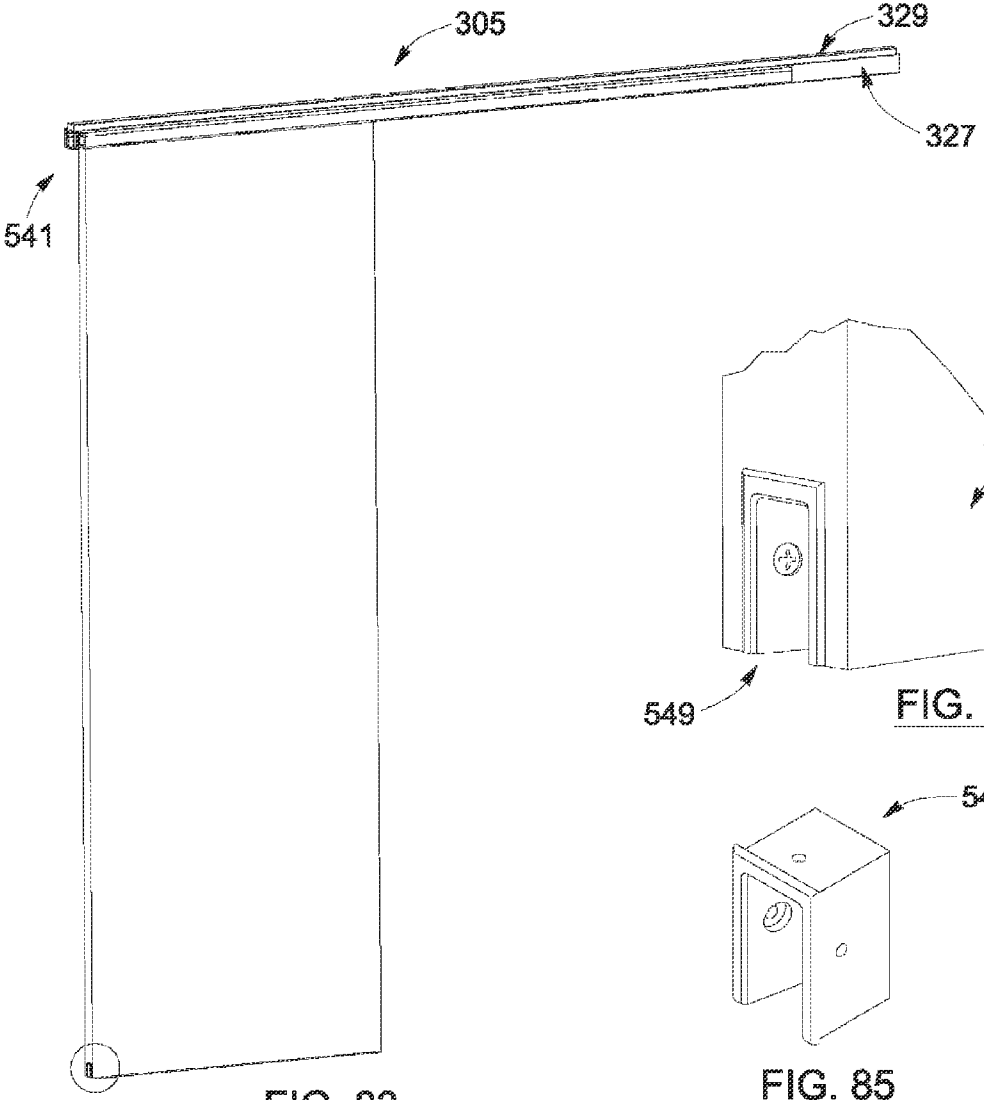
FIG. 83 is a perspective view of what is shown in FIG. 76.
Figures 87, 88, 89:
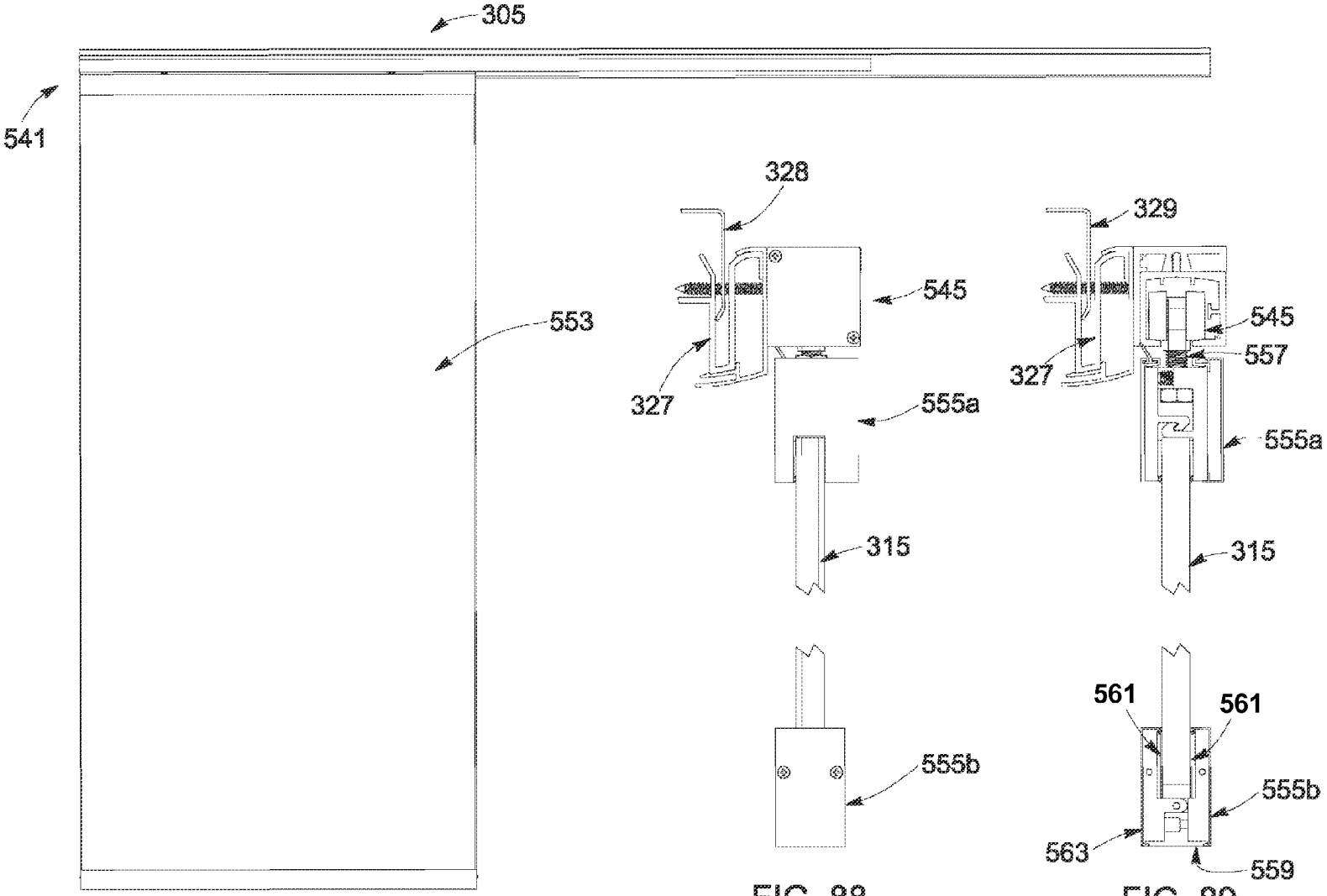
FIG. 87 is a side elevational view of a sliding door assembly operatively mounted onto a ceiling track and ceiling rail and comprising a sliding glass door according to a preferred embodiment of the present invention.
FIG. 88 is a schematic side view of what is shown in FIG. 87.
FIG. 89 is a cross-sectional view taken along a given segment of what is shown in FIG. 88.
Figures 90, 91, 92, 93:
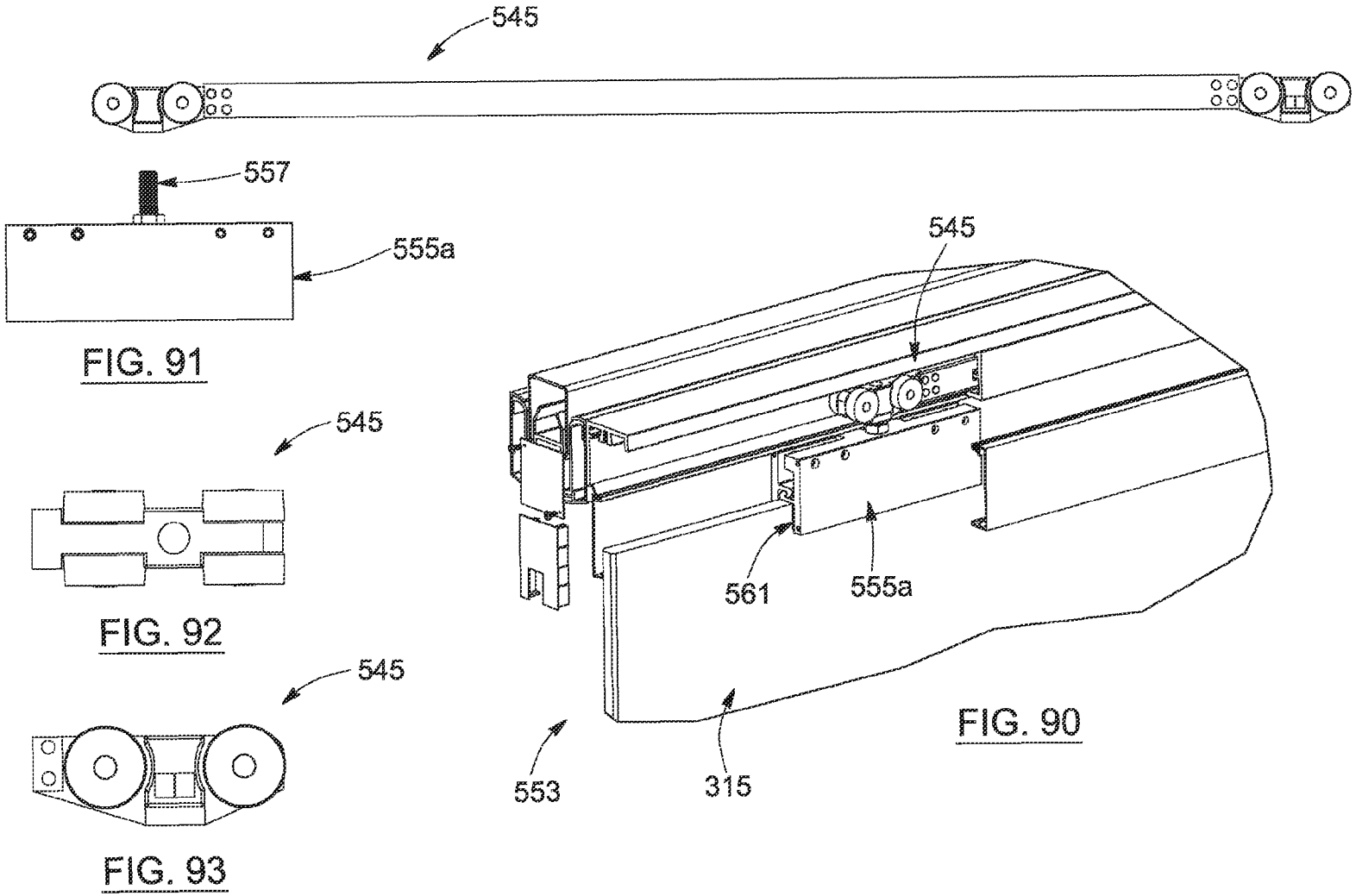
FIG. 90 is a partial top perspective view of a sliding door assembly operatively mounted onto a corresponding ceiling track and ceiling rail and comprising a sliding glass door according to yet another preferred embodiment of the present invention, some of the components shown in an exploded relationship with respect to others so as to namely better illustrate a corresponding glass clamp according to a preferred embodiment of the present invention.
FIG. 91 is a side elevational view of a sliding door hardware being shown in an exploded relationship with respect to a corresponding glass clamp according to a preferred embodiment of the present invention.
FIG. 92 is a top plan view of a rightmost portion of what is shown in FIG. 91.
FIG. 93 is a partial side elevational view of a rightmost portion of what is shown in FIG. 91.
Figure 95:
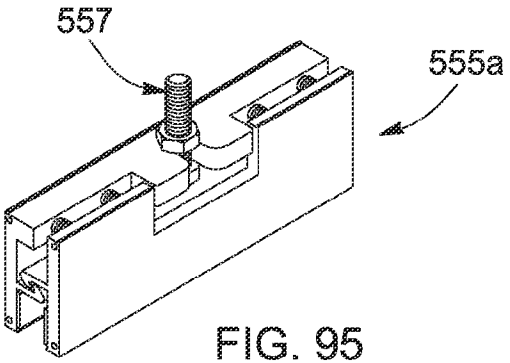
FIG. 95 is a front elevational view of what is shown in FIG. 94.
Figure 97:
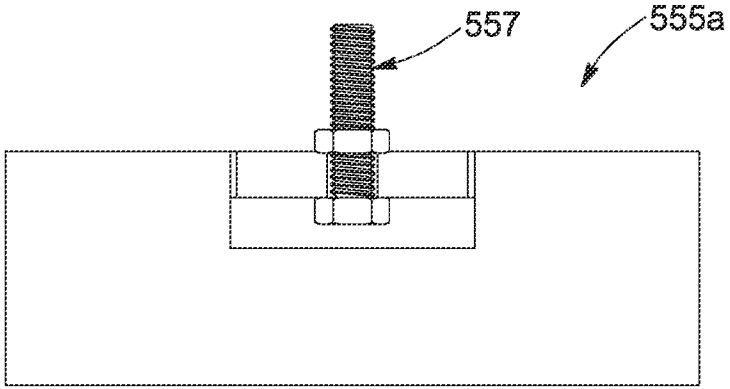
FIG. 97 is another side elevational view of what is shown in FIG. 94.
Figure 94:
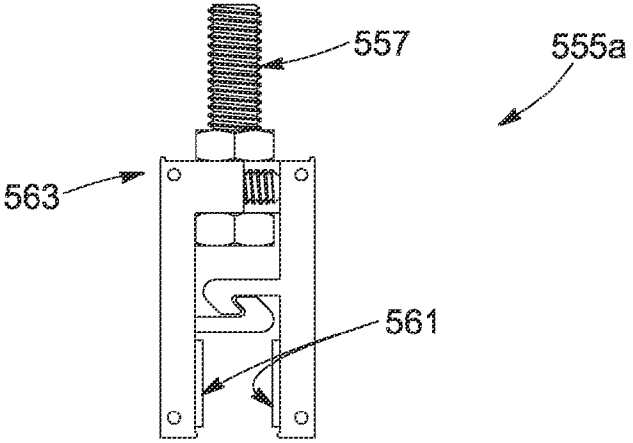
FIG. 94 is a perspective view of the upper glass clamp shown in FIG. 90, the upper glass clamp being shown provided with a height adjustment fastener.
Figure 96:
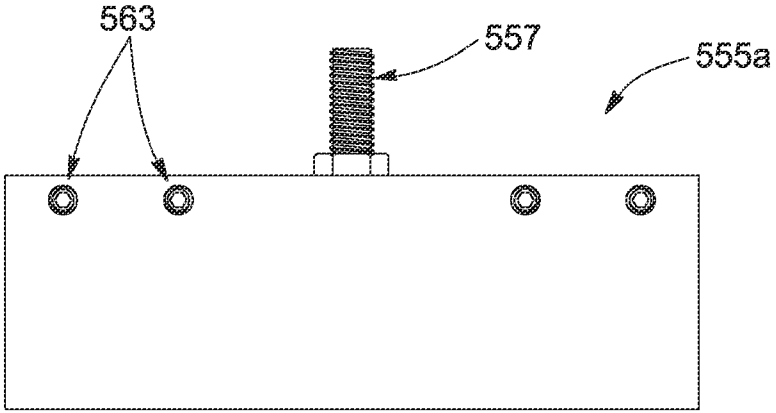
FIG. 96 is a side elevational view of what is shown in FIG. 94.
Figure 100:
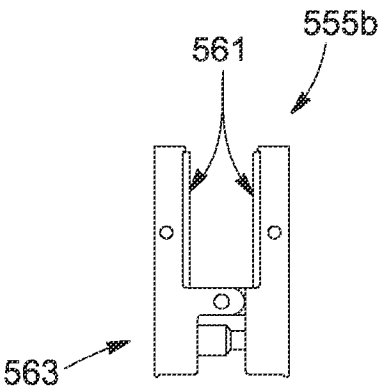
FIG. 100 is a front elevational view of what is shown in FIG. 99.
Figure 101:
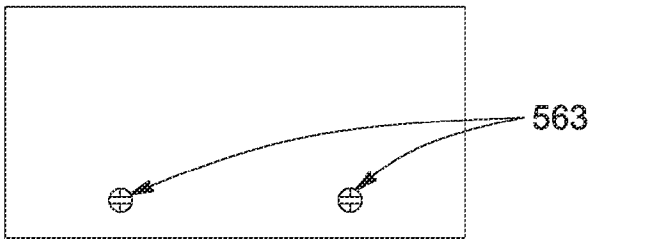
FIG. 101 is a side elevational view of what is shown in FIG. 99.
Figure 99:
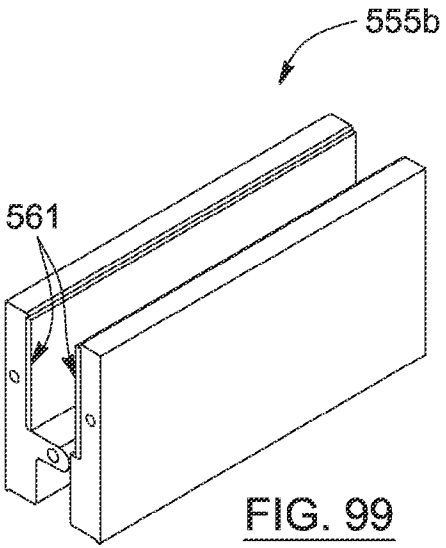
FIG. 99 is a perspective view of a bottom glass clamp shown in FIG. 98.
Figure 98:
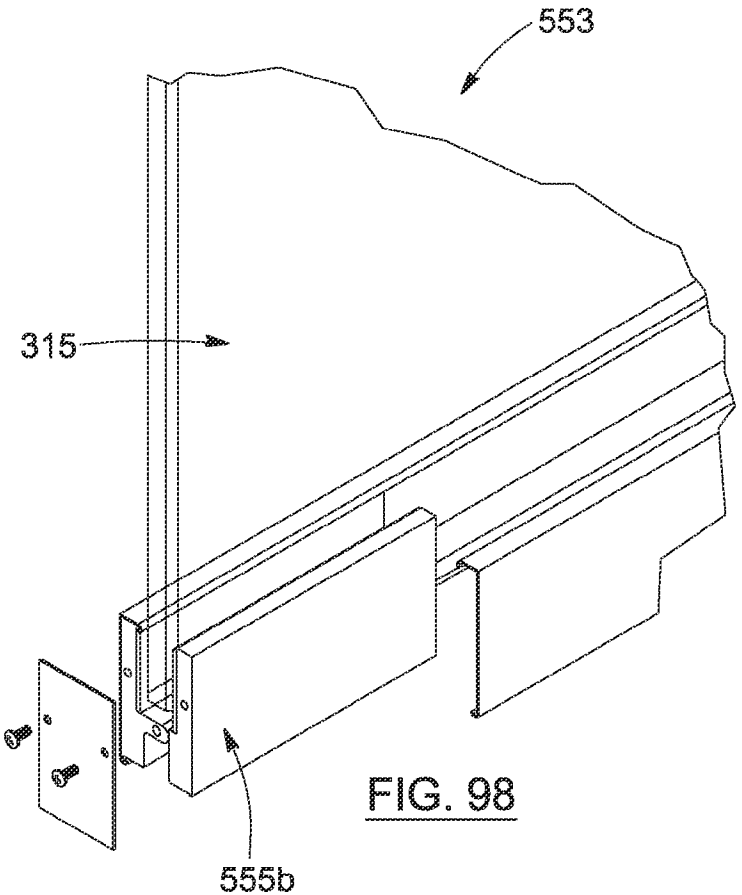
FIG. 98 is a partial bottom perspective view of a glass sliding door assembly, according to a preferred embodiment of the present invention, some of the components being shown in an exploded relationship with respect to others so as to better illustrate a bottom glass clamp according to a preferred embodiment of the present invention.

As shown for example in FIGS. 76 and 77, the sliding door assembly (541) preferably comprises a sliding door (543) removably mountable onto a sliding door hardware (545) of the sliding door assembly (541) via an upper sliding door mounting bracket (547) as illustrated in FIG. 78. Preferably, a bottom portion of the sliding door (543) is provided with a bottom guide plug (549), as better shown in FIGS. 84 and 85. Preferably also, a bottom portion of the sliding door (543) is provided with a bottom floor seal (551), and the bottom floor seal (551) may be spring-loaded via a spring 551*a* so as to be biased downwardly, as exemplified in FIG. 86.

Alternatively, and when referring to FIGS. 87-100, the sliding door assembly (541) may comprise a sliding glass door (553) removably mountable onto a sliding door hardware (545) of the sliding door assembly (541) via a pair of upper glass clamps (555*a*), the sliding door assembly (541) further comprising a height adjustment fastener (557) cooperating between the sliding door hardware (545) and each upper glass clamp (555*a*), and configured for selectively adjusting the vertical distance between said sliding door hardware and each upper glass clamp (555*a*), so as to in turn selectively adjust the height and angle of the sliding glass door (553) with respect to the floor (307). Preferably, the sliding glass door (553) is provided with a pair of bottom glass clamps (555*b*), which in turn are preferably provided with a bottom floor seal (559). Preferably also, opposite inner surfaces of each glass clamp (555) are provided with corresponding gaskets (561).

According to a preferred embodiment of the present invention, each glass clamp (555) comprises a tightening assembly (563) for urging the inner surfaces of the clamp (555) towards one another via a corresponding tightening of the tightening assembly (563), as can be easily understood when referring to FIGS. 89 and 94-100.

One way or the other, whether a sliding wooden door (543) or a sliding glass door (553), the sliding door hardware (545) is preferably provided with a soft-stop mechanism, not illustrated.

Figure 105:
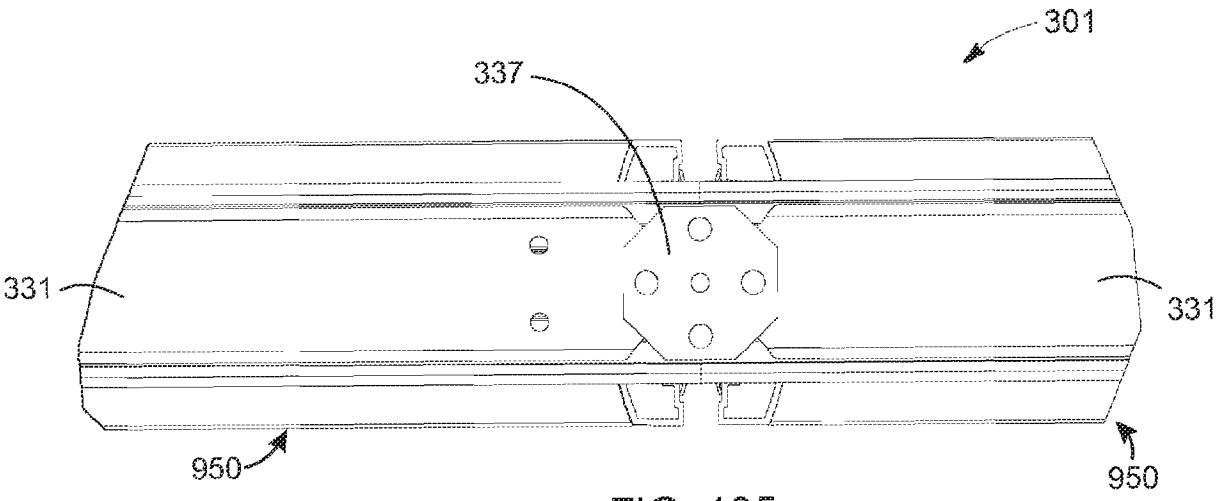
FIG. 105 is a bottom plan view of a pair of glass post panels being assembled onto one another according to a preferred embodiment of the present invention.
Figure 106:
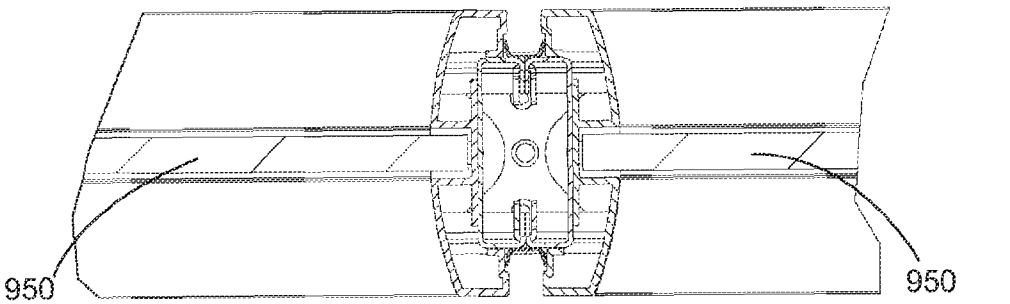
FIG. 106 is a cross-sectional view taken along a given segment of what is shown in FIG. 105.

FIG. 102 is a side elevational view of a pair of glass post panels 950 being assembled onto one another according to a preferred embodiment of the present invention. FIG. 103 is an enlarged view of a top portion and FIG. 104 is an enlarged view of the pair of glass post panels 950. FIG. 105 is a bottom plan view of a pair of glass post panels being assembled onto one another according to a preferred embodiment of the present invention, illustrating the connecting plate 337 and the bottom floor channel 331. FIG. 106 is a cross-sectional view taken along a given segment of what is shown in FIG. 105.

Figure 109:
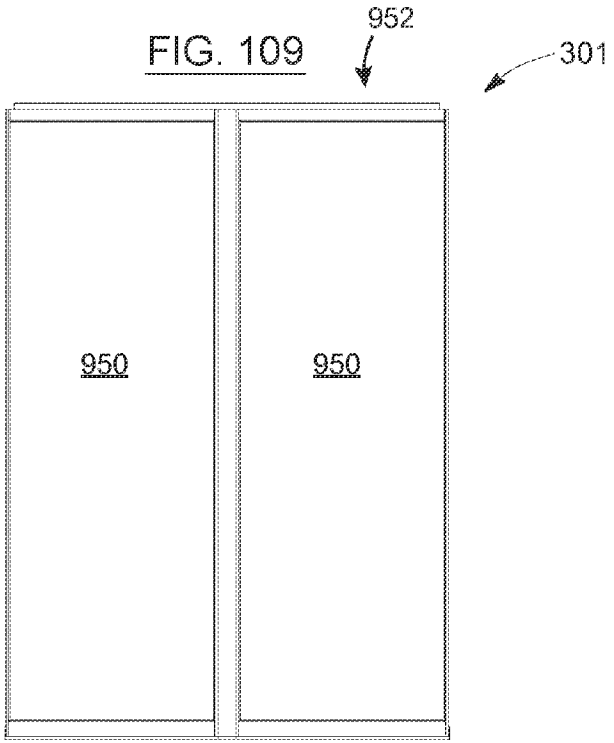
FIG. 109 is a side elevational view of a three-way glass post panel assembly according to a preferred embodiment of the present invention
Figure 110:
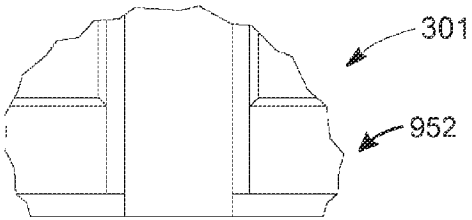
FIG. 110 is an enlarged view of a bottom portion of what is shown in FIG. 109.
Figure 107:
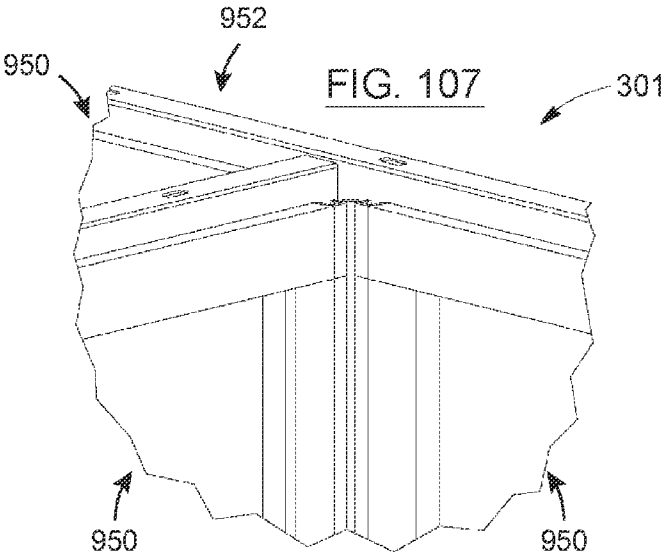
FIG. 107 is a partial top view of a three-way glass post panel assembly according to a preferred embodiment of the present invention.
Figure 108:
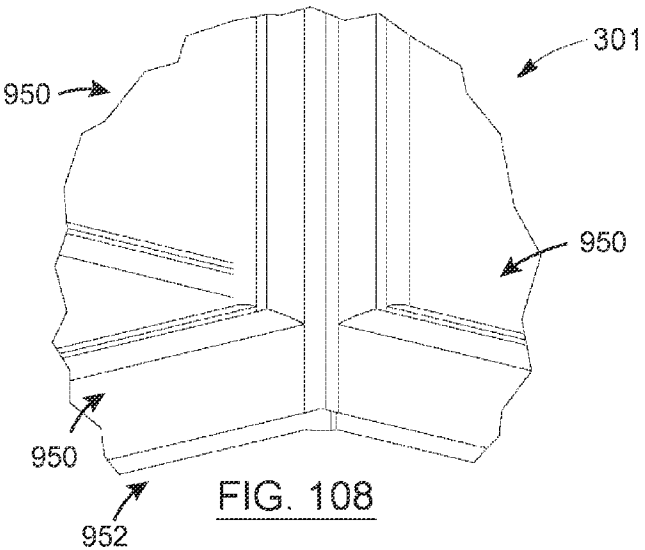
FIG. 108 is a partial bottom view of a three-way glass post panel assembly according to a preferred embodiment of the present invention.

FIG. 107 is a partial top view of a three-way glass post panel 952 assembly according to a preferred embodiment of the present invention. FIG. 108 is a partial bottom view of the three-way glass post panel assembly 952. FIG. 109 is a side elevational view of the three-way glass post panel assembly 952. FIG. 110 is an enlarged view of a bottom portion of the three-way glass post panel assembly 952.

Figure 112:
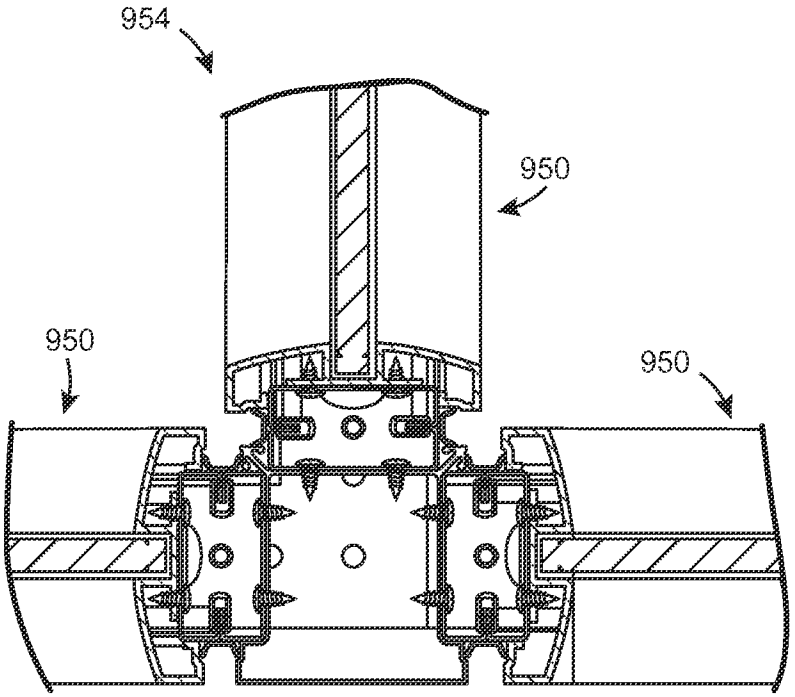
FIG. 112 is an enlarged view of a portion of what is shown in FIG. 111.
Figure 111:
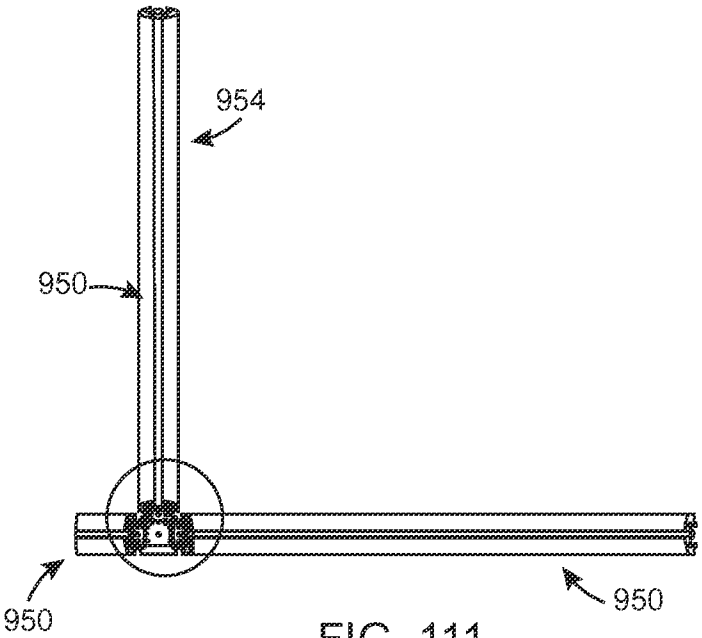
FIG. 111 is a cross-sectional view of a glass post panel three-way assembly according to a preferred embodiment of the present invention.

FIG. 111 is a cross-sectional view of a glass post panel three-way assembly 954. FIG. 112 is an enlarged view of a portion of the glass post three-way panel assembly 954.

Figure 116:
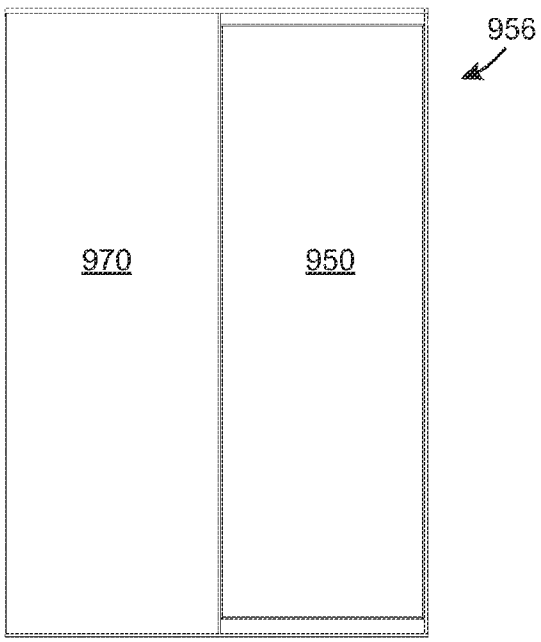
FIG. 116 is a side elevational view of what is shown in FIG. 113.
Figure 117:
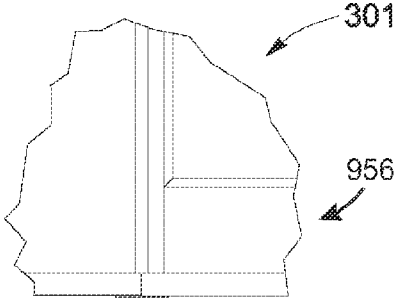
FIG. 117 is an enlarged view of a bottom portion of what is shown in FIG. 116.
Figure 114:
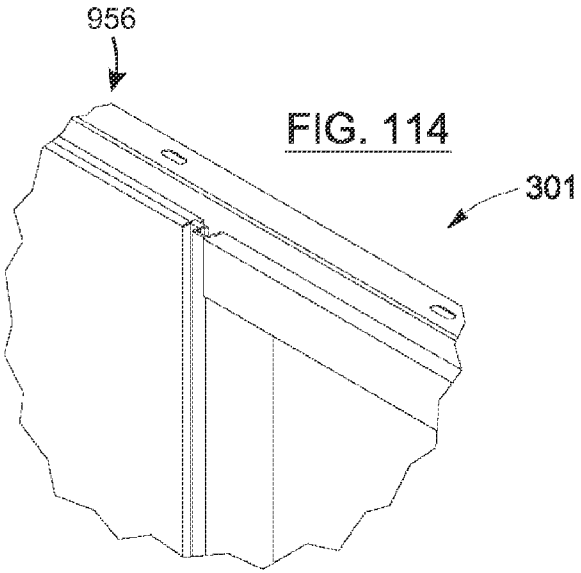
FIG. 114 is an enlarged view of a top portion of what is shown in FIG. 113.
Figure 115:
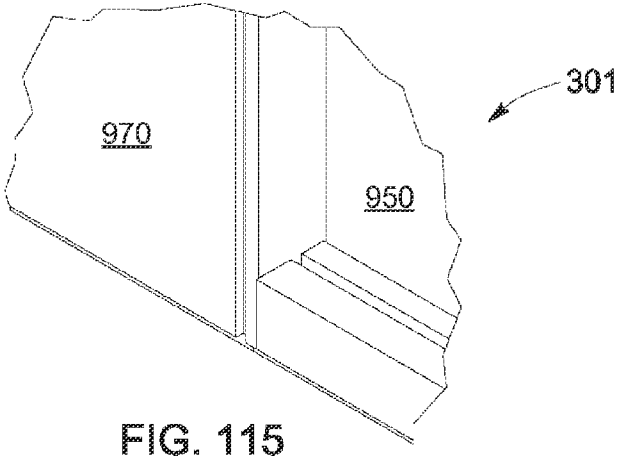
FIG. 115 is an enlarged view of a bottom portion of what is shown in FIG. 113.
Figure 113:
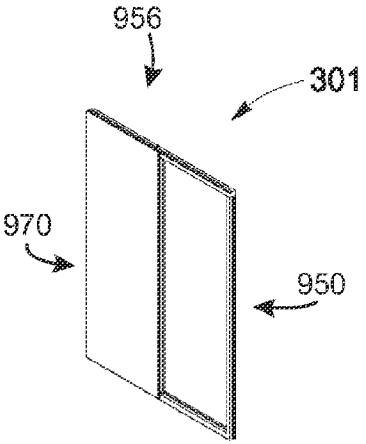
FIG. 113 is a perspective view of a wall panel assembly including a solid panel and a glass post panel assembled onto one another according to a preferred embodiment of the present invention.

FIG. 113 is a perspective view of a wall panel assembly 956 including a solid panel 970 and a glass post panel 950 assembled onto one another according to a preferred embodiment of the present invention. FIG. 114 is an enlarged view of a top portion of the wall panel assembly 956. FIG. 115 is an enlarged view of the wall panel assembly 956. FIG. 116 is a side elevational view of the wall panel assembly 956. FIG. 117 is an enlarged view of a bottom portion of the wall panel assembly 956.

According to a preferred embodiment of the present invention, each prefabricated frameless wall panel (305) of the wall panel system (301) has substantially the same height and the same width, said same height corresponding to a predetermined average height between the floor (307) and the ceiling (309), and each height adjustment assembly (333) being selectively adjusted to compensate for deviations between the floor (307) and the ceiling (309).

In view of the foregoing, some methods of pre-assembling wall panels (305) at a manufacturing site for installation between the floor of the room at the installation, or job site and the ceiling rail (329) secured to the ceiling of the room, are described below. In some embodiments, pre-assembly includes securing a first one of the lower clamp assemblies (472), shown in FIG. 5, to the front and back of the frameless panel (315) at the bottom portion of the frameless panel (315). As second one of the lower clamp assemblies (472) is also optionally secured to the bottom portion of the frameless panel (315), the first and second clamp assemblies (472) generally being located toward opposite sides of the frameless panel (315).

As illustrated for example in FIGS. 7 and 8, the bottom floor channel (331) is extended in a lengthwise direction between the right and left sides of the panel (315) along the bottom of the frameless panel (315). A first one of the height adjustment mechanisms (333) is secured to the first one of the lower clamp assemblies (472) and the bottom floor channel (331), the first adjustment mechanism (333) being configured to selectively modify the vertical position of the frameless panel (315). A second one of the height adjustment mechanisms (333) is secured to the bottom floor channel (331), the second height adjustment mechanism (333) being configured to selectively modify a vertical position of the frameless panel (315) independent of the first height adjustment mechanism (333). As illustrated, the first height adjustment mechanism (333) and the second height adjustment mechanism (333) can be disposed at opposing bottom corners of the frameless panel (315). Thus, during installation, a user (not shown) is able to selectively raise the left and right sides of the frameless panel (315) (e.g., manually or using a power tool), according to some embodiments.

In some embodiments, the ceiling track (327), shown in FIG. 6, is extended in a lengthwise direction between the right and left sides of the frameless panel (315) along the top of the frameless panel (315), the ceiling track (327) being configured to be removably inserted into the ceiling rail (329). In particular, one of the upper, or top clamp assemblies (326) is secured to the front and the back of the frameless panel (315) at the top portion of the frameless panel (315) and the upper clamp assembly (326) is secured to the ceiling track (327), using a bolt fastener, for example. In some embodiments, a second one of the upper clamp assemblies (326), illustrated in FIG. 4, is secured to the top portion of the frameless panel (315), the first and second upper clamp assemblies (326) being generally located toward opposites sides of the panel (315). Following pre-assembly, one or more of the pre-assembled wall panels (305) are delivered to the installation site. In some embodiments, a plurality of pre-assembled wall panels (305) are provided as a shipping kit or kit of parts to the installation site with additional components of the wall panel system (301).

As shown in FIGS. 148 and 149, some methods of installing the wall panel system (301) between the floor of the room and the ceiling rail (329) include aligning the ceiling track (327) of the pre-assembled wall panel (305) with the ceiling rail (329). The ceiling track (327) is removably inserted into the ceiling rail (329) by angling or tilting the top of the wall panel (305) forward. The bottom of the wall panel (305) is the brought forward and the floor channel (331) is operatively rested against the floor with the ceiling track (327) received in the ceiling rail (329). A vertical position of the pre-assembled wall panel (305) is then adjusted by actuating one more of the adjustment mechanisms (333) with the ceiling track (327) being constrained front to back by the ceiling rail (329) while also being able to slide up and down vertically as the vertical position of the pre-assembled wall panel (305) is adjusted.

In some embodiments, height adjustment is accomplished manually (i.e., without the assistance of a powered tool, such as an electric drill). In other embodiments, the adjustment mechanisms are actuated using a power tool. In some embodiments, (e.g., as shown in FIGS. 19-22), actuating the adjustment mechanism includes driving a first end of a first leg and first end of a second leg toward one another, a second end of the first leg being pivotably connected relative to a second end of the second leg. In some embodiments (e.g., as shown in FIGS. 28-33), actuation of the adjustment mechanism (e.g., using a worm gear such as the worm gear 466) includes rotating the first, second, and third members (334, 336, 338) relative to one another to telescopically extend the third member (338) from the second member (336) and the second member (336) from the first member (334). As illustrated, a bottom cover (509) fits along the bottom.

According to another preferred aspect of the invention, the present wall panel system (301) may be used with and further comprises at least one framed wall panel (567) to be assembled with at least one other wall panel (305, 315, 567) of the wall panel system (301), whether a "frameless" wall panel (315) or a "framed" wall panel (567). The assembling of wall panels (305, 315, 567) is via corresponding components, as exemplified in the accompanying drawings, and preferably, a pair of integrated and power-drivable height adjustment assemblies (333) is also associated with each framed wall panel (567) and is insertable into (or comes pre-assembled with) a corresponding bottom floor channel (331) of the framed wall panel (567), each height adjustment assembly (333) comprising a support edge (335) for operatively supporting a bottom distance (569) of the framed wall panel (567), so as to selectively raise or lower the framed wall panel (567) by raising or lowering the bottom distance channel (569) thereof accordingly, thereby allowing a vertical height adjustment of the framed wall panel (567) and a rotational angle adjustment thereof, similarly to each "frameless" wall panel (315) of the wall panel system (301).

Preferably, the framed wall panel (567) comprises a dropdown cover (571), said dropdown cover (571) being nestable within the bottom distance channel (569) of the framed wall panel (567) and being operable between lowered and raised configurations so as to selectively have access to the height adjustment assemblies (333) associated with the framed wall panel (567), as can be easily understood when referring to FIGS. 144-147.

Preferably, the dropdown cover (571) is spring loaded with a corresponding spring (573) disposed between the bottom distance channel (569) and the dropdown cover (571), so as to urge the dropdown cover (571) towards a lowered configuration, against the floor (307), as can be easily understood when referring to FIGS. 146 and 147.

Figure 118:
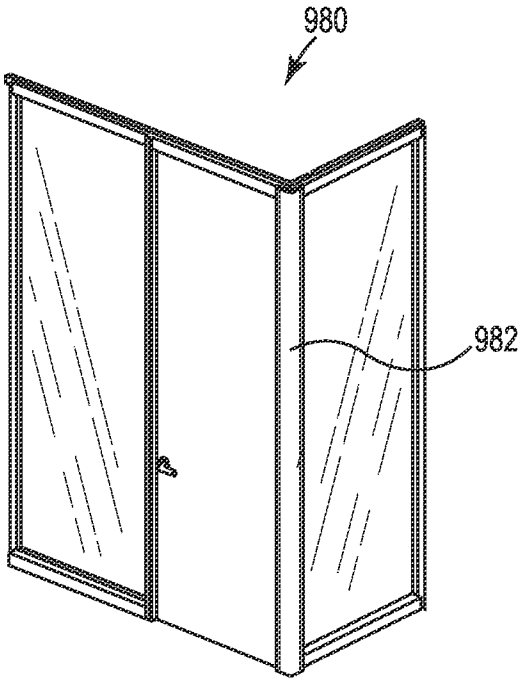
FIG. 118 is a perspective view of a wall panel assembly including a door post according to a preferred embodiment of the present invention.
Figure 119:
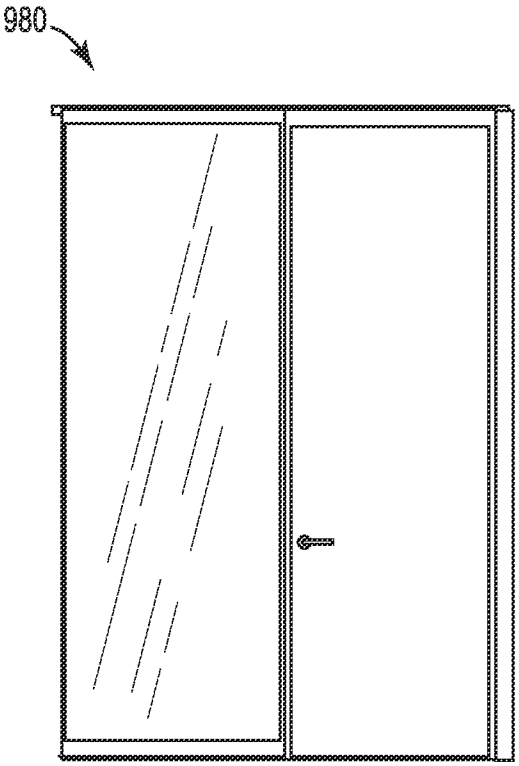
FIG. 119 is a side elevational view of what is shown in FIG. 118.
Figure 120:
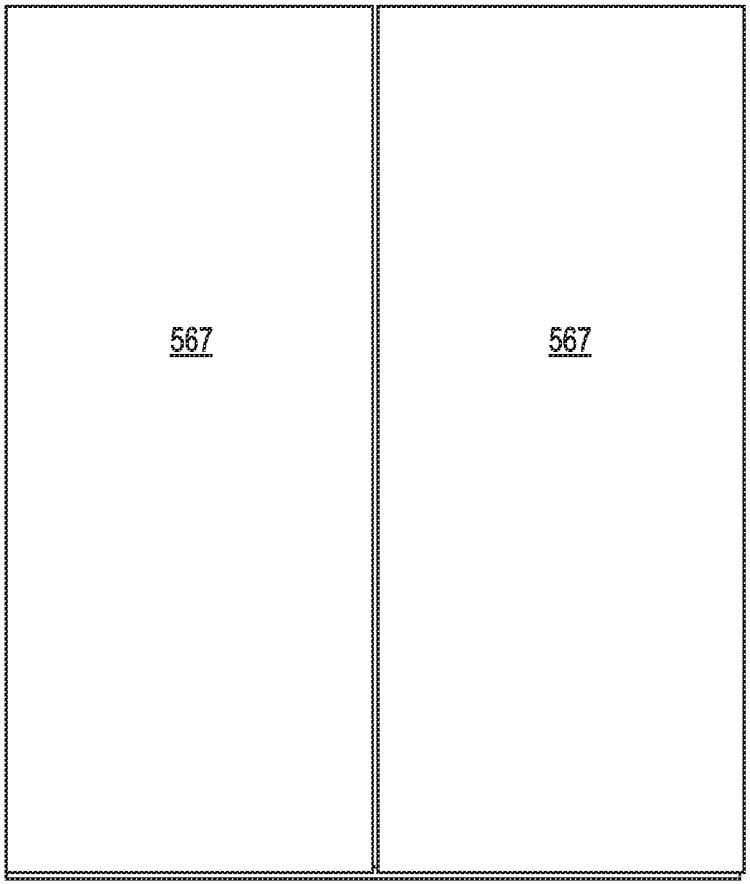
FIG. 120 is a side elevational view of a wall panel assembly comprising two solid panels assembled onto one another according to a preferred embodiment of the present invention.
Figure 122:
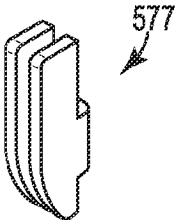
Figure 123:
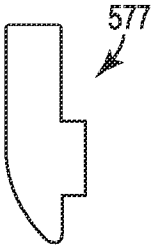
Figure 124:
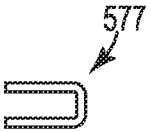
Figure 121:
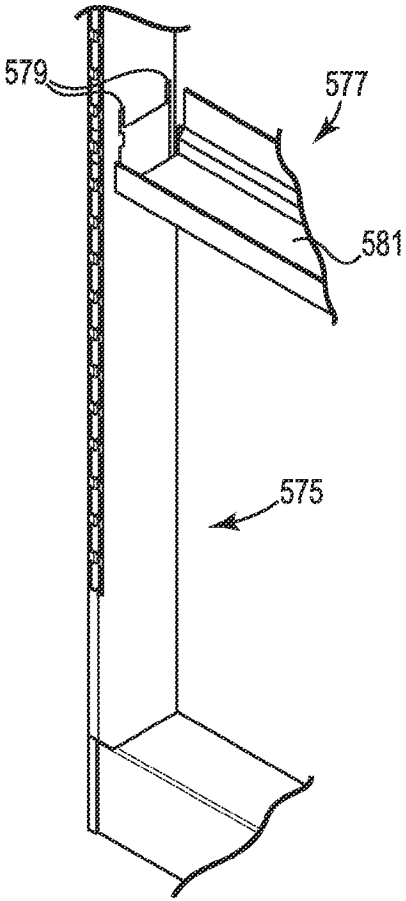
Figure 125:
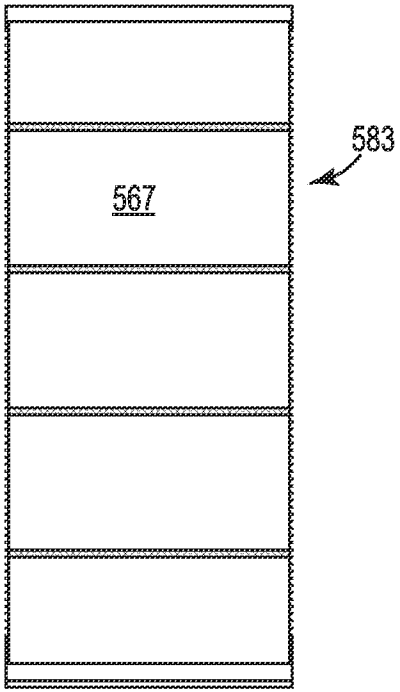
Figure 126:
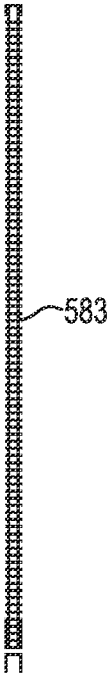
Figure 128:
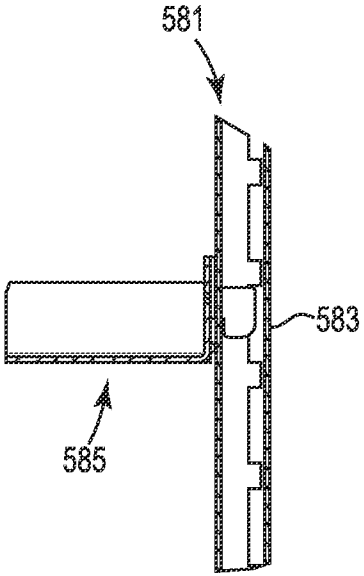
Figure 127:
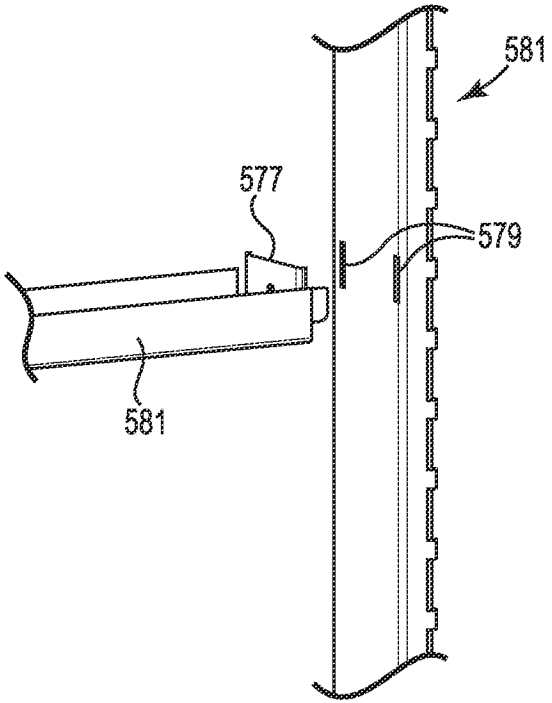
Figure 130:
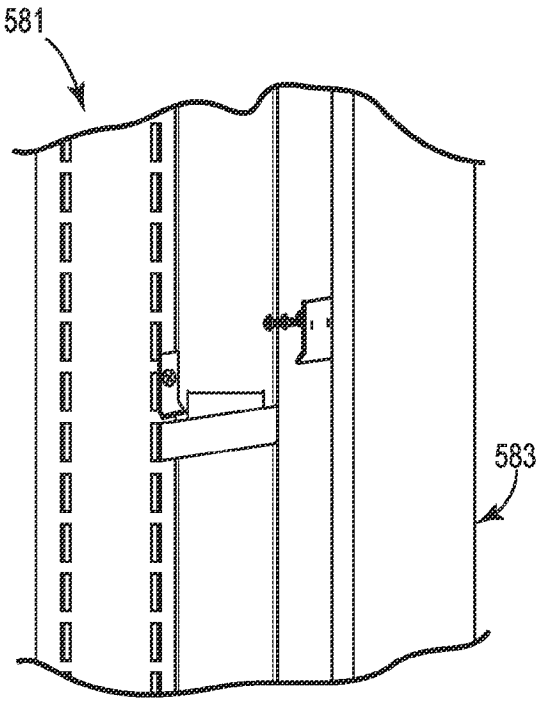
Figure 131:
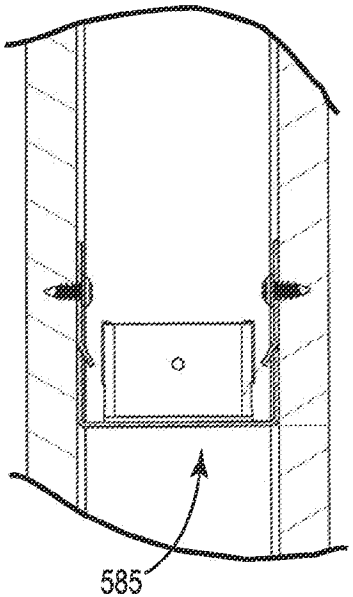
Figure 129:
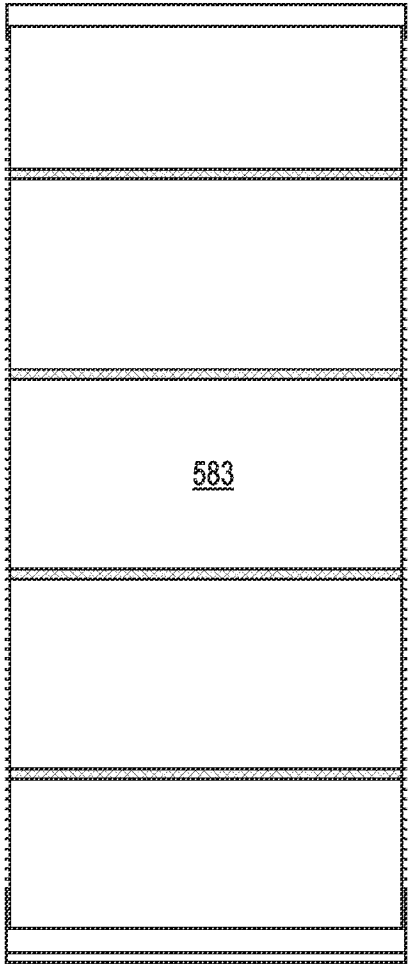
Figure 132:
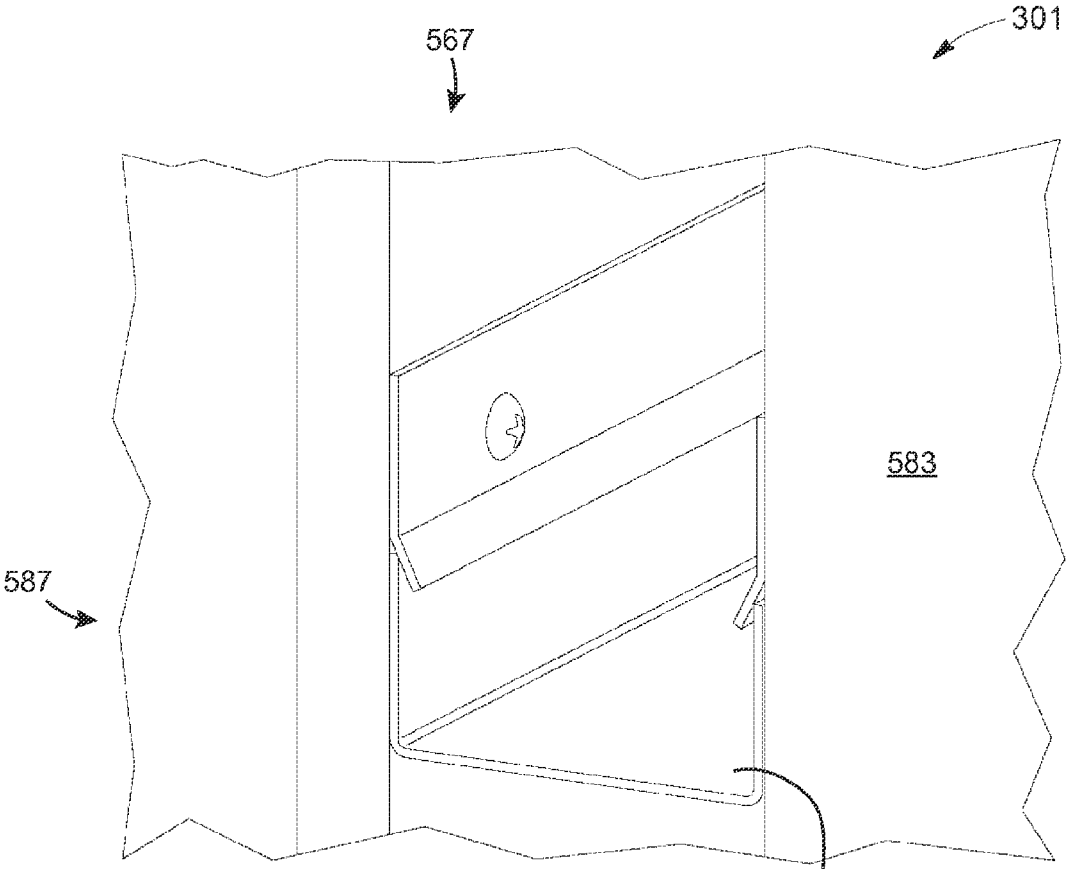

FIG. 118 is a perspective view of a wall panel assembly 980 including a door post 982 according to a preferred embodiment of the present invention. FIG. 119 is a side elevational view of the wall panel assembly 980.

Referring now to FIGS. 120-124, first and second neighboring framed wall panels (567) are connected to one another with at least one post connection clip (577) being removably insertable into a pair of slots (579) of adjacent vertical posts (575).

According to another preferred embodiment of the present invention, the framed wall panel (567) comprises an intermediate distance channel (581), and an outer covering (583) provided with an inner hanging component (585), the outer covering (583) being mounted onto the framed wall panel (567) by hanging the hanging component (585) thereof onto the intermediate distance channel (581), as can be easily understood when referring to FIGS. 125-132.

The outer covering (583) may be a metallic shell (583), in which case, the inner hanging component (585) thereof is also preferably a stiffening component (587) for providing structural rigidity to the metallic shell (583), as exemplified in FIGS. 133 and 134.

FIG. 135 is a cross-sectional view of a solid panel MDF/stackable and glass pole panel assembly 990 according to a preferred embodiment of the present invention including a wall structure 1102 made of a first material.

FIG. 136 is a cross-sectional view of a solid panel MDF/stackable and glass pole panel assembly 992 according to another preferred embodiment of the present invention, including a wall structure 1104 made of a second material and including a layer 1106.

According to yet another preferred embodiment of the present invention, and as better shown in FIGS. 137-140, the framed wall panel (567) may comprise a horizontal hooking channel (589) defined between a pair of stacked components (1591) of the framed wall panel (567), the hooking channel (589) being configured for receiving at least one hooking bracket (591).

Preferably, each hooking bracket (591) comprises a hooking portion (593) and hanging portion (595), the hooking portion (593) of the hooking bracket (591) being complementary in shape to that of the hooking channel (589), and the hooking channel (589) preferably comprises a groove (597) being shaped concave upwardly, as exemplified in FIG. 139.

FIG. 141 is a side elevational view of a wall panel assembly 1002 disposed along a clear story configuration according to a preferred embodiment of the present invention. FIG. 142 is an enlarged cross-sectional view of a top portion of the wall panel assembly 1002. FIG. 143 is an enlarged view of a bottom portion of the wall panel assembly 1002.

FIG. 144 is a fragmentary perspective view of a framed glass panel 1004 being provided with a dropdown cover 1006 according to a preferred embodiment of the present invention. FIG. 145 is a bottom perspective of the framed glass panel 1004, the framed glass panel 1004 being now without a bottom cover 1008.

Preferably, the wall panel system (301) comprises at least one other complementary wall panel (599) selected from the group consisting of glass post panel, solid panel, door post, metallic frame panel, stackable panel and clear story panel, so as to enable a variety of assemblies of different wall panels, as exemplified in the accompanying drawings.

As may now be better appreciated, the present invention is a substantial improvement over conventional wall panel systems, as can be easily understood by a person skilled in the art when referring to the accompanying drawings, and the present description.

For example, with respect to the "butt-glazed panel" embodiment of the present invention, it may have the following components, features, dispositions, interrelations, variants and/or resulting advantages, namely: a) modular panels with a continuous base cover and ceiling cover; b) continuous cover and ceiling cover will be assembled on the job side; c) ⅜" tempered glass with a ⅛" chamber on vertical edge for perfect butt joint in 2-way, 3-way or 4-way installation; d) the height of base cover stays constant; e) height adjustment of about +/−1", components travel inside the floor channel and base cover; f) height adjustment will be mechanical operating via power tools or manual (option 1—gear box and counter threaded rod; option 2—rotating, radial connected tubular gears; and option 3—double shaft and gear box); g) adjustment will be accessible from both sides of the panel; h) carpet gripper/seismic floor plate assures consistent and accurate distance/spacing between adjacent panels; i) carpet gripper/seismic floor plate allows panel to be placed in any angle; and j) vertical butt glazed filler/connector assures rigidity and exclusive design look.

With respect to the "carpet gripper/seismic floor attachment" embodiment of the present invention, it may have the following components, features, dispositions, interrelations, variants and/or resulting advantages, namely: a) all panels are secured to the floor channel with the threaded carpet gripper; b) holds dimension, keeps system from growing on the job side; and c) set screws are used as carpet grippers, but also to hold the floor channel in place (in seismic areas, the floor channel is fixed with a nut on the set screw and the plate will be bolted to the floor).

With respect to the "glass post panel" embodiment of the present invention, it may have the following components, features, dispositions, interrelations, variants and/or resulting advantages, namely: a) glass panels are modular unitized panels with a recessed base; b) glass panels accept ¼" and ⅜" glass; c) glass panel frame consists of an aluminum or steel slotted post cladded with aluminum extrusions; d) panel to panel connection is achieved by hooking clips inserted into slotted standard punched along the vertical edges of the post; e) there will be a approx ⅜" reveal between panels; f) top distance channel 2.5" bottom distance channel 3"; g) height adjustment of about +/−1", travelling inside the floor channel—glass is preferably held in place by a clamp secured to the frame; h) recessed base with incorporate spring-loaded dropdown cover concealing the height adjustment mechanism; i) spring-loaded dropdown cover pre-assembled in factory; and j) post and distance channels designed with a radius of about 4".

With respect to the "solid panel" embodiment of the present invention, it may have the following the following components, features, dispositions, interrelations, variants and/or resulting advantages, namely: a) solid panels are modular unitized panels with a recessed base; b) solid panels are stackable; c) solid panel frame is steel, with vertical slotting in the post; d) panel to panel connection by clip in steel slotting post; e) slotting in the post will also provide way of hanging of different kinds of accessories (i.e. overheads, work surfaces, furniture, shelving, etc.)—also, this could be achieved horizontally via horizontal track channel; f) shells are clipped or hung with the stiffeners to the frame into steel/spring steel clips which are fastened to the inside of the frame or hung horizontally; g) recessed base with incorporated spring-loaded dropdown cover; h) height adjustment of about +/−1", traveling inside the floor channel, clamp is screwed to the frame; i) height will be adjusted with a power tool from the side of the panel; j) optional continues horizontal hooking channel incorporated in the frame; k) optional continuous horizontal hooking channel with stackable panels; and l) total width of hooking channel is ⅜", slot is shaped round to accept a same shape bracket, designed to prevent bracket from falling out.

With respect to the "height adjustment assembly" embodiment of the present invention, it may have the following components, features, dispositions, interrelations, variants and/or resulting advantages, namely: a) height adjustment of about +/−1", traveling inside the floor channel, clamp is screwed to the frame or is clamping ⅜" or ½" glass; b) height will be adjusted with a power tool from the side of the panel; c) a gear box assembly operates the counter-threaded rod which in turn operates the steel, cross-attached arms which are secured to the glass holding clamps; and d) the height adjustment is accessible from both sides.

According to the present invention, the wall panel system and corresponding parts are preferably made of substantially rigid materials, such as metallic materials (aluminum, stainless steel, etc.), hardened polymers, composite materials, and/or the like, whereas other components thereof according to the present invention, in order to achieve the resulting advantages briefly discussed herein, may preferably be made of a suitably malleable and resilient material, such as a polymeric material (plastic, rubber, etc.), and/or the like, depending on the particular applications for which the wall panel system and resulting working space are intended for and the different parameters in cause, as apparent to a person skilled in the art.

As may now also be further appreciated, the wall panel system according to the present invention is an improvement over the prior art in that it provides a moveable non-progressive mountable and demountable wall panel system, particularly well suited for mounting frameless wall panels, such as butt-glazed wall panels, for example, in a very fast, easy, convenient, proper, systematic and cost-effective manner, thereby avoiding the corresponding drawbacks of the "stick-built" approach of conventional wall panel systems.

Of course, numerous modifications can be made to the above-described embodiments without departing from the scope of the invention as defined in the appended claims. For example, FIGS. 150-177 show features of a wall panel system 301, according to some embodiments.

FIGS. 150-152 show components of a pre-assembled frameless wall panel 305, according to some embodiments. As shown, the wall panel 305 includes various components similar to those previously described. In some embodiments, the pre-assembled frameless wall panel 305 includes a pair of spaced apart, top clamp assemblies (326) (shown in greater detail in FIG. 151), a pair of ceiling tracks (327), each of which is configured to be secured to a corresponding one of the top clamp assemblies (326). The pre-assembled frameless wall panel (305) also includes a wall panel (315), a pair of height adjustment assemblies (333) (shown in greater detail in FIG. 152), and a bottom floor channel (331). While various components are shown provided in pairs, greater or fewer than two components are contemplated.

FIGS. 153-155 show a sliding door frame (800) for use with the wall panel system (301). Generally, a sliding door assembly (e.g., such as the sliding door assembly (541)) is operatively secured to the sliding door frame (800). As shown, the sliding door frame (800) includes a first jamb (802), a second jamb (804), and a header (806) extending between the first and second jambs (802, 804).

According to some embodiments, the first and second jambs (802, 804) are mirror images of one another and thus, features of both jambs (802, 804) are described in associate with the first jamb (802). FIG. 154 is partial view of the door frame (800) in area 154-154 designated in FIG. 153 and FIG. 155 is a top view of FIG. 154, according to some embodiments. As shown in FIG. 155, the first jamb (802) includes a clamp assembly (810) for clamping an adjacent frameless panel (not shown) of the wall panel system (301) and an inner cover assembly (812) for presenting an aesthetically pleasing surface to a user of the system (301).

In some embodiments, the clamp assembly (810) defines a receiving channel (813) for clamping onto a vertical edge of an adjacent, frameless panel, the clamp assembly (810) including a first portion (820) and a second portion (822), the first and second portions (820, 822) being configured to form a complementary fit to define the receiving channel (813). As shown, the clamp assembly (810) also includes retention members (824, 826) configured to be secured in an opposing manner to the first and second portions (820, 822), respectively.

The cover assembly (812) optionally includes securing means for securing the cover assembly (812) to the clamp assembly (810). In some embodiments, the securing means is a gasket (830) received by the cover assembly (812) and the clamp assembly (810) for frictionally retaining the cover assembly (812) to the clamp assembly (810) as shown in FIG. 155.

In some embodiments, assembly of the wall panel system (301) includes securing the first and second portions (820, 822) on opposing sides of a vertical edge of an adjacent, frameless panel and securing the portions (820, 822) together using one or more fasteners (832) to secure the frameless panel (not shown) and associated portions of the system (301) to the first jamb (802). The second jamb (804) is optionally secured to another frameless panel (not shown) of the system (301) and the header (806) is secured between the first and second jambs (802, 804). In some embodiments, a sliding door assembly (e.g., such as the sliding door assembly (541)) is operatively secured to header (806).

FIGS. 156-161 show additional features of the wall panel system (301) for further enhancing resistance of the system (301) against unwanted movement, such as that associated with seismic activity, for example. FIGS. 156 and 157 show an upper bracket (900) secured to adjacent ceiling tracks (327A, 327B) (e.g., similar to the ceiling track (327)) and the ceiling rail (329), the upper bracket (900) reinforcing or otherwise enhancing resistance of the system (301) to unwanted movement. As shown in FIGS. 158 and 159, the upper bracket (900) includes a first vertical leg (902) and a second vertical leg (904), the first vertical leg (902) being positioned above, and offset rearwardly from, the second vertical leg (904). The first vertical leg (902) is also substantially narrower than the second vertical leg (904), according to some embodiments. As shown, the first and second vertical legs (902, 904) include a plurality of apertures (906) for receiving fasteners, such as self-tapping screws (908) (FIGS. 156 and 157).

As shown in FIGS. 156 and 157, the upper bracket (900), also described as an upper interconnector, is centrally positioned between the adjacent ceiling tracks (327A, 327B), the first vertical leg (902) is secured to the ceiling rail (329), and the second vertical leg (904) is secured to the adjacent ceiling tracks (327A, 327B) using the self-tapping screws (908). In at least this manner, the adjacent ceiling tracks (327A, 327B) of the system (301) are secured together and are also secured to the ceiling rail (329) to provide additional resistance to unwanted movement of the system (301).

FIGS. 160-162 show a lower bracket (930) that is adapted to be received within adjacent bottom floor channels (331A, 331B) and secured to a floor to enhance resistance of the system (301) against unwanted movement. As shown in FIGS. 160 and 162, the lower bracket (930) is formed as an elongate piece of U-channel with relatively short sidewalls, the lower bracket (930) including two centrally located apertures (932).

In use the lower bracket (930), also described as a lower interconnector, is received within the adjacent, bottom floor channels (331A, 331B) and a fastener (not shown) such as a cement nail, is driven through the apertures (932) into the floor to help fasten the bottom floor channels (331A, 331B) to the floor.

FIGS. 163-167 show another height adjustment assembly (333), according to some embodiments. As shown, the height adjustment assembly (333) includes a scissors-type height adjustment mechanism including a base (339), opposite first and second end caps (441, 443) projecting from the base (339), and a height adjusting rod (445) being rotatively mounted about the end caps (441, 443). The height adjusting rod (445) has first and second threaded segments (447, 449) each being oppositely threaded with respect to one another. The height adjustment assembly (333) also includes first and second adjustment legs (451, 453), the first adjustment leg (451) having an extremity pivotably mounted onto a runner component (455) threadedly engaged onto the first threaded segment (447) of the height adjusting rod (445) and a second extremity pitovably mounted onto a support edge (335). As shown, the second adjustment leg (453) has an extremity pivotably mounted onto a runner component (457) threadedly engaged onto the second threaded segment (449) of the height adjusting rod (445) and a second extremity pitovably mounted onto the support edge (335), such that a rotation of the common height adjusting rod (445) along a first direction causes a raising of the support edge (335), and a rotation of said common height adjusting rod (445) along a second and opposite direction causes a lowering of the support edge (335).

Figure 165:
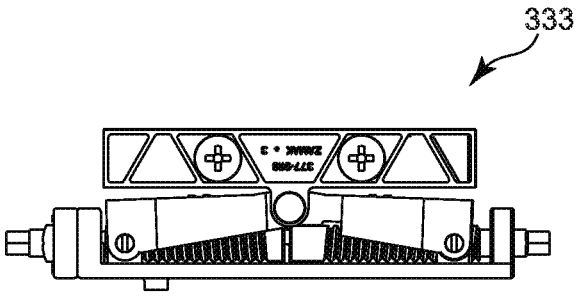
Figure 166:
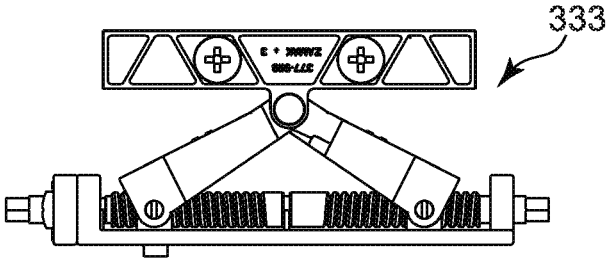
Figure 167:
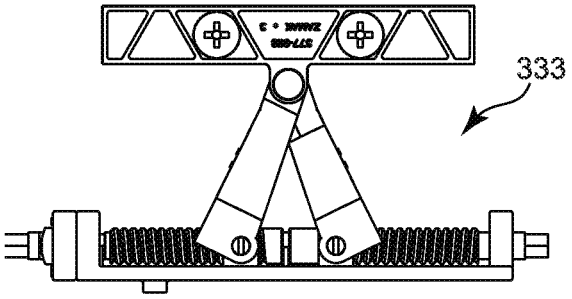

In some embodiments, the second extremities of the first and second adjustment legs (451, 453) are pivotably mounted onto a bottom portion of the support edge (335) about a common pivot axis (459), as better shown in FIGS. 17, 18, 21 and 22. The adjustment legs (451, 453) optionally include recessed portions (451A, 453A) for avoiding, or receiving, a portion of the height adjusting rod (445) when the adjustment legs (451, 453) are drawn down into a lowered configuration. FIGS. 165-167 demonstrate movement of the height adjustment assembly (333) between a retracted or collapsed state (FIG. 165), an intermediate state (FIG. 166) and an extended, or expanded state (FIG. 167).

FIGS. 168-177 show various features and components of a wall panel system (301) including a plurality of pre-assembled wall panels (305) similar to the pre-assembled wall panel (305) shown in FIG. 150. FIG. 168 shows a front, perspective view of the wall panel system (301) including a plurality of adjacent pre-assembled wall panels (305), the plurality of wall panels (305) including a first pre-assembled wall panel (305A), a second preassembled wall panel (305B), and a third pre-assembled wall panel (305C). As shown, the panels (305) include through holes (513) that are configured for use with a rail and tile system (950).

In some embodiments, the rail and tile system (950) includes a plurality of rails (952) forming a support framework and a plurality of tiles (954) supported by the framework. The tiles (954) are optionally secured to the rails (952) by fasteners, clips, brackets, adhesives or other securing means as desired. A variety of rail and tile system configurations are contemplated, where FIG. 169 shows rails (952) for supporting a tile (954) or tiles (954) formed of one or more pieces of fabric, FIG. 170 shows rails (952) for supporting a tile (954) or tiles (954) formed of a veneer or laminate material, and FIG. 171 shows rails (952) for supporting a tile (954) or tiles (954) formed of laminated glass that can be used as a marker board, for example.

FIG. 172 shows a back, perspective view of the system (301) with a second rail and tile system (950B) mounted to the back side of the system (301). The rail and tile system (950B) is shown in FIG. 172 with the tiles removed to show apertures (956B) in the rails (952B) for securing the rails to the panels (305A, 305B, 305C) using the through holes (513). For example, fasteners such as bolts and washers (FIG. 174) are threaded through the holes (513) to secure the rail and tile systems (950, 950B) in place on opposite sides of the panels (305A, 305B, 305C).

As shown in FIG. 168, wall panel accessories such as a shelf (960) or a table extension (962) are optionally secured (e.g., cantilevered) into the rails (952) or features (not shown) included in the tiles (954). FIG. 173 is an enlarged, cross-sectional view along line 173-173 in FIG. 172 with the second rail and tile system (950B) removed for ease of illustration. As shown, the shelf (960) is inserted into an opening in the rail (952) such that the shelf (960) is cantilevered to the rail (952). As shown in FIG. 168, one or more of the tiles (954) includes an opening or other features for receiving an electrical outlet assembly (964). The electrical outlet assembly (964) includes any of a variety of low, standard, or high voltage outlet means, such as a 110V electrical outlet, a LAN receptacle, an RF cable receptacle, or others. FIG. 172 shows the electrical outlet assembly (964) from a rear view (as viewed through the glass of the panel (305B)), where FIG. 175 is an enlarged view of area 175-175 of FIG. 172. As shown in FIG. 175, the electrical outlet assembly (964) includes a bracket (966) that is secured to the tile (954) using fastening means, such as screws, for example. The electrical outlet assembly (964) is optionally secured to a conduit feed assembly (FIG. 176) which is connected to an electrical source (e.g., 110V power source, a LAN connection, cable t.v., or other). If desired, the conduit feed assembly can be run down to the bottom cover (509) (FIG. 168) and through the bottom cover (509) to the electrical source. The electrical outlet assembly (964) thereby provides an effective and readily assembled solution for deploying outlets with the system 301.

FIGS. 176 and 177 show components of another electrical outlet assembly (970) that is configured to be mounted at the bottom of the system (301) adjacent the bottom floor channels (331). As shown, the electrical outlet assembly (970) includes a first outlet (972), a second outlet (974), an electrical interconnect (976), a first mounting bracket (978), a second mounting bracket (980), a conduit feed assembly (982), and a modified bottom cover (984) that works similarly to bottom cover (509).

The first and second outlets (972, 974) are optionally electrically connected by electrical interconnect (976). As shown, the first and second outlets (972, 974) are configured as U.S. standard 110V outlets, although as mentioned with the electrical outlet assembly (964) any of a variety of outlet configurations are contemplated. In some embodiments, the first bracket (978) is configured to clip onto the first outlet (972) and the second bracket (980) is similarly configured to clip onto the second outlet (974).

In some embodiments, the modified bottom cover (984) includes a first opening (990) for operatively exposing the first outlet (972) for a user and a second opening (992) for operatively exposing the second outlet (974) for the user. The cover (984) also includes a first slot (996) for receiving a portion of the first bracket (978) in a snap fit relationship and a second slot (998) for receiving a portion of the second bracket (980) in a snap fit relationship and defines an upper channel (999) configured to receive the first and second outlets (972, 974), the electrical interconnect (976), the first and second mounting brackets (978, 980), and the conduit feed assembly (982).

FIG. 177 is an end view showing the snap-fit, or clipped together relationship of the second bracket (980) and the bottom cover (984) with other portions of the assembly (970) removed for ease of illustration. As shown, the second bracket (980) is snapped into the bottom cover (984) with a lower portion (1000) of the second bracket (980) protruding through the second slot (998) (hidden in FIG. 177). With the components fully or partially assembled together, the bottom cover (984) is secured to one or more of the bottom channels (331) and the conduit feed assembly (982) is connected to an electrical source (e.g., 110V power source, a LAN connection, cable t.v., or others). The electrical outlet assembly (970) thereby provides an effective and readily assembled solution for deploying low and/or high voltage outlets with the system (301).

Although various features of modular wall systems and associated methods have been described, it should be understood a variety of different features and combinations thereof are contemplated without departing from the scope of invention. For example, while the embodiments described above refer to particular features, the scope of invention also includes embodiments having different combinations of features and embodiments that do not include all of the described features. Accordingly, the scope of invention is intended to embrace all such alternatives, modifications, and variations as fall within the claims, together with all equivalents thereof.

We claim:

1. A method of making a pre-assembled wall panel at a manufacturing site for installation between a floor of a room at a job site and a ceiling rail secured to a ceiling of the room at the job site, the method comprising:

providing a panel having a top, a bottom, a left side, a right side, a front, and a back, the panel defining a top portion toward the top and a bottom portion toward the bottom of the panel, the panel being substantially frameless on at least the left and right sides of the panel;

securing a bottom clamp assembly to the front and back of the panel at the bottom portion of the panel; and securing an adjustment mechanism to the bottom clamp assembly, the adjustment mechanism being configured to expand and contract in height to selectively modify a vertical position of the panel and a vertical position of the bottom clamp assembly.

2. The method of claim 1, further comprising extending a bottom floor channel in a lengthwise direction between the right and left sides of the panel below the bottom of the panel and securing the adjustment mechanism to the bottom floor channel.

3. The method of claim 1, further comprising extending a ceiling track along the top of the panel and securing the ceiling track to the top portion of the panel.

4. The method of claim 3, further comprising clamping the ceiling track to the top portion of the panel.

5. The method of claim 1, further comprising shipping the pre-assembled wall panel from the manufacturing site.

6. A method of installing a wall panel system between a floor of a room and a ceiling rail extending along and secured to a ceiling of the room, the method comprising:

inserting a ceiling track of a pre-assembled wall panel into the ceiling rail, the pre-assembled wall panel having a top and a bottom and including:

a panel having a top, a bottom, a left side that is free of a vertical frame member, a right side that is free of a vertical frame member, a front, and a back, the panel defining a top portion toward the top of the panel and a bottom portion toward the bottom of the panel;

an upper attachment assembly secured to the front of the panel and to the back of the panel at the top portion of the panel, the upper attachment assembly coupling the ceiling track to the top of the panel;

an adjustment mechanism secured to the bottom portion of the panel by a lower attachment assembly secured to the front of the panel and to the back of the panel at the bottom portion of the panel;

operatively resting the bottom of the pre-assembled wall panel against the floor; and adjusting a vertical position of the pre-assembled wall panel by actuating the adjustment mechanism, the ceiling track of the pre-assembled wall panel being constrained front to back by the ceiling rail while being able to slide up and down vertically as the vertical position of the pre-assembled wall panel is adjusted, wherein actuating the adjustment mechanism adjusts a vertical position of the panel and a vertical position of the lower clamp assembly.

7. The method of claim 6, wherein operatively resting the bottom portion of the pre-assembled wall panel against the floor includes operatively resting a bottom floor channel of the pre-assembled wall panel against the floor opposite the ceiling rail extending along the ceiling, the bottom floor channel receiving the adjustment mechanism and extending in a lengthwise direction below the bottom of the panel.

8. The method of claim 6, further comprising securing a connecting plate to the pre-assembled wall panel to align the bottom floor channel to an adjacent bottom floor channel of a second, adjacent pre-assembled wall panel that is substantially similar to the pre-assembled wall panel such that the pre-assembled wall panel is aligned to the second, adjacent pre-assembled wall panel.

9. The method of claim 6, wherein the adjustment mechanism is actuated manually.

10. The method of claim 6, wherein the adjustment mechanism is actuated using a power tool.

11. The method of claim 6, wherein actuating the adjustment mechanism includes driving a first end of a first leg and a first end of a second leg toward one another, a second end of the first leg being pivotably connected relative to a second end of the second leg.

12. The method of claim 6, wherein the adjustment mechanism includes a first substantially vertical member having inner threads and outer threads and a second substantially vertical member having outer threads, the second member being telescopically received in the first member, the method further comprising rotating the first and second members relative to one another to telescopically extend the second member from the first member.

13. A method of pre-assembling wall panels at a manufacturing site for installation between a floor of a room at a job site and a ceiling rail secured to a ceiling of the room, the method comprising:

providing a panel having a top, a bottom, a left side that is frameless, a right side that is frameless, a front, and a back, the panel defining a top portion toward the top of the panel and a bottom portion toward the bottom of the panel;

securing a lower clamp assembly to the front of the panel and the back of the panel at the bottom portion of the panel;

extending a bottom floor channel below the bottom of the panel;

securing a first height adjustment mechanism to the lower clamp assembly and the bottom floor channel, the first height adjustment mechanism being configured to selectively modify a vertical position of the panel and a vertical position of the lower clamp assembly; and securing a second height adjustment mechanism to the bottom floor channel, the second height adjustment mechanism being configured to selectively modify a vertical position of the panel independent of the first height adjustment mechanism.

14. The method of claim 13, further comprising coupling a ceiling track along the top of the panel, the ceiling track being configured to be removably inserted into the ceiling rail.

15. The method of claim 14, further comprising clamping the ceiling track to the top portion of the panel.

16. The method of claim 13, further comprising shipping a pre-assembled wall panel from the manufacturing site.

17. A method of installing a wall panel system between a floor of a room and a ceiling rail extending along and secured to a ceiling of the room, the method comprising:

removably inserting a ceiling track of a pre-assembled wall panel into the ceiling rail, the pre-assembled wall panel including:

a panel free from a frame extending around the panel to support the panel, the panel having a top, a bottom, a left side, a right side, a front, and a back, the panel defining a top portion and a bottom portion, the ceiling track being coupled to the panel at the top portion of the panel, the ceiling track extending in a lengthwise direction along the top portion of the panel;

operatively resting a bottom floor channel of the pre-assembled wall panel against the floor of the room opposite the ceiling rail extending along the ceiling of the room, the bottom floor channel receiving a first height adjustment mechanism and a second height adjustment mechanism and extending along the bottom portion of the panel, the first height adjustment mechanism being secured to the bottom portion of the panel by a lower clamp assembly that is secured to the front and the back of the panel at the bottom portion of the panel; and adjusting a vertical position of the pre-assembled wall panel by independently actuating the first height adjustment mechanism and the second height adjustment mechanism, the ceiling track of the pre-assembled wall panel being constrained front to back by the ceiling rail while being able to slide up and down vertically as the vertical position of the pre-assembled wall panel is adjusted, wherein actuating the first height adjustment mechanism adjusts a vertical position of the panel and a vertical position of the lower clamp assembly.

18. The method of claim 17, wherein the first height adjustment mechanism is actuated manually.

19. The method of claim 17, wherein the first height adjustment mechanism is actuated using a power tool.

20. The method of claim 17, wherein actuating the first height adjustment mechanism includes driving a first end of a first leg and a first end of a second leg toward one another, a second end of the first leg being pivotably connected relative to a second end of the second leg.

21. The method of claim 17, wherein the first height adjustment mechanism includes a first substantially vertical member having inner threads and outer threads and a second substantially vertical member having outer threads, the second member being telescopically received in the first member, the method further comprising rotating the first and second members relative to one another to telescopically extend the second member from the first member.

* * * * *